US011415371B2

(12) United States Patent
Matsumoto et al.

(10) Patent No.: US 11,415,371 B2
(45) Date of Patent: Aug. 16, 2022

(54) HEAT EXCHANGER AND REFRIGERATION APPARATUS

(71) Applicant: DAIKIN INDUSTRIES, LTD., Osaka (JP)

(72) Inventors: Yoshiyuki Matsumoto, Osaka (JP); Shun Yoshioka, Osaka (JP); Shouta Agou, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 174 days.

(21) Appl. No.: 16/498,924

(22) PCT Filed: Mar. 22, 2018

(86) PCT No.: PCT/JP2018/011534
§ 371 (c)(1),
(2) Date: Sep. 27, 2019

(87) PCT Pub. No.: WO2018/180934
PCT Pub. Date: Oct. 4, 2018

(65) Prior Publication Data

US 2020/0049409 A1 Feb. 13, 2020

(30) Foreign Application Priority Data

Mar. 27, 2017 (JP) ..... JP2017-061203
Mar. 27, 2017 (JP) ..... JP2017-061204
(Continued)

(51) Int. Cl.
*F28F 9/02* (2006.01)
*F28D 1/04* (2006.01)

(52) U.S. Cl.
CPC ..... *F28D 1/0408* (2013.01); *F28F 9/02* (2013.01)

(58) Field of Classification Search
CPC .... F28D 1/0408; F28D 1/0417; F28D 1/0426; F28D 1/0452; F28F 9/02
(Continued)

(56) References Cited

U.S. PATENT DOCUMENTS 2,252,064 A 8/1941 Cornell, Jr.
2,820,617 A 1/1958 Tadewald
(Continued)

FOREIGN PATENT DOCUMENTS

CN 101360961 A 2/2009
CN 103062838 A 4/2013
(Continued)

OTHER PUBLICATIONS

International Preliminary Report on Patentability issued in corresponding International Application No. PCT/JP2018/011534 dated Oct. 10, 2019 (7 pages).
(Continued)

*Primary Examiner* — Claire E Rojohn, III
(74) *Attorney, Agent, or Firm* — Osha Bergman Watanabe & Burton LLP

(57) ABSTRACT

A heat exchanger including: rows of heat exchanging units that are superposed with one another in an air flow direction of the heat exchanger; and flat multi-hole tubes that extend from a first end toward a second of the heat exchanging units in a first direction in the heat exchanging units and that include gas-side flat multi-hole tubes. A refrigerant flows in the heat exchanging unit in the first direction. A number of the gas-side flat multi-hole tubes that are included in a front-most row heat exchanging unit on an airflow upstream side of the heat exchanger is less than a number of the gas-side flat multi-hole tubes included in a rear-most row heat exchanging unit on an airflow downstream side of the heat exchanger.

12 Claims, 34 Drawing Sheets

(30) Foreign Application Priority Data

Mar. 27, 2017 (JP) ..... JP2017-061205
Mar. 27, 2017 (JP) ..... JP2017-061232
Mar. 27, 2017 (JP) ..... JP2017-061233
Mar. 27, 2017 (JP) ..... JP2017-061234
Dec. 26, 2017 (JP) ..... JP2017-248904

(58) Field of Classification Search
USPC ..... 165/175
See application file for complete search history.

(56) References Cited

U.S. PATENT DOCUMENTS 4,173,998 A * 11/1979 Jahoda ..... B21D 53/085 165/182
5,076,353 A 12/1991 Haussmann
5,267,610 A * 12/1993 Culbert ..... F28F 1/32 29/890.047
5,509,272 A * 4/1996 Hyde ..... F25B 39/04 62/196.3
5,529,116 A * 6/1996 Sasaki ..... F28D 1/0417 123/41.51
5,988,267 A * 11/1999 Park ..... F28D 1/05375 165/110
6,170,565 B1 * 1/2001 Nishishita ..... F28D 1/0435 165/146
6,273,182 B1 * 8/2001 Pautler ..... F28F 9/002 165/140
6,672,375 B1 * 1/2004 Shippy ..... F28F 1/32 165/122
6,786,056 B2 * 9/2004 Bash ..... H05K 7/20745 62/229
7,757,753 B2 * 7/2010 Yanik ..... F25B 39/00 165/174
8,006,512 B2 * 8/2011 Sanagi ..... F24F 1/0047 62/426
8,037,929 B2 * 10/2011 Higashiyama ..... F28F 17/005 165/172
8,205,470 B2 6/2012 Yoshioka et al.
9,377,225 B2 6/2016 Song et al.
9,618,229 B2 * 4/2017 Shiborino ..... F28D 1/0477
10,101,091 B2 * 10/2018 Higashiiue ..... F25B 39/00
10,670,344 B2 6/2020 Ito et al.
2008/0173434 A1 * 7/2008 Matter ..... F28F 9/262 165/150
2009/0025420 A1 * 1/2009 Kojima ..... F25B 41/20 62/527
2009/0084131 A1 * 4/2009 Reifel ..... F28D 1/0471 29/890.035
2009/0314020 A1 * 12/2009 Yoshioka ..... F24F 1/0047 62/507
2010/0281902 A1 11/2010 Kakizaki et al.
2012/0073786 A1 3/2012 Sakashita et al.
2012/0145364 A1 * 6/2012 Oritani ..... F24F 1/0067 165/172
2012/0234931 A1 9/2012 Hirota et al.
2012/0255703 A1 10/2012 Mishiro et al.
2013/0092355 A1 * 4/2013 Douglas ..... F24F 1/0063 165/104.34
2013/0240176 A1 * 9/2013 Lee ..... F28F 17/005 165/59
2015/0059400 A1 * 3/2015 Okazaki ..... F25B 39/028 165/181
2015/0083377 A1 3/2015 Jindou et al.
2016/0054010 A1 * 2/2016 Suhara ..... F24F 1/0067 62/426
2016/0054075 A1 * 2/2016 Taras ..... F28F 9/02 165/173
2016/0138839 A1 * 5/2016 Suhara ..... F24F 1/0071 62/160
2016/0223265 A1 * 8/2016 Jindou ..... F28F 1/128
2016/0245560 A1 * 8/2016 Higashiiue ..... F28F 9/0278
2016/0290730 A1 * 10/2016 Taras ..... F28F 1/126
2016/0327343 A1 * 11/2016 Hwang ..... F28D 1/0435
2017/0241684 A1 * 8/2017 Ito ..... F25B 13/00
2017/0292720 A1 * 10/2017 Ugajin ..... F24F 1/0025
2017/0336145 A1 * 11/2017 Nakamura ..... F25B 47/025
2018/0058736 A1 * 3/2018 Jin ..... F25B 39/00
2018/0094860 A1 * 4/2018 Sakamaki ..... F28F 1/128
2018/0094874 A1 * 4/2018 Sakamaki ..... F28F 9/22
2018/0135900 A1 * 5/2018 Jindou ..... F25B 13/00
2020/0072517 A1 3/2020 Kato et al.

FOREIGN PATENT DOCUMENTS

CN 103256757 A 8/2013
CN 203396065 U 1/2014
CN 105008809 A 10/2015
EP 1798490 A1 6/2007
EP 1975525 A1 10/2008
EP 2860483 A1 4/2015
EP 2930450 A1 10/2015
EP 3015808 A1 5/2016
EP 3276289 A1 1/2018
JP H08244446 A 9/1996
JP H11-141968 A 5/1999
JP 2000-329486 A 11/2000
JP 2000329486 A * 11/2000 ..... F28D 1/0477
JP 2001-336896 A 12/2001
JP 2002350002 A 12/2002
JP 2002372383 A 12/2002
JP 2005164211 A 6/2005
JP 2005315455 A 11/2005
JP 2006284134 A 10/2006
JP 2006-329511 A 12/2006
JP 2008196811 A 8/2008
JP 2009074754 A 4/2009
JP 2010078234 A 4/2010
JP 2010107102 A 5/2010
JP 2012063089 A 3/2012
JP 2012193872 A 10/2012
JP 2013076521 A 4/2013
JP 2014215011 A 11/2014
JP 2014215017 A 11/2014
JP 2016-038192 A 3/2016
JP 2016038192 A 3/2016
JP 2016177717 A 10/2016
JP 2016183850 A 10/2016
JP 2016205744 A 12/2016
JP 2016217565 A 12/2016
WO 2013183508 A1 12/2013
WO 2015037235 A1 3/2015
WO 2016071953 A1 5/2016
WO 2016/121125 A1 8/2016
WO 2016174830 A1 11/2016

OTHER PUBLICATIONS

International Search Report issued in corresponding International Application No. PCT/JP2018/011534, dated Jun. 12, 2018 with translation (3 pages).
Office Action issued in corresponding U.S. Appl. No. 16/498,724, dated Nov. 17, 2020 (28 pages).
Extended European Search Report issued in corresponding European Application No. 18776928.6 dated Feb. 24, 2020 (4 pages).
Office Action issued in corresponding U.S. Appl. No. 16/498,776 dated Mar. 2, 2021 (16 pages).

* cited by examiner

HEAT EXCHANGER AND REFRIGERATION APPARATUS

TECHNICAL FIELD

The present invention relates to a heat exchanger and a refrigeration apparatus including the heat exchanger.

BACKGROUND

There is a known heat exchanger that includes heat exchanging units arranged so as to be superposed with each other in an air flow direction. In each heat exchanging unit, a plurality of flat tubes through which a refrigerant flows are arranged. For example, PTL 1 (Japanese Unexamined Patent Application Publication No. 2016-38192) discloses a heat exchanger that includes two rows of heat exchanging units.

The heat exchanger in PTL 1 (Japanese Unexamined Patent Application Publication No. 2016-38192) is configured such that a refrigerant flows in flat tubes of a heat exchanging unit on an airflow upstream side and in flat tubes of a heat exchanging unit on an airflow downstream side in directions opposite to each other.

According to PTL 1 (Japanese Unexamined Patent Application Publication No. 2016-38192), heat exchanging units that have the same configuration are arranged on the airflow upstream side and the airflow downstream side. Thus, when the heat exchanger is used as a condenser, there is a possibility of efficiency being not sufficiently achieved.

PATENT LITERATURE

<PTL 1> Japanese Unexamined Patent Application Publication No. 2016-38192

SUMMARY

One or more embodiments of the present invention provide a heat exchanger that includes a plurality of rows of heat exchanging units in which a plurality of flat tubes, in which a refrigerant flows, are arranged, and that is efficient.

A heat exchanger includes a plurality of rows of heat exchanging units. In the heat exchanger, the plurality of rows of heat exchanging units are arranged so as to be superposed with each other in an air flow direction. In each of the heat exchanging units, a plurality of flat multi-hole tubes extending from a first end toward a second end and in which a refrigerant flows are arranged in a first direction. A number of gas-side flat multi-hole tubes that each include a gas-refrigerant port at one end thereof and that are included in the heat exchanging unit at a front-most row on an airflow upstream side is less than a number of gas-side flat multi-hole tubes included in the heat exchanging unit at a rear-most row on an airflow downstream side.

In the heat exchanger, for example, when a gas refrigerant flows into the gas-refrigerant ports of the gas-side flat multi-hole tubes (when the heat exchanger is used as a condenser), a ratio of cooling of a high-temperature gas refrigerant performed at the heat exchanging unit at the rear-most row is higher than that performed at the heat exchanging unit at the front-most row. The high-temperature gas refrigerant is capable of relatively efficiently exchanging heat with high-temperature air (that has been heated by a refrigerant on the airflow upstream side) on the airflow downstream side. It is thus possible to cause a heat exchange between a refrigerant and air to be performed efficiently compared with that in a configuration other than the above configuration.

In the heat exchanger, at least two rows of the heat exchanging units each may include the gas-side flat multi-hole tubes.

Here, as a result of the gas-side flat multi-hole tubes being arranged in a plurality of rows of heat exchanging units, it is possible to achieve highly flexible path arrangement, which easily achieves a heat exchanger that is high in efficiency.

In the heat exchanger, the flat multi-hole tubes may further include liquid-side flat multi-hole tubes that differ from the gas-side flat multi-hole tubes and that each include a liquid-refrigerant port at one end thereof.

In the heat exchanger, a total number of the gas-side flat multi-hole tubes may be more than the total number of a liquid-side flat multi-hole tubes.

Here, because the number of the gas-side flat multi-hole tubes is more than the number of the liquid-side flat multi-hole tubes, when the heat exchanger is used as an evaporator, it is possible to suppress performance degradation even under an operational condition in which the degree of superheat is set to high.

In the heat exchanger, the gas-refrigerant port included in each of the gas-side flat multi-hole tube may be disposed at the first end.

Here, in any of the gas-side flat multi-hole tubes in the plurality of rows, the gas-refrigerant port is disposed at the first end. It is thus easy to suppress a heat loss generated as a result of a region (superheat region) of the gas-side flat multi-hole tubes in which a high-temperature gas refrigerant flows being arranged adjacent to a region of the gas-side flat multi-hole tubes in which a refrigerant having a temperature lower than the temperature of the high-temperature gas refrigerant flows.

The heat exchanger may further include a merging portion that causes the refrigerant flowing out from a plurality of the gas-side flat multi-hole tubes to merge together and to be guided into the liquid-side flat multi-hole tubes.

The heat exchanger may further include a header pipe that guides the refrigerant flowing out from the gas-side flat multi-hole tubes into a plurality of liquid-side flat multi-hole tubes. A partition plate that segregates the refrigerant flowing out from the gas-side flat multi-hole tubes by the heat exchanging units is arranged in the header pipe.

Here, it is possible to guide the refrigerant of the different heat exchanging units, in other words, the refrigerant in different states into respective different liquid-side flat multi-hole tubes.

In the heat exchanger, the refrigerant may flow in an identical direction in all of the flat multi-hole tubes.

Such a configuration enables regions that relatively greatly differ from each other in terms of temperature of a refrigerant that flows therein to be arranged away from each other, which easily suppresses generation of the heat loss.

The heat exchanger may include three rows of the heat exchanging units.

The heat exchanger may include at least three rows of the heat exchanging units. Only the heat exchanging unit at the front-most row includes the liquid-side flat multi-hole tubes.

Here, in a usage as a condenser, heat regions are concentrated on the rear-row side, and it is thus possible to improve performance.

In the heat exchanger, the gas-side flat multi-hole tubes may include a first gas-side flat multi-hole tube that includes the gas-refrigerant port at the first end. The heat exchanging units may not be arranged on the airflow downstream side of first gas-side flat multi-hole tubes in the air flow direction, or, only the gas-side flat multi-hole tubes that each include the gas-refrigerant port at the first end are arranged, on the airflow downstream side of the first gas-side flat multi-hole tubes in the air flow direction, at a position identical to a position of the first gas-side flat multi-hole tubes in the first direction.

Here, for example, in a usage as a condenser, it is possible to suppress a refrigerant that has been once cooled from being heated by air that has been heated on the airflow upstream side, and it is possible to suppress performance degradation.

In the heat exchanger, the gas-side flat multi-hole tubes each may include a gas region formed in a vicinity of the gas refrigerant port thereof and in which a gas refrigerant flows. No two-phase or liquid region in which a two-phase refrigerant or a liquid-phase refrigerant flows in the flat multi-hole tubes may be arranged on the airflow downstream side of the gas region in the air flow direction.

Such a configuration easily suppresses generation of the heat loss.

A refrigeration apparatus according to one or more embodiments of the present invention includes any one of the aforementioned heat exchangers.

BRIEF DESCRIPTION OF THE DRAWINGS

In FIG. 4, the indoor unit in a state in which a decorative panel is detached is drawn.

DETAILED DESCRIPTION

Figure 1:
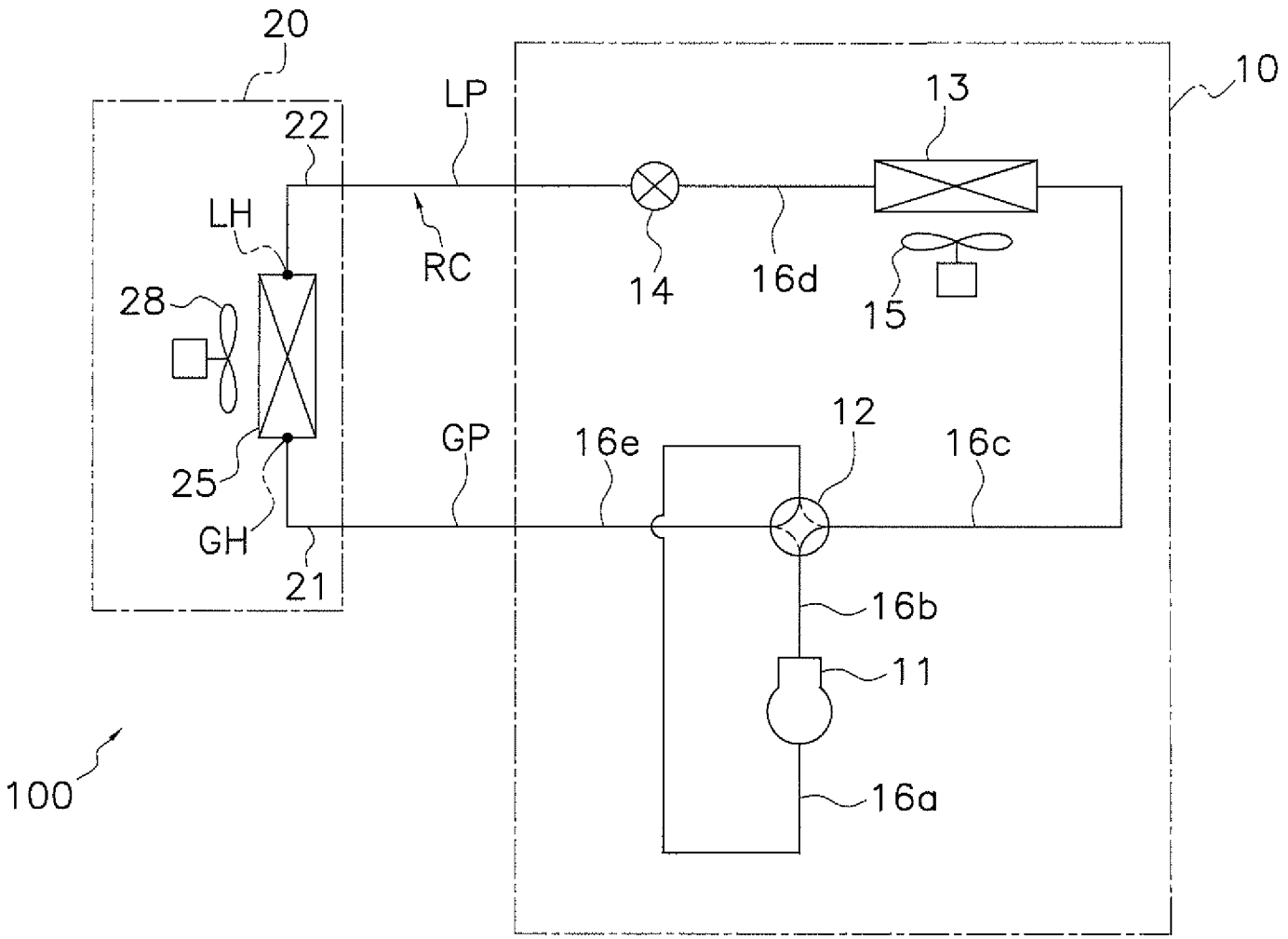
FIG. 1 is a block diagram of an air conditioner with a refrigeration apparatus according to one or more embodiments of the present invention.

Hereinafter, heat exchangers and refrigeration apparatuses according to one or more embodiments of the present invention will be described with reference to the drawings.

Members that are identical or similar to each other are given identical reference signs in a plurality of the drawings.

An indoor heat exchanger 25 according to one or more embodiments of the present invention and an air conditioner 100 including the indoor heat exchanger 25 will be described. In the following embodiments, to describe directions or positional relations, wordings, such as up, down, left, right, front, and rear, are used, and directions indicated by these wordings are according to the directions indicated by the arrows in the drawings.

(1) Air Conditioner

An overview of the air conditioner 100 including the indoor heat exchanger 25 will be described. FIG. 1 is a block diagram of the air conditioner 100.

The air conditioner 100 is an apparatus that performs air conditioning of a target space by performing cooling operation or heating operation. Specifically, the air conditioner 100 includes a refrigerant circuit RC and performs a vapor compression refrigeration cycle.

The air conditioner 100 includes, mainly, an outdoor unit 10 as a heat source unit, and an indoor unit 20 as a utilization unit. In the air conditioner 100, the outdoor unit 10 and the indoor unit 20 are connected to each other by a gas-refrigerant connection pipe GP and a liquid-refrigerant connection pipe LP, thereby constituting the refrigerant circuit RC. The refrigerant circuit RC is filled with, for example, a HFC refrigerant, such as R32 or R410A. The type of the refrigerant is, however, not limited to R32 or R410A and may be HFO1234yf, HFO1234ze(E), a mixture refrigerant thereof, or the like.

The outdoor unit 10 and the indoor unit 20 will be further described.

(1-1) Outdoor Unit

The outdoor unit 10 is a unit installed outdoor.

The outdoor unit 10 includes, mainly, a compressor 11, a flow-direction switching mechanism 12, an outdoor heat exchanger 13, an expansion mechanism 14, and an outdoor fan 15 (refer to FIG. 1).

In addition, the outdoor unit 10 includes a suction pipe 16*a*, a discharge pipe 16*b*, a first gas-refrigerant pipe 16*c*, a liquid-refrigerant pipe 16*d*, and a second gas-refrigerant pipe 16*e* (refer to FIG. 1). The suction pipe 16*a* connects the flow-direction switching mechanism 12 and the suction side of the compressor 11 to each other. The discharge pipe 16*b* connects the discharge side of the compressor 11 and the flow-direction switching mechanism 12 to each other. The first gas-refrigerant pipe 16*c* connects the flow-direction switching mechanism 12 and a gas-side end of the outdoor heat exchanger 13 to each other. The liquid-refrigerant pipe 16*d* connects a liquid-side end of the outdoor heat exchanger 13 and the liquid-refrigerant connection pipe LP to each other. The expansion mechanism 14 is disposed at the liquid-refrigerant pipe 16*d*. The second gas-refrigerant pipe 16*e* connects the flow-direction switching mechanism 12 and the gas-refrigerant connection pipe GP to each other.

The compressor 11 is an apparatus that suctions, compresses, and discharges a low-pressure gas refrigerant. The compressor 11 is an inverter-controlled compressor in which the number of revolutions of a motor is adjustable (capacity is adjustable). The number of revolutions of the compressor 11 is adjusted by a non-illustrated control unit in response to an operational condition. The compressor 11 may be a compressor in which the number of revolutions of the motor is constant.

The flow-direction switching mechanism 12 is a mechanism that switches, according to an operating mode (cooling operation mode or a heating operation mode), a refrigerant-flow direction in the refrigerant circuit RC. In one or more embodiments, the flow-direction switching mechanism 12 is a four-way switching valve.

In the cooling operation mode, the flow-direction switching mechanism 12 switches the refrigerant-flow direction in the refrigerant circuit RC such that a refrigerant discharged by the compressor 11 is sent to the outdoor heat exchanger 13. Specifically, in the cooling operation mode, the flow-direction switching mechanism 12 causes the suction pipe 16*a* to communicate with the second gas-refrigerant pipe 16*e* and causes the discharge pipe 16*b* to communicate with the first gas-refrigerant pipe 16*c* (refer to the solid lines in FIG. 1). In the heating operation mode, the flow-direction switching mechanism 12 switches the refrigerant-flow direction in the refrigerant circuit RC such that a refrigerant discharged by the compressor 11 is sent to the indoor heat exchanger 25. Specifically, in the heating operation mode, the flow-direction switching mechanism 12 causes the suction pipe 16*a* to communicate with the first gas-refrigerant pipe 16*c* and causes the discharge pipe 16*b* to communicate with the second gas-refrigerant pipe 16*e* (refer to the dashed lines in FIG. 1).

The flow-direction switching mechanism 12 is not limited to the four-way switching valve and may be constituted by a combination of a plurality of electromagnetic valves and refrigerant pipes to achieve the aforementioned switching of the refrigerant-flow direction.

The outdoor heat exchanger 13 is a heat exchanger that functions as a refrigerant condenser during cooling operation and functions as a refrigerant evaporator during heating operation. The outdoor heat exchanger 13 includes a plurality of heat transfer tubes and a plurality of heat transfer fins (not illustrated).

The expansion mechanism 14 is a mechanism that decompresses a high-pressure refrigerant that flows thereinto. In one or more embodiments, the expansion mechanism 14 is an expansion valve whose opening degree is adjustable. The opening degree of the expansion mechanism 14 is adjusted, as appropriate, in response to an operational condition. The expansion mechanism 14 is not limited to the expansion valve and may be a capillary tube or the like.

The outdoor fan 15 is a fan that generates an air flow flowing into the outdoor unit 10 from the outside, passing through the outdoor heat exchanger 13, and flowing out to the outside of the outdoor unit 10. The drive of the outdoor fan 15 is controlled by the non-illustrated control unit while operating, and the number of revolutions thereof is adjusted, as appropriate.

(1-2) Indoor Unit

The indoor unit 20 is installed indoor (in a target space of air conditioning). The indoor unit 20 includes, mainly, the indoor heat exchanger 25 and an indoor fan 28 (refer to FIG. 1).

The indoor heat exchanger 25 according to one or more embodiments of the present invention functions as a refrigerant evaporator during cooling operation and functions as a refrigerant condenser during heating operation. A gas-refrigerant pipe 21 is connected to gas-side refrigerant ports (gas-side ports GH) of the indoor heat exchanger 25. The gas-refrigerant pipe 21 is a pipe that connects the gas-refrigerant connection pipe GP and the indoor heat exchanger 25 to each other. The gas-refrigerant pipe 21 is branched on the side of the indoor heat exchanger 25 into a first gas-refrigerant pipe 21*a* and a second gas-refrigerant pipe 21*b* (refer to, for example, FIG. 6; the branched portion is not illustrated). A liquid-refrigerant pipe 22 is connected to liquid-side refrigerant ports (liquid-side ports LH) of the indoor heat exchanger 25. The liquid-refrigerant pipe 22 is a pipe that connects the liquid-refrigerant connection pipe LP and the indoor heat exchanger 25 to each other. The liquid-refrigerant pipe 22 branches on the side of the indoor heat exchanger 25 into a first liquid-refrigerant pipe 22*a* and a second liquid-refrigerant pipe 22*b* (refer to, for example, FIG. 6; the branched portion is not illustrated). Details of the indoor heat exchanger 25 will be described later.

The indoor fan 28 is a fan that generates an air flow (indoor air flow AF; refer to, for example, FIG. 5) flowing into the indoor unit 20 from the outside, passing through the indoor heat exchanger 25, and flowing out to the outside of the indoor unit 20. The drive of the indoor fan 28 is controlled by the non-illustrated control unit while operating, and the number of revolutions thereof is adjusted, as appropriate.

(1-3) Gas-Refrigerant Connection Pipe and Liquid-Refrigerant Connection Pipe

The gas-refrigerant connection pipe GP and the liquid-refrigerant connection pipe LP are pipes that are to be installed at an installation site of the air conditioner 100. The pipe diameter and the pipe length of each of the gas-refrigerant connection pipe GP and the liquid-refrigerant connection pipe LP are individually selected according to design specifications and installation environments.

The gas-refrigerant connection pipe GP is a pipe that connects the second gas-refrigerant pipe 16*e* of the outdoor unit 10 and the gas-refrigerant pipe 21 of the indoor unit 20 to each other and is a pipe in which, mainly, a gas refrigerant flows. The liquid-refrigerant connection pipe LP is a pipe that connects the liquid-refrigerant pipe 16*d* of the outdoor unit 10 and the liquid-refrigerant pipe 22 of the indoor unit 20 to each other and is a pipe in which, mainly, a liquid refrigerant flows.

(2) Refrigerant Flow in Air Conditioner

The air conditioner 100 causes refrigerants to circulate as described below in the refrigerant circuit RC during cooling operation and during heating operation.

(2-1) During Cooling Operation

During cooling operation, the flow-direction switching mechanism 12 is in the state indicated by the solid lines of FIG. 1, the discharge side of the compressor 11 communicates with the gas side of the outdoor heat exchanger 13, and the suction side of the compressor 11 communicates with the gas side of the indoor heat exchanger 25.

When the compressor 11 is driven in such a state, a low-pressure gas refrigerant is compressed at the compressor 11 into a high-pressure gas refrigerant. The high-pressure gas refrigerant is sent, via the discharge pipe 16*b*, the flow-direction switching mechanism 12, and the first gas-refrigerant pipe 16*c*, to the outdoor heat exchanger 13. The high-pressure gas refrigerant exchanges heat, at the outdoor heat exchanger 13, with outdoor air, thereby condensing and becoming a high-pressure liquid refrigerant (liquid refrigerant in a subcooled state). The high-pressure liquid refrigerant that flows out from the outdoor heat exchanger 13 is sent to the expansion mechanism 14. The refrigerant that has been decompressed at the expansion mechanism 14 and that has a low-pressure flows through the liquid-refrigerant pipe 16*d*, the liquid-refrigerant connection pipe LP, and the liquid-refrigerant pipe 22 and flows into the indoor heat exchanger 25 from the liquid-side ports LH. The refrigerant that has flowed into the indoor heat exchanger 25 exchanges heat with indoor air, thereby evaporating and becoming a low-pressure gas refrigerant (gas refrigerant in a superheated state), and flows out from the indoor heat exchanger 25 via the gas-side ports GH. The refrigerant that has flowed out from the indoor heat exchanger 25 flows through the gas-refrigerant pipe 21, the gas-refrigerant connection pipe GP, the second gas-refrigerant pipe 16*e*, and the suction pipe 16*a*, and is suctioned by the compressor 11 again.

(2-2) During Heating Operation

During heating operation, the flow-direction switching mechanism 12 is in the state indicated by the dashed lines of FIG. 1, the discharge side of the compressor 11 communicates with the gas side of the indoor heat exchanger 25, and the suction side of the compressor 11 communicates with the gas side of the outdoor heat exchanger 13.

When the compressor 11 is driven in such a state, a low-pressure gas refrigerant is compressed at the compressor 11, thereby becoming a high-pressure gas refrigerant, and sent to the indoor heat exchanger 25 via the discharge pipe 16*b*, the flow-direction switching mechanism 12, the second gas-refrigerant pipe 16*e*, the gas-refrigerant connection pipe GP, and the gas-refrigerant pipe 21. The high-pressure gas refrigerant that has sent to the indoor heat exchanger 25 and that is in a superheated state flows into the indoor heat exchanger 25 via the gas-side ports GH and exchanges heat with indoor air, thereby condensing and becoming a high-pressure liquid refrigerant (liquid refrigerant in a subcooled state), and then flows out from the indoor heat exchanger 25 via the liquid-side ports LH. The refrigerant that has flowed out from the indoor heat exchanger 25 is sent to the expansion mechanism 14 via the liquid-refrigerant pipe 22, the liquid-refrigerant connection pipe LP, and the liquid-refrigerant pipe 16*d*. The high-pressure liquid refrigerant sent to the expansion mechanism 14 is decompressed, when passing through the expansion mechanism 14, in response to the opening degree of the expansion mechanism 14. The refrigerant that has passed through the expansion mechanism 14 and that has a low pressure flows into the outdoor heat exchanger 13. The refrigerant that has flowed into the outdoor heat exchanger 13 and that has the low pressure exchanges heat with outdoor air, thereby evaporating and becoming a low-pressure gas refrigerant, and is suctioned again by the compressor 11 via the first gas-refrigerant pipe 16*c*, the flow-direction switching mechanism 12, and the suction pipe 16*a*.

(3) Details of Indoor Unit

Figure 2:
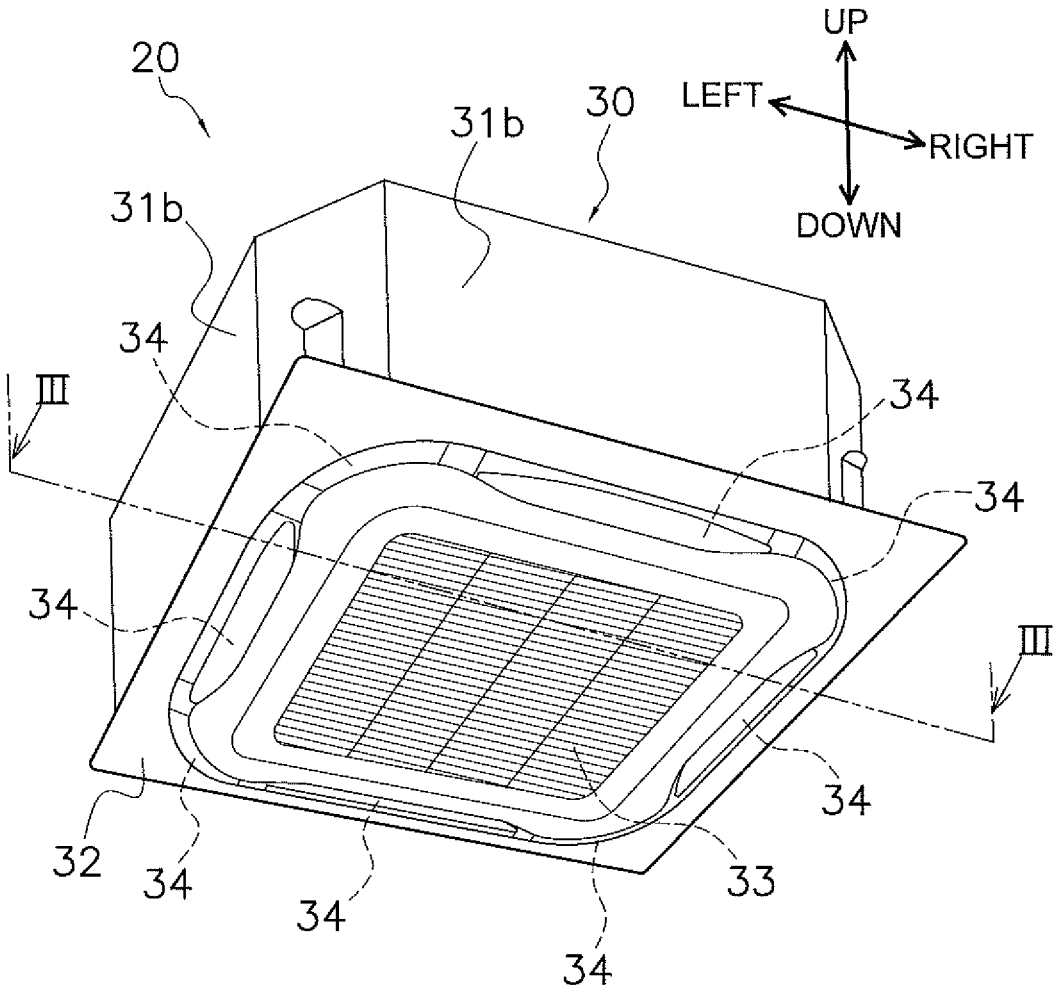
FIG. 2 is a perspective view of an indoor unit of the air conditioner in FIG. 1.
Figure 3:
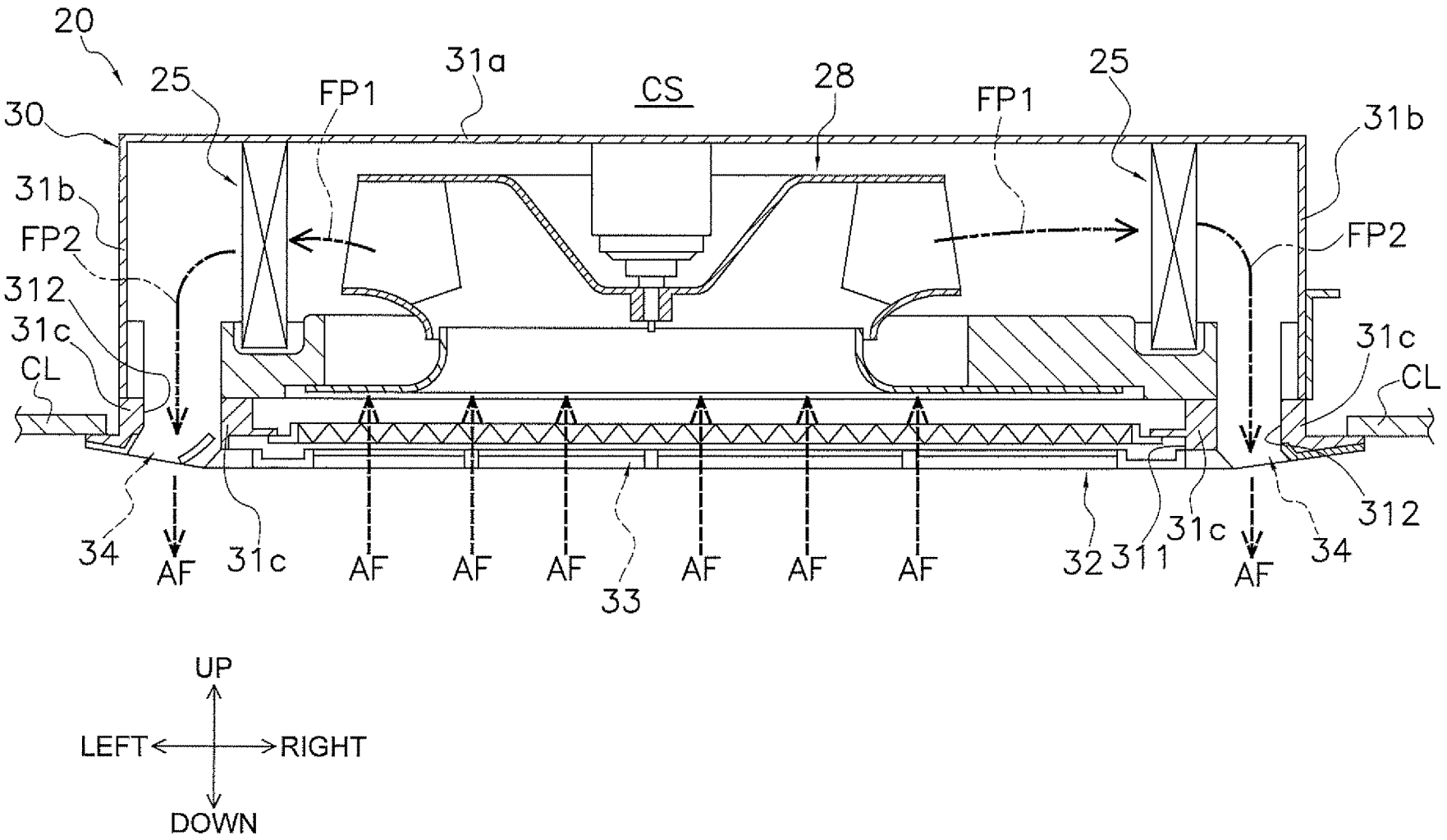
FIG. 3 is a schematic sectional view of the indoor unit, as viewed in the direction of the arrows III-III of FIG. 2, attached to a ceiling.
Figure 4:
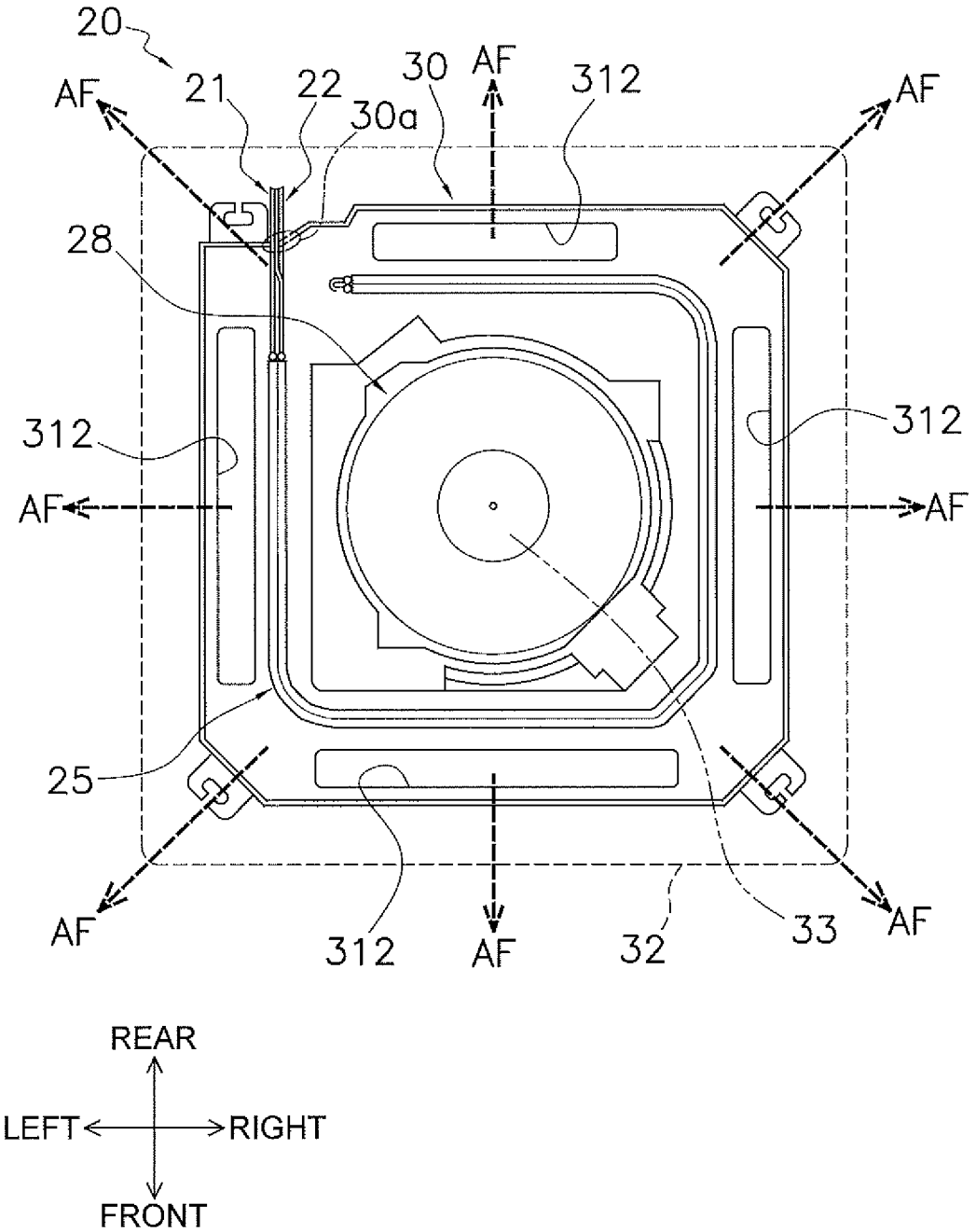
FIG. 4 is a bottom view schematically illustrating a schematic configuration of the indoor unit in FIG. 2.

FIG. 2 is a perspective view of the indoor unit 20. FIG. 3 is a schematic sectional view of the indoor unit 20, as viewed in the direction of the arrows III-III of FIG. 2, in a state of being attached to a ceiling surface CL. FIG. 4 is a schematic view illustrating a schematic configuration of the indoor unit 20 in a bottom view.

The indoor unit 20 is a so-called ceiling-embedded air-conditioning indoor unit and is installed at a ceiling of an air-conditioning target space. The indoor unit 20 includes a casing 30 that constitutes an outer contour thereof.

Equipment, such as the indoor heat exchanger 25 and the indoor fan 28, is housed in the casing 30. As illustrated in FIG. 3, the casing 30 is inserted into an opening formed in the ceiling surface CL of the target space and installed in a ceiling space CS formed between the ceiling surface CL and a floor surface of an upper floor or a roof. The casing 30 includes a top panel 31*a*, a side plate 31*b*, a bottom plate 31*c*, and a decorative panel 32.

The top panel 31*a* is a member that constitutes the top surface portion of the casing 30 and has a substantially octagonal shape formed by long sides and short sides that are alternately connected.

The side plate 31*b* is a member that constitutes the side-surface portion of the casing 30 and has a substantially octagonal prism shape corresponding to the shape of the top panel 31*a*. The side plate 31*b* has an opening 30*a* (refer to the one-dot chain line of FIG. 4) for inserting (pulling in) the gas-refrigerant connection pipe GP and the liquid-refrigerant connection pipe LP into the casing 30 or pulling out the gas-refrigerant pipe 21 or the liquid-refrigerant pipe 22 to the outside of the casing 30.

The bottom plate 31*c* is a member that constitutes the bottom surface portion of the casing 30 and has a substantially quadrilateral large opening 311 at the center thereof (refer to FIG. 3). A plurality of openings 312 are disposed (refer to FIG. 3) at the periphery of the large opening 311 of the bottom plate 31*c*. The decorative panel 32 is attached to the lower-surface side (target-space side) of the bottom plate 31*c*.

The decorative panel 32 is a plate-shaped member exposed to the target space and has a substantially quadrilateral shape in plan view. The decorative panel 32 is installed by being fitted into the opening of the ceiling surface CL (refer to FIG. 3). The decorative panel 32 has an intake port 33 and blow-out ports 34 for the indoor air flow AF. The intake port 33 is formed, in a center portion of the decorative panel 32, at a position so as to be partially superposed with the large opening 311 of the bottom plate 31*c* in plan view and has a substantially quadrilateral shape. The blow-out ports 34 are disposed at the periphery of the intake port 33 so as to surround the intake port 33.

An intake flow path FP1 for guiding the indoor air flow AF that has flowed into the casing 30 via the intake port 33 to the indoor heat exchanger 25, and a blow-out flow path FP2 for sending the indoor air flow AF that has passed through the indoor heat exchanger 25 to the blow-out ports 34 are formed in the casing 30. The blow-out flow path FP2 is arranged on the outer side of the intake flow path FP1 so as to surround the intake flow path FP1.

In the casing 30, the indoor fan 28 is arranged at a center portion, and the indoor heat exchanger 25 is arranged so as to surround the indoor fan 28. The indoor fan 28 is partially superposed with the intake port 33 in plan view (refer to FIG. 4). The indoor heat exchanger 25 has a substantially quadrilateral ring shape in plan view and is arranged so as to surround the intake port 33 and to be surrounded by the blow-out ports 34.

As a result of the intake port 33, the blow-out ports 34, the intake flow path FP1, the blow-out flow path FP2, the indoor heat exchanger 25, and the indoor fan 28 being arranged in the aforementioned mode, the indoor air flow AF flows along a route described below in the indoor unit 20 while the indoor fan 28 is operated.

The indoor air flow AF generated by the indoor fan 28 flows into the casing 30 via the intake port 33 and is guided into the indoor heat exchanger 25 via the intake flow path FP1. The indoor air flow AF guided into the indoor heat exchanger 25 is sent to the blow-out ports 34 via the blow-out flow path FP2 after exchanging heat with a refrigerant in the indoor heat exchanger 25, and blown out into a target space from the blow-out ports 34.

In the following description, a direction in which the indoor air flow AF flows when passing through the indoor heat exchanger 25 is referred to as "air flow direction dr3" (refer to FIG. 7 and FIG. 8). In one or more embodiments, the air flow direction dr3 is the horizontal direction.

(4) Indoor Heat Exchanger

The indoor heat exchanger 25 will be described.

(4-1) Configuration of Indoor Heat Exchanger

Figure 5:
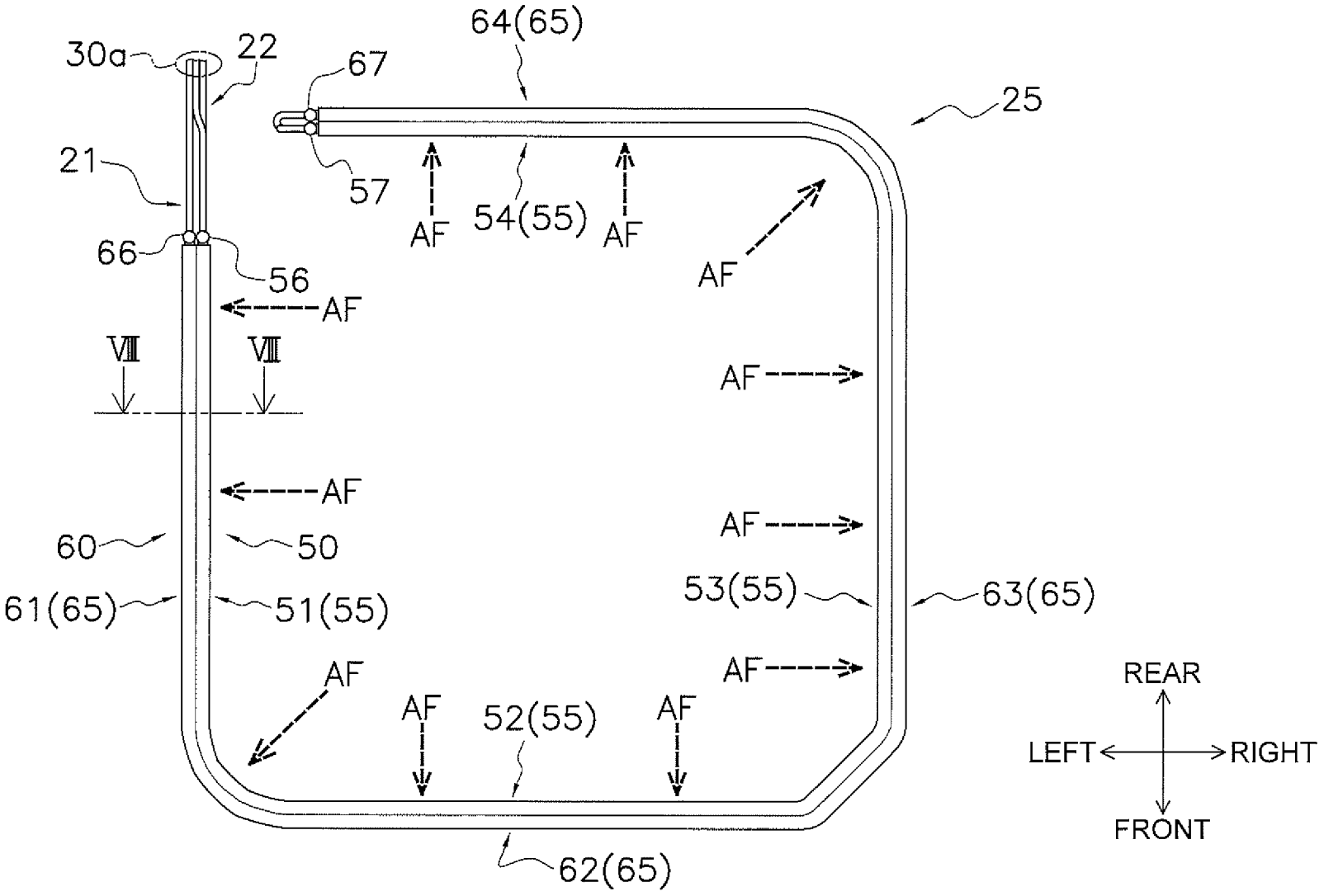
FIG. 5 is a schematic view roughly illustrating an indoor heat exchanger, as viewed in a stacking direction of flat multi-hole tubes, according to one or more embodiments of the present invention.
Figure 6:
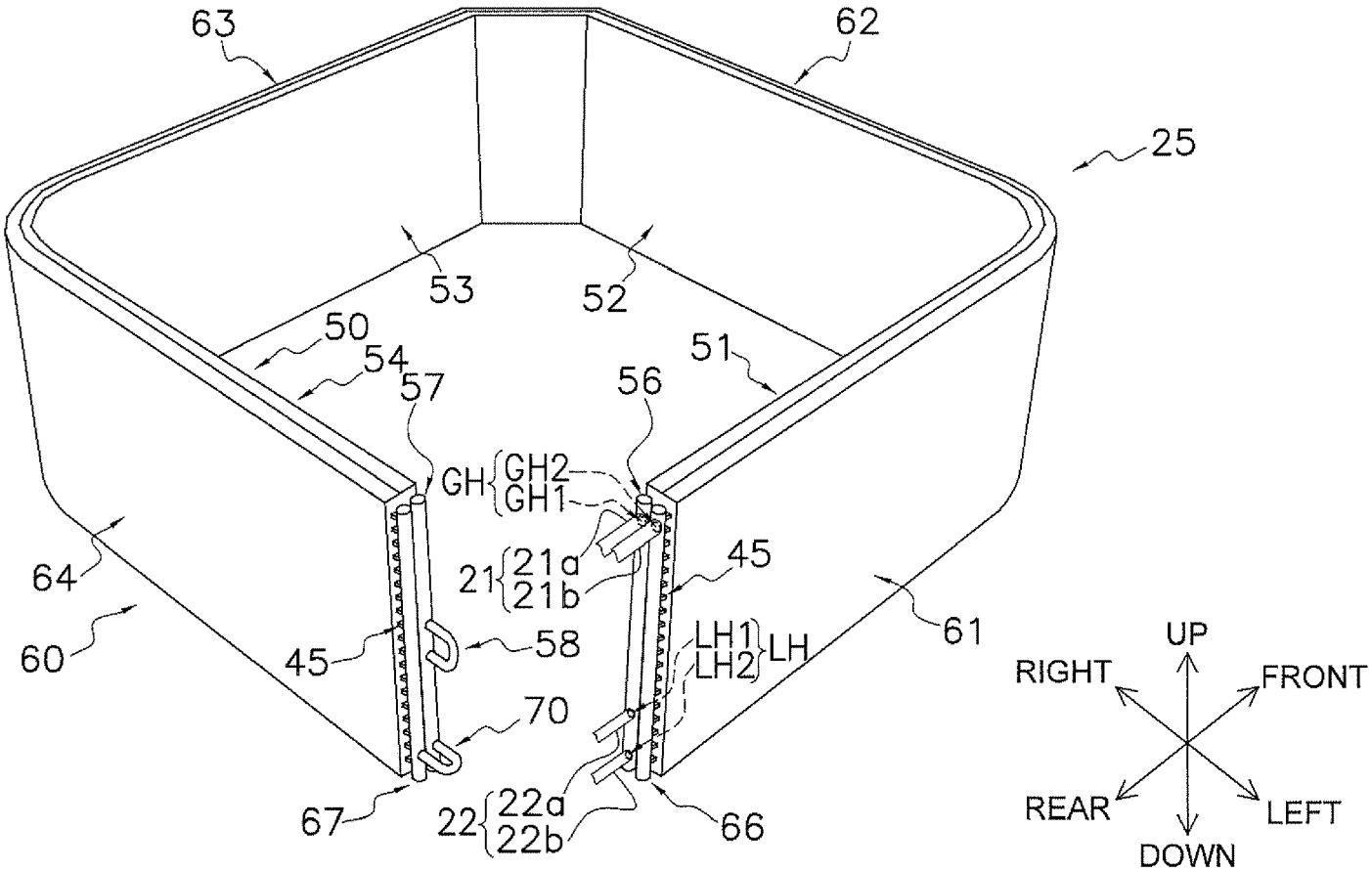
FIG. 6 is a perspective view of the indoor heat exchanger in FIG. 5.

FIG. 5 is a schematic view roughly illustrating the indoor heat exchanger 25 as viewed in a flat-tube stacking direction dr2 of later-described flat multi-hole tubes 45. The flat-tube stacking direction dr2 is an example of a first direction. Here, the flat-tube stacking direction dr2 is the up-down direction. FIG. 5 is a schematic view of the indoor heat exchanger 25 as viewed from below. FIG. 6 is a perspective view of the indoor heat exchanger 25. FIG. 7 is a perspective view illustrating a portion of a heat exchanging surface 40. FIG. 8 is a schematic sectional view in the direction of the arrows VIII-VIII of FIG. 5. FIG. 9 is a schematic view roughly illustrating a configuration of the indoor heat exchanger 25.

(4-1-1) Refrigerant Ports for Indoor Heat Exchanger

Refrigerant ports for the indoor heat exchanger 25 will be described.

As described above, a refrigerant flows into or flows out from the indoor heat exchanger 25 via the gas-side ports GH and the liquid-side ports LH (refer to FIG. 1). During heating operation (that is, when the indoor heat exchanger 25 is used as a condenser), the gas-side ports GH function as inlets for a refrigerant (mainly, a gas refrigerant in a superheated state), and the liquid-side ports LH function as outlets for a refrigerant (mainly, a liquid refrigerant in a subcooled state). During cooling operation (that is, when the indoor heat exchanger 25 is used as an evaporator), the liquid-side ports LH function as inlets for a refrigerant, and the gas-side ports GH function as outlets for a refrigerant (mainly, a gas refrigerant in a superheated state).

The indoor heat exchanger 25 includes a plurality (two, here) of the gas-side ports GH and a plurality (two, here) of the liquid-side ports LH. Specifically, the indoor heat exchanger 25 includes, as the gas-side ports GH, a first gas-side port GH1 and a second gas-side port GH2 (refer to FIG. 6). The indoor heat exchanger 25 includes, as the liquid-side ports LH, a first liquid-side port LH1 and a second liquid-side port LH2 (refer to FIG. 6). The first gas-side port GH1 and the second gas-side port GH2 are arranged above the first liquid-side port LH1 and the second liquid-side port LH2 (refer to FIG. 6).

(4-1-2) Heat Exchanging Surface of Indoor Heat Exchanger

Next, the heat exchanging surface 40 of the indoor heat exchanger 25 will be described. In the indoor heat exchanger 25, a heat exchange between the indoor air flow AF and a refrigerant is performed at the heat exchanging surface 40. In an installed state, the indoor air flow AF that passes through the heat exchanging surface 40 has an air velocity distribution. In the indoor unit 20 according to one or more embodiments, the air velocity of the indoor air flow AF that passes through the heat exchanging surface 40 is higher on the upper-tier side than on the lower-tier side.

The heat exchanging surface 40 includes a front-row first heat exchanging surface 51, a front-row second heat exchanging surface 52, a front-row third heat exchanging surface 53, a front-row fourth heat exchanging surface 54, a rear-row first heat exchanging surface 61, a rear-row second heat exchanging surface 62, a rear-row third heat exchanging surface 63, and a rear-row fourth heat exchanging surface 64, which will be described later.

The indoor heat exchanger 25 includes the heat exchanging surface 40, which is for exchanging heat with the indoor air flow AF, on the airflow upstream side and the airflow downstream side in the air flow direction dr3 of the indoor air flow AF. Specifically, the heat exchanging surface 40 includes a front-row heat exchanging surface 55 arranged on the airflow upstream side in the air flow direction dr3 and a rear-row heat exchanging surface 65 arranged on the airflow downstream side in the air flow direction dr3. In other words, the indoor heat exchanger 25 includes a front-row heat exchanging unit 50 arranged on the airflow upstream side in the air flow direction dr3 and a rear-row heat exchanging unit 60 arranged on the airflow downstream side in the air flow direction dr3. The front-row heat exchanging unit 50 includes the front-row heat exchanging surface 55 (the front-row first heat exchanging surface 51, the front-row second heat exchanging surface 52, the front-row third heat exchanging surface 53, and the front-row fourth heat exchanging surface 54). The rear-row heat exchanging unit 60 includes the rear-row heat exchanging surface 65 (the rear-row first heat exchanging surface 61, the rear-row second heat exchanging surface 62, the rear-row third heat exchanging surface 63, and the rear-row fourth heat exchanging surface 64). The front-row heat exchanging unit 50 and the rear-row heat exchanging unit 60 will be described later.

Figure 7:
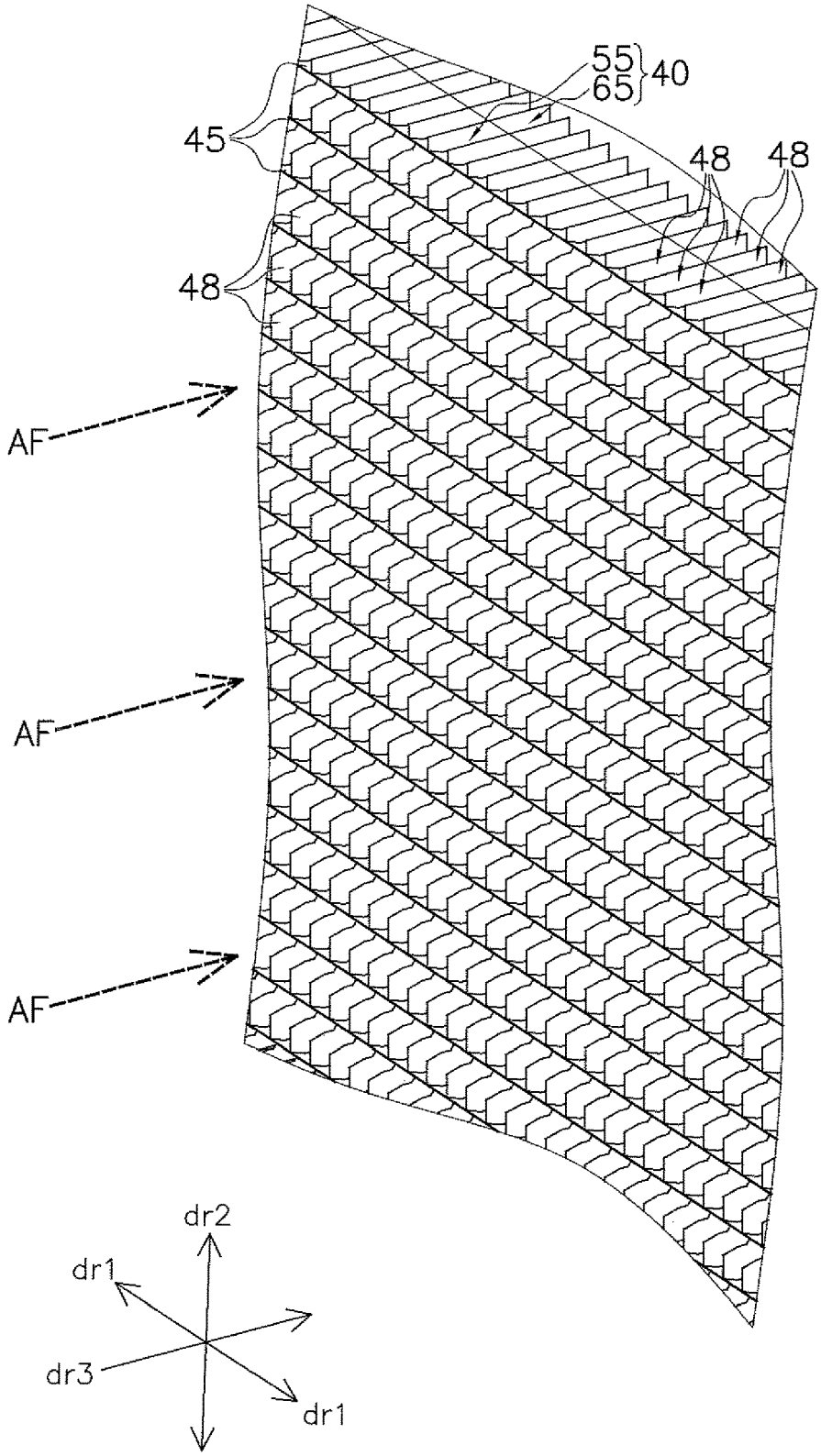
FIG. 7 is a perspective view illustrating a portion of a heat exchanging unit of the indoor heat exchanger in FIG. 5.
Figure 8:
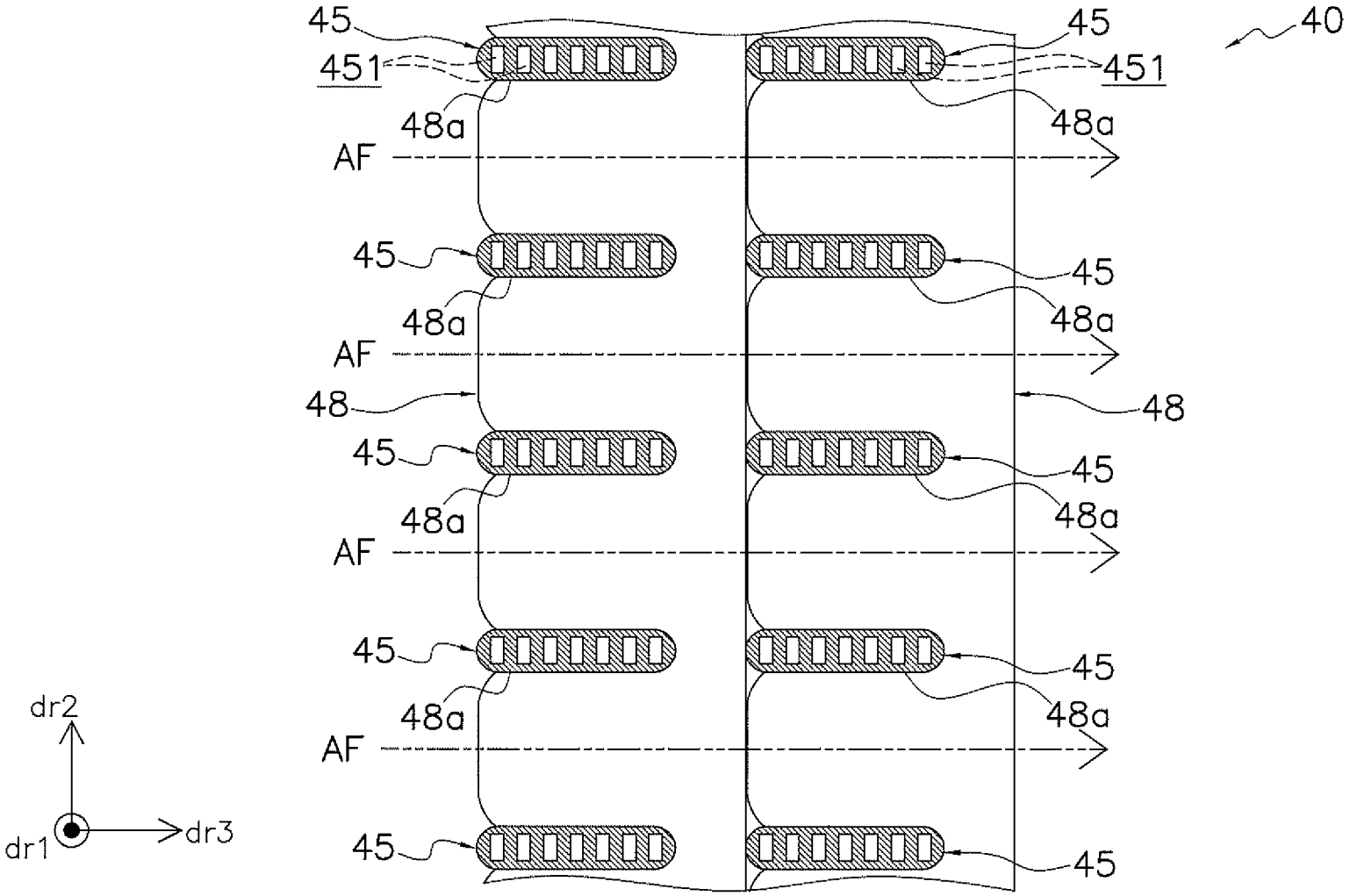
FIG. 8 is a schematic sectional view in the direction of the arrows VIII-VIII of FIG. 5.
Figure 9:
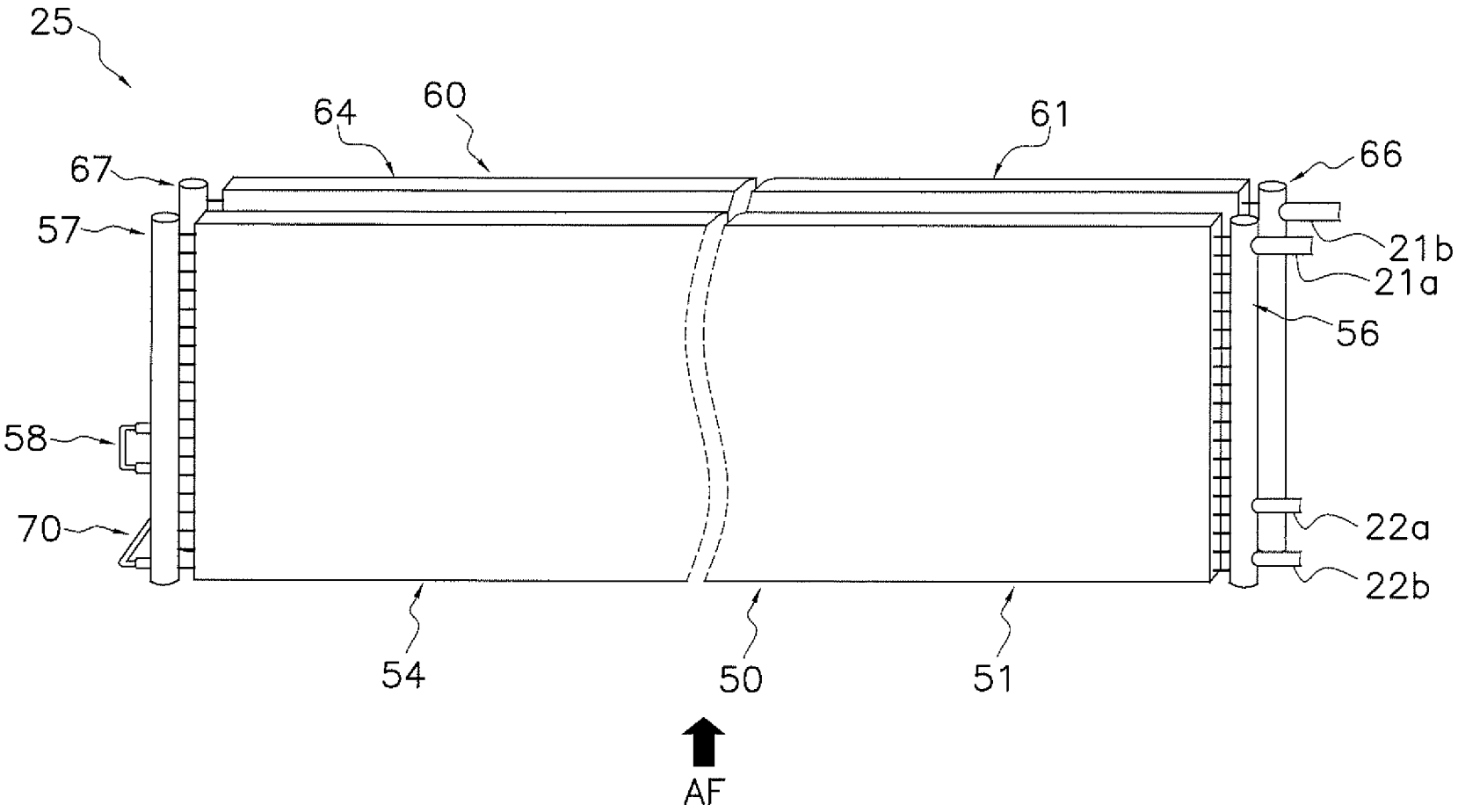
FIG. 9 is a schematic view roughly illustrating a configuration of the indoor heat exchanger in FIG. 5.

The indoor heat exchanger 25 includes, at each heat exchanging surface 40, a plurality (19, here) of the flat multi-hole tubes 45 in which a refrigerant flows, and a plurality of heat transfer fins 48 that facilitate a heat exchange between the refrigerant and the indoor air flow AF (refer to, for example, FIG. 7 and FIG. 8). The number of the flat multi-hole tubes 45 is presented here as an example and not limited thereto. The number of the flat multi-hole tubes 45 may be changed, as appropriate, according to design specifications and the like. For example, the number of the flat multi-hole tubes 45 may be 18 or less or 20 or more.

Each of the flat multi-hole tubes 45 extends from a first end (an end adjacent to a front-row first header 56 in the front-row heat exchanging unit 50; an end adjacent to a rear-row first header 66 in the rear-row heat exchanging unit 60) toward a second end (an end adjacent to a front-row second header 57 in the front-row heat exchanging unit 50; an end adjacent to a rear-row second header 67 in the rear-row heat exchanging unit 60) (refer to FIG. 9). Here, each of the flat multi-hole tubes 45 extends to define the four sides of a substantially quadrilateral shape (refer to FIG. 6). Each of the flat multi-hole tubes 45 is arranged so as to extend in a predetermined flat-tube extending direction dr1 (horizontal direction, here). A plurality of the flat multi-hole tubes 45 are arranged (stacked) with an interval therebetween in a predetermined flat-tube stacking direction dr2 (vertical direction, here). The flat-tube extending direction dr1 intersects the flat-tube stacking direction dr2 and the air flow direction dr3. The flat-tube stacking direction dr2 intersects the flat-tube extending direction dr1 and the air flow direction dr3. Here, in particular, the air flow direction dr3 is substantially orthogonal to the flat-tube stacking direction dr2. In one or more embodiments, the indoor heat exchanger 25 includes the heat exchanging surface 40 on the airflow upstream side and the airflow downstream side. In the indoor heat exchanger 25, the flat multi-hole tubes 45 arranged in a plurality of rows (two rows, here) in the air flow direction dr3 are stacked on each other at a plurality of tiers in the flat-tube stacking direction dr2. The number of the flat multi-hole tubes 45 of the heat exchanging surface 40, the number of the rows thereof, and the number of the tiers thereof can be changed, as appropriate, according to design specifications.

Each of the flat multi-hole tubes 45 is a flat tube that has a flat cross sectional shape. The flat multi-hole tubes 45 are made of aluminum or an aluminum alloy. A plurality of refrigerant flow paths (flat-tube flow paths 451) extending in the flat-tube extending direction dr1 are formed in each of the flat multi-hole tubes 45 (refer to FIG. 8). The plurality of flat-tube flow paths 451 are arranged in the air flow direction dr3 in each of the flat multi-hole tubes 45 (refer to FIG. 8).

The heat transfer fins 48 are flat plate-shaped members that increase an area of a heat transfer between the flat multi-hole tubes 45 and the indoor air flow AF. The heat transfer fins 48 are made of aluminum or an aluminum alloy. The heat transfer fins 48 extend to intersect the flat multi-hole tubes 45 such that the flat-tube stacking direction dr2 coincides with the longitudinal direction thereof. A plurality of slits 48*a* are formed in the heat transfer fins 48 so as to be aligned in the flat-tube stacking direction dr2 with an interval therebetween. The flat multi-hole tubes 45 are inserted into respective slits 48*a* (refer to FIG. 8).

Each heat transfer fin 48 together with the other heat transfer fins 48 is arranged at the heat exchanging surface 40 so as to be aligned in the flat-tube extending direction dr1 with an interval therebetween. In one or more embodiments, the indoor heat exchanger 25 includes the heat exchanging surface 40 on the airflow upstream side and the airflow downstream side. In the indoor heat exchanger 25, the heat transfer fins 48 extending in the flat-tube stacking direction dr2 are arranged in two rows in the air flow direction dr3. Also, a large number of the heat transfer fins 48 are arranged in the flat-tube extending direction dr1. The number of the heat transfer fins 48 of the heat exchanging surface 40 of the indoor heat exchanger 25 is selected according to the length dimensions of the flat multi-hole tubes 45 in the flat-tube extending direction dr1 and can be selected and changed, as appropriate, according to design specifications.

(4-1-3) Configuration of Indoor Heat Exchanger

The indoor heat exchanger 25 includes, mainly, a plurality (two, here) of heat exchanging units (the front-row heat exchanging unit 50 and the rear-row heat exchanging unit 60), the front-row first header 56, the front-row second header 57, the rear-row first header 66, the rear-row second header 67, a return pipe 58, and a connection pipe 70. Configurations of these components will be described below.

For convenience of description, the configuration of the indoor heat exchanger 25 will be described separately as a front row configuration (the front-row heat exchanging unit 50, the front-row first header 56, the front-row second header 57, and the return pipe 58) on the airflow upstream side in the air flow direction dr3, a rear row configuration (the rear-row heat exchanging unit 60, the rear-row first header 66, and the rear-row second header 67) on the airflow downstream side in the air flow direction dr3, and the connection pipe 70.

(4-1-3-1) Front Row Configuration

Figure 10:
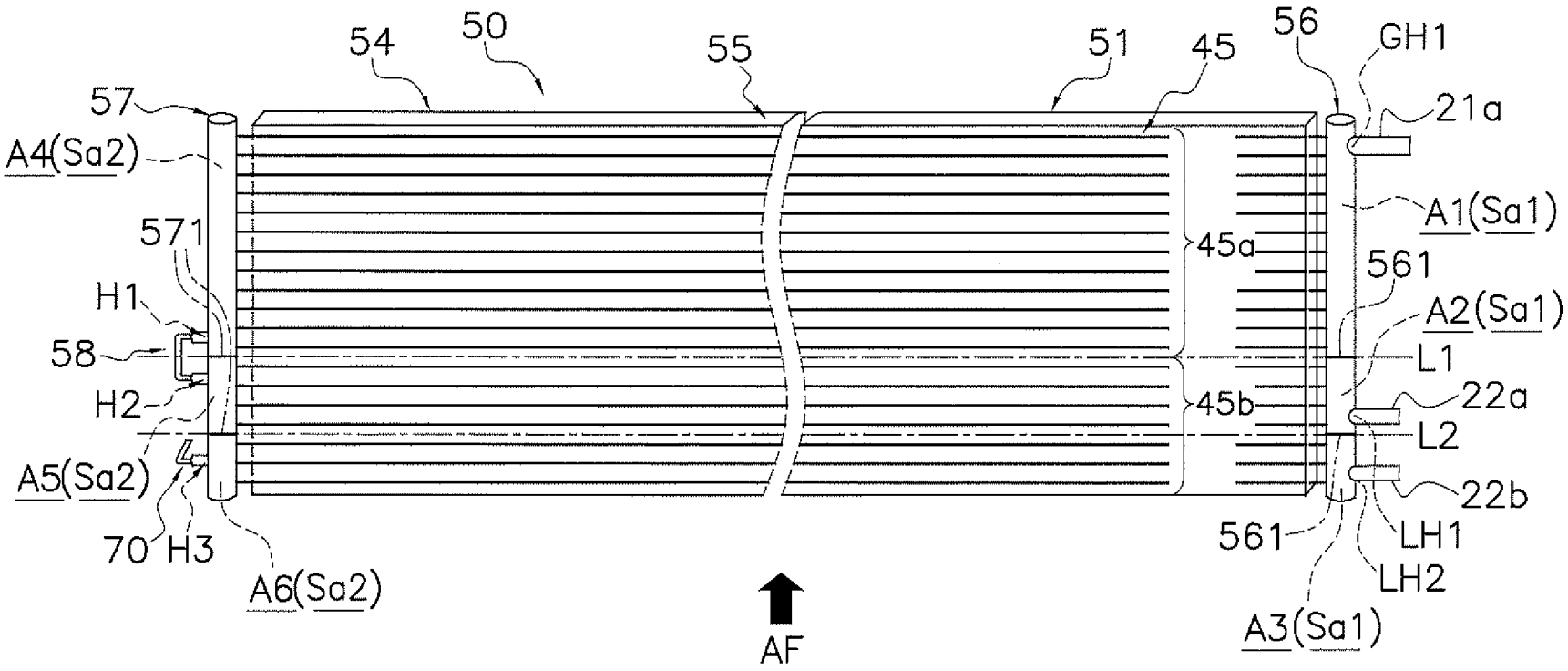
FIG. 10 is a schematic view roughly illustrating a front row configuration of the indoor heat exchanger in FIG. 5.

FIG. 10 is a schematic view roughly illustrating the front row configuration including the front-row heat exchanging unit 50, the front-row first header 56, the front-row second header 57, and the return pipe 58.

The front-row heat exchanging unit 50 includes the front-row heat exchanging surface 55 as the heat exchanging surface 40. The front-row heat exchanging surface 55 includes the front-row first heat exchanging surface 51, the front-row second heat exchanging surface 52, the front-row third heat exchanging surface 53, and the front-row fourth heat exchanging surface 54.

(4-1-3-1-1) Front-Row Heat Exchanging Unit

The flat multi-hole tubes 45 included in the front-row heat exchanging surface 55 of the front-row heat exchanging unit 50 extend from the first end (the front-row first header 56) toward the second end (the front-row second header 57). Each of the flat multi-hole tubes 45 extends to define the four sides of a substantially quadrilateral shape. In other words, each of the flat multi-hole tubes 45 is arranged in a substantially square shape. The front-row first heat exchanging surface 51, the front-row second heat exchanging surface 52, the front-row third heat exchanging surface 53, and the front-row fourth heat exchanging surface 54 are arranged in this order in a direction, in which the flat multi-hole tubes 45 extend, from the end adjacent to the front-row first header 56 toward the end adjacent to the front-row second header 57.

The front-row first heat exchanging surface 51, the front-row second heat exchanging surface 52, the front-row third heat exchanging surface 53, and the front-row fourth exchanging surface 54 are arranged in a substantially quadrilateral shape in plan view (refer to FIG. 5). Specifically, the front-row first heat exchanging surface 51 extends forward from the front-row first header 56. The front-row second heat exchanging surface 52 extends rightward from the front end of the front-row first heat exchanging surface 51. The front-row third heat exchanging surface 53 extends rearward from the right end of the front-row second heat exchanging surface 52. The front-row fourth heat exchanging surface 54 extends leftward from the rear end of the front-row third heat exchanging surface 53 to the front-row second header 57.

From the point of view of easy understanding, the front-row first heat exchanging surface 51, the front-row second heat exchanging surface 52, the front-row third heat exchanging surface 53, and the front-row fourth heat exchanging surface 54, which are arranged in the quadrilateral shape, are drawn as a single flat surface shape in the schematic views, such as FIG. 10.

(4-1-3-1-2) Front-Row First Header

The front-row first header 56 is a header pipe that functions, for example, as a distribution header that causes a refrigerant to diverge into each of the flat multi-hole tubes 45 or as a merging header that causes the refrigerant flowing out from each of the flat multi-hole tubes 45 to merge together. In an installed state, the front-row first header 56 extends such that the vertical direction (up-down direction) coincides with the longitudinal direction thereof.

The front-row first header 56 has a cylindrical shape, and a front-row first header space Sa1 is formed in the front-row first header 56 (refer to FIG. 10). The front-row first header 56 is connected to the terminal end (rear end) of the front-row first heat exchanging surface 51 (refer to FIG. 6). The front-row first header 56 is connected to one end of each of the flat multi-hole tubes 45 of the front-row heat exchanging unit 50 and causes these flat multi-hole tubes 45 to communicate with the front-row first header space Sa1 (refer to FIG. 10).

A plurality (two, here) of horizontal partition plates 561 are arranged in the front-row first header 56 (refer to FIG. 10). The front-row first header space Sa1 is partitioned in the flat-tube stacking direction dr2 by the horizontal partition plates 561 into a plurality (three, here) of spaces. Specifically, the front-row first header space Sa1 is partitioned by the horizontal partition plates 561 into a front-row first space A1, a front-row second space A2, and a front-row third space A3 (refer to FIG. 10). The front-row first space A1, the front-row second space A2, and the front-row third space A3 are arranged such that the front-row first space A1, the front-row second space A2, and the front-row third space A3 are aligned in this order from the upper side.

The front-row first header 56 includes the first gas-side port GH1 (refer to FIG. 10). The first gas-side port GH1 communicates with the front-row first space A1. The first gas-refrigerant pipe 21*a* is connected to the first gas-side port GH1 (refer to FIG. 10). The front-row first space A1 is positioned on the most downstream side of a refrigerant flow in the indoor heat exchanger 25 during cooling operation and positioned on the most upstream side of the refrigerant flow in the indoor heat exchanger 25 during heating operation.

The front-row first header 56 includes the first liquid-side port LH1 and the second liquid-side port LH2 (refer to FIG. 10). The first liquid-side port LH1 communicates with the front-row second space A2. The first liquid-refrigerant pipe 22*a* is connected to the first liquid-side port LH1 (refer to FIG. 10). The second liquid-side port LH2 communicates with the front-row third space A3. The second liquid-refrigerant pipe 22*b* is connected to the second liquid-side port LH2 (refer to FIG. 10). The front-row second space A2 and the front-row third space A3 are positioned on the most upstream side of the refrigerant flow in the indoor heat exchanger 25 during cooling operation and are positioned on the most downstream side of the refrigerant flow in the indoor heat exchanger 25 during heating operation.

(4-1-3-1-3) Front-Row Second Header

The front-row second header 57 is a header pipe that functions, for example, as a distribution header that causes a refrigerant to diverge into each of the flat multi-hole tubes 45, a merging header that causes the refrigerant flowing out from each of the flat multi-hole tubes 45 to merge together, or a return header that causes the refrigerant flowing out from each of the flat multi-hole tubes 45 to return into the other flat multi-hole tubes 45. In an installed state, the front-row second header 57 extends such that the vertical direction (up-down direction) coincides with the longitudinal direction thereof.

The front-row second header 57 has a cylindrical shape, and a front-row second header space Sa2 is formed in the front-row second header 57 (refer to FIG. 10). The front-row second header 57 is connected to the terminal end (left end) of the front-row fourth heat exchanging surface 54 (refer to FIG. 6). The front-row second header 57 is connected to one end of each of the flat multi-hole tubes 45 of the front-row heat exchanging unit 50 and causes these flat multi-hole tubes 45 to communicate with the front-row second header space Sa2 (refer to FIG. 10).

A plurality (two, here) of horizontal partition plates 571 are arranged in the front-row second header 57 (refer to FIG. 10). The front-row second header space Sa2 is partitioned in the flat-tube stacking direction dr2 by the horizontal partition plates 571 into a plurality (three, here) of spaces. Specifically, the front-row second header space Sa2 is partitioned by the horizontal partition plates 571 into a front-row fourth space A4, a front-row fifth space A5, and a front-row sixth space A6 (refer to FIG. 10). The front-row fourth space A4, the front-row fifth space A5, and the front-row sixth space A6 are arranged such that the front-row fourth space A4, the front-row fifth space A5, and the front-row sixth space A6 are aligned in this order from the upper side.

The front-row fourth space A4 communicates with the front-row first space A1 of the front-row first header 56 via the flat multi-hole tubes 45 (refer to FIG. 10). A first connection hole H1 is formed at a portion corresponding to the front-row fourth space A4 of the front-row second header 57. One end of the return pipe 58 is connected to the first connection hole H1. The front-row fourth space A4 and the return pipe 58 communicate with each other. The front-row fourth space A4 communicates with the front-row fifth space A5 via the return pipe 58.

The front-row fifth space A5 communicates with the front-row second space A2 of the front-row first header 56 via the flat multi-hole tubes 45 (refer to FIG. 10). A second connection hole H2 is formed at a portion corresponding to the front-row fifth space A5 of the front-row second header 57. One end of the return pipe 58 is connected to the second connection hole H2. The front-row fifth space A5 and the return pipe 58 communicate with each other.

The front-row sixth space A6 communicates with the front-row third space A3 of the front-row first header 56 via the flat multi-hole tubes 45 (refer to FIG. 10). A third connection hole H3 is formed at a portion corresponding to the front-row sixth space A6 of the front-row second header 57. One end of the connection pipe 70 is connected to the third connection hole H3. The front-row sixth space A6 and the connection pipe 70 communicate with each other. The front-row sixth space A6 communicates with a later-described rear-row second header space Sb2 in the rear-row second header 67 via the connection pipe 70.

(4-1-3-1-4) Return Pipe

The return pipe 58 is a pipe for forming a return flow path that causes a refrigerant that has passed through the flat multi-hole tubes 45 and flowed into any of the spaces (the front-row fourth space A4 or the front-row fifth space A5, here) in the front-row second header 57 to return and flow into the other space (the front-row fifth space A5 or the front-row fourth space A4, here). In one or more embodiments, one end of the return pipe 58 is connected to the front-row second header 57 so as to communicate with the front-row fourth space A4, and other end thereof is connected to the front-row second header 57 so as to communicate with the front-row fifth space A5.

In one or more embodiments, the return pipe 58 is used to form the return flow path; however, the method of forming the return flow path is not limited to such a method. For example, as an alternative to disposing the return pipe 58, an opening may be formed in the horizontal partition plate 571 between the front-row fourth space A4 and the front-row fifth space A5 to form a flow path that causes the front-row fourth space A4 and the front-row fifth space A5 to communicate with each other.

(4-1-3-2) Rear Row Configuration

Figure 11:
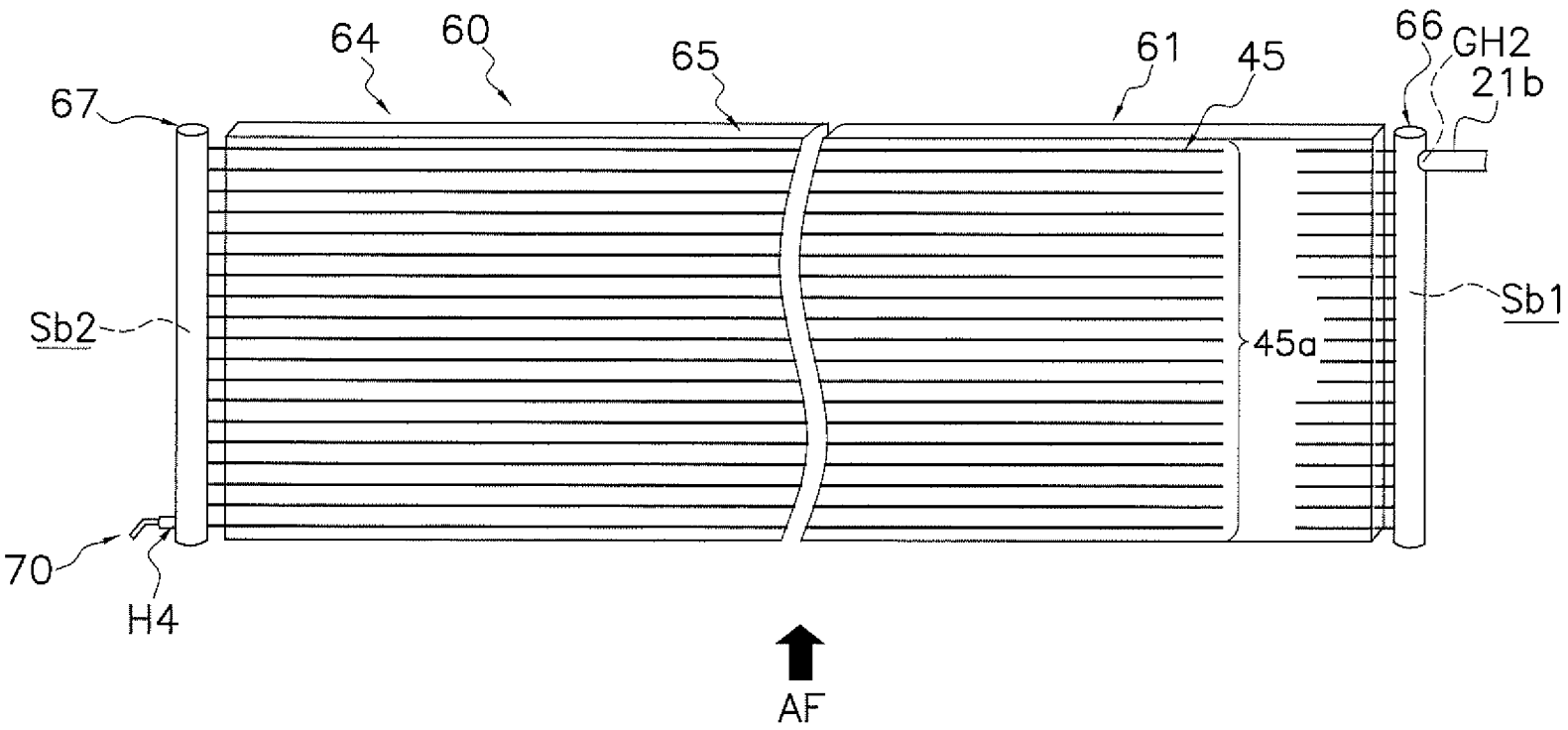
FIG. 11 is a schematic view roughly illustrating a rear row configuration of the indoor heat exchanger in FIG. 5.

FIG. 11 is a schematic view roughly illustrating the rear row configuration including the rear-row heat exchanging unit 60, the rear-row first header 66, and the rear-row second header 67.

The rear-row heat exchanging unit 60 includes the rear-row heat exchanging surface 65 as the heat exchanging surface 40. The rear-row heat exchanging surface 65 includes the rear-row first heat exchanging surface 61, the rear-row second heat exchanging surface 62, the rear-row third heat exchanging surface 63, and the rear-row fourth heat exchanging surface 64.

(4-1-3-2-1) Rear-Row Heat Exchanging Unit

The flat multi-hole tubes 45 included in the rear-row heat exchanging surface 65 of the rear-row heat exchanging unit 60 extend from the first end (the rear-row first header 66) toward the second end (the rear-row second header 67). Each of the flat multi-hole tubes 45 extends to define the four sides of a substantially quadrilateral shape (Each of the flat multi-hole tubes 45 are arranged in a substantially square shape). The rear-row first heat exchanging surface 61, the rear-row second heat exchanging surface 62, the rear-row third heat exchanging surface 63, and the rear-row fourth heat exchanging surface 64 are arranged in this order in a direction, in which the flat multi-hole tubes 45 extend, from the end adjacent to the rear-row first header 66 toward the end adjacent to the rear-row second header 67.

The rear-row first heat exchanging surface 61, the rear-row second heat exchanging surface 62, the rear-row third heat exchanging surface 63, and the rear-row fourth heat exchanging surface 64 are arranged in a substantially quadrilateral shape in plan view (refer to FIG. 5). Specifically, the rear-row first heat exchanging surface 61 extend forward from the rear-row first header 66. The rear-row second heat exchanging surface 62 extends rightward from the front end of the rear-row first heat exchanging surface 61. The rear-row third heat exchanging surface 63 extends rearward from the right end of the rear-row second heat exchanging surface 62. The rear-row fourth heat exchanging surface 64 extends leftward from the rear end of the rear-row third heat exchanging surface 63 to the rear-row second header 67.

The rear-row heat exchanging surface 65 having the substantially quadrilateral shape is arranged adjacent to the front-row heat exchanging surface 55 so as to surround the front-row heat exchanging surface 55 (refer to FIG. 6). The rear-row first heat exchanging surface 61, the rear-row second heat exchanging surface 62, the rear-row third heat exchanging surface 63, and the rear-row fourth heat exchanging surface 64 are arranged to face the front-row first heat exchanging surface 51, the front-row second heat exchanging surface 52, the front-row third heat exchanging surface 53, and the front-row fourth heat exchanging surface 54, respectively.

From the point of view of easy understanding, the rear-row first heat exchanging surface 61, the rear-row second heat exchanging surface 62, the rear-row third heat exchanging surface 63, and the rear-row fourth heat exchanging surface 64, which are each arranged in the quadrilateral shape, are drawn as a single flat surface shape in the schematic views, such as FIG. 11.

(4-1-3-2-2) Rear-Row First Header

The rear-row first header 66 is a header pipe that functions, for example, as a distribution header that causes a refrigerant to diverge into each of the flat multi-hole tubes 45 or a merging header that causes the refrigerant flowing out from each of the flat multi-hole tubes 45 to merge together. In an installed state, the rear-row first header 66 extends such that the vertical direction coincides with the longitudinal direction thereof. The rear-row first header 66 is arranged on the airflow downstream side (the left side in FIG. 6) of the front-row first header 56 in the air flow direction dr3 so as to be adjacent to the front-row first header 56.

The rear-row first header 66 has a cylindrical shape, and a rear-row first header space Sb1 is formed in the rear-row first header 66 (refer to FIG. 11). The rear-row first header 66 is connected to the terminal end (rear end) of the rear-row first heat exchanging surface 61 (refer to FIG. 6). The rear-row first header 66 is connected to one end of each of the flat multi-hole tubes 45 of the rear-row heat exchanging unit 60 and causes these flat multi-hole tubes 45 to communicate with the rear-row first header space Sb1 (refer to FIG. 11).

The second gas-side port GH2 is formed in the rear-row first header 66 (refer to FIG. 11). The second gas-side port GH2 communicates with the rear-row first header space Sb1. The second gas-refrigerant pipe 21*b* is connected to the second gas-side port GH2 (refer to FIG. 11). The rear-row first header space Sb1 is positioned on the most downstream side of a refrigerant flow in the indoor heat exchanger 25 during cooling operation and positioned on the most upstream side of the refrigerant flow in the indoor heat exchanger 25 during heating operation.

(4-1-3-2-3) Rear-Row Second Header

The rear-row second header 67 is a header pipe that functions, for example, as a distribution header that causes a refrigerant to diverge into each of the flat multi-hole tubes 45, a merging header that causes the refrigerant flowing out from each of the flat multi-hole tubes 45 to merge together, or a return header that causes the refrigerant flowing out from each of the flat multi-hole tubes 45 to return into the other flat multi-hole tubes 45. In an installed state, the rear-row second header 67 extends such that the vertical direction coincides with the longitudinal direction thereof. The rear-row second header 67 is adjacent to the airflow downstream side (the rear side in FIG. 6) of the front-row second header 57 in the air flow direction dr3.

The rear-row second header 67 has a cylindrical shape, and the rear-row second header space Sb2 is formed in the rear-row second header 67 (refer to FIG. 11). The rear-row second header 67 is connected to the terminal end (left end) of the rear-row fourth heat exchanging surface 64 (refer to FIG. 6). The rear-row second header 67 is connected to one end of each of the flat multi-hole tubes 45 of the rear-row heat exchanging unit 60 and causes these flat multi-hole tubes 45 to communicate with the rear-row second header space Sb2 (refer to FIG. 11).

The rear-row second header space Sb2 communicates with the rear-row first header space Sb1 of the rear-row first header 66 via the flat multi-hole tubes 45 (refer to FIG. 11). A fourth connection hole H4 is formed in the front-row second header 57. One end of the connection pipe 70 is connected to the fourth connection hole H4. The rear-row second header space Sb2 communicates with the front-row sixth space A6 of the front-row second header 57 via the connection pipe 70.

(4-1-3-3) Connection Pipe

The connection pipe 70 is a refrigerant pipe that forms a refrigerant flow path between the front-row heat exchanging unit 50 and the rear-row heat exchanging unit 60. The connection pipe 70 is a refrigerant flow path that causes the front-row sixth space A6 of the front-row second header 57 and the rear-row second header space Sb2 of the rear-row second header 67 to communicate with each other.

(4-2) Refrigerant Paths in Indoor Heat Exchanger

Refrigerant paths in the indoor heat exchanger 25 will be described. Here, "path" denotes a refrigerant flow path formed as a result of components included in the indoor heat exchanger 25 communicating with each other.

Figure 12:
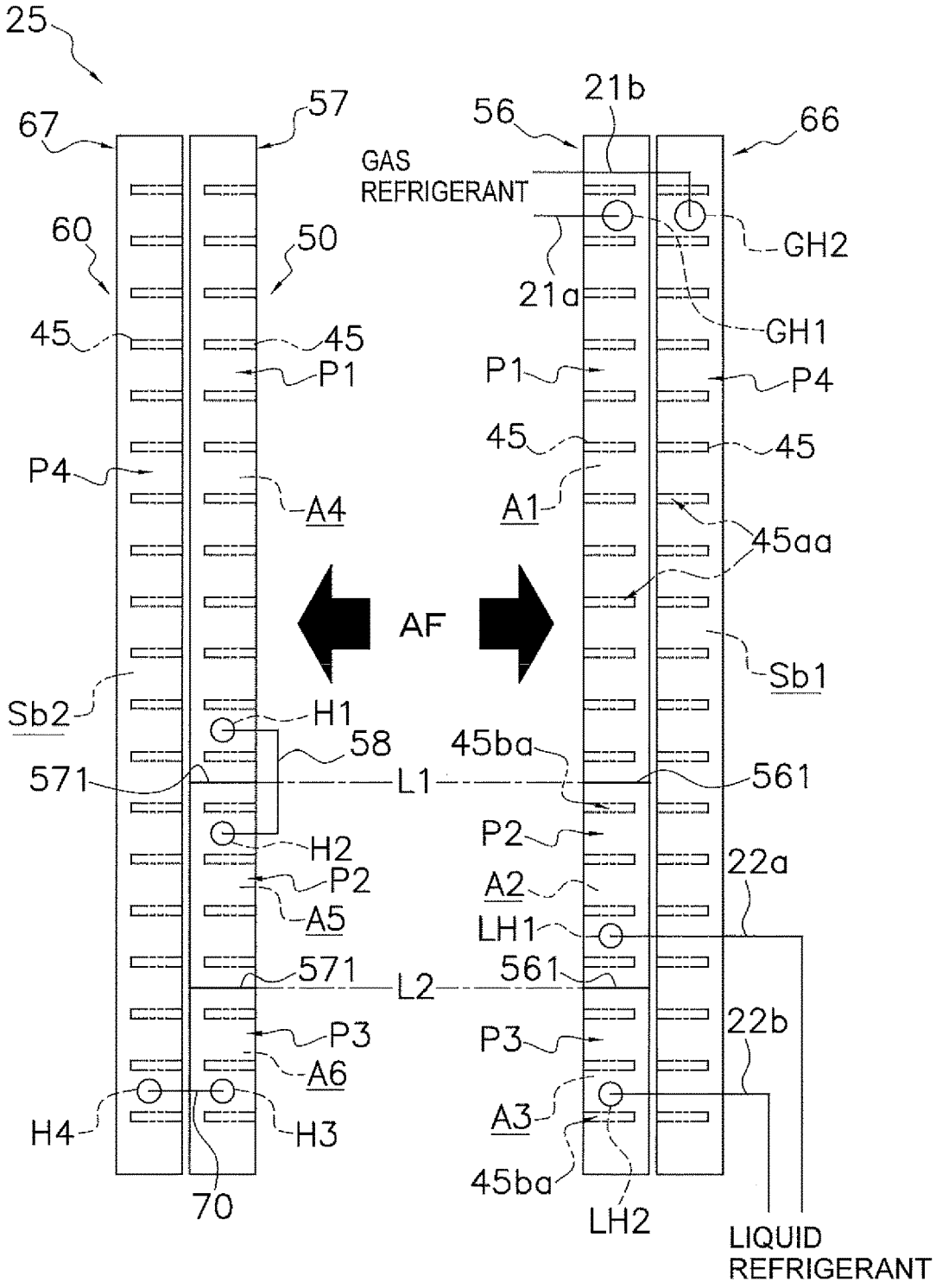
FIG. 12 is a schematic view roughly illustrating refrigerant paths formed in the indoor heat exchanger in FIG. 5.

FIG. 12 is a schematic view roughly illustrating refrigerant paths formed in the indoor heat exchanger 25. In one or more embodiments, a plurality of paths are formed in the indoor heat exchanger 25. Specifically, a first path P1, a second path P2, a third path P3, and a fourth path P4 are formed in the indoor heat exchanger 25.

(4-2-1) First Path

Figure 13:
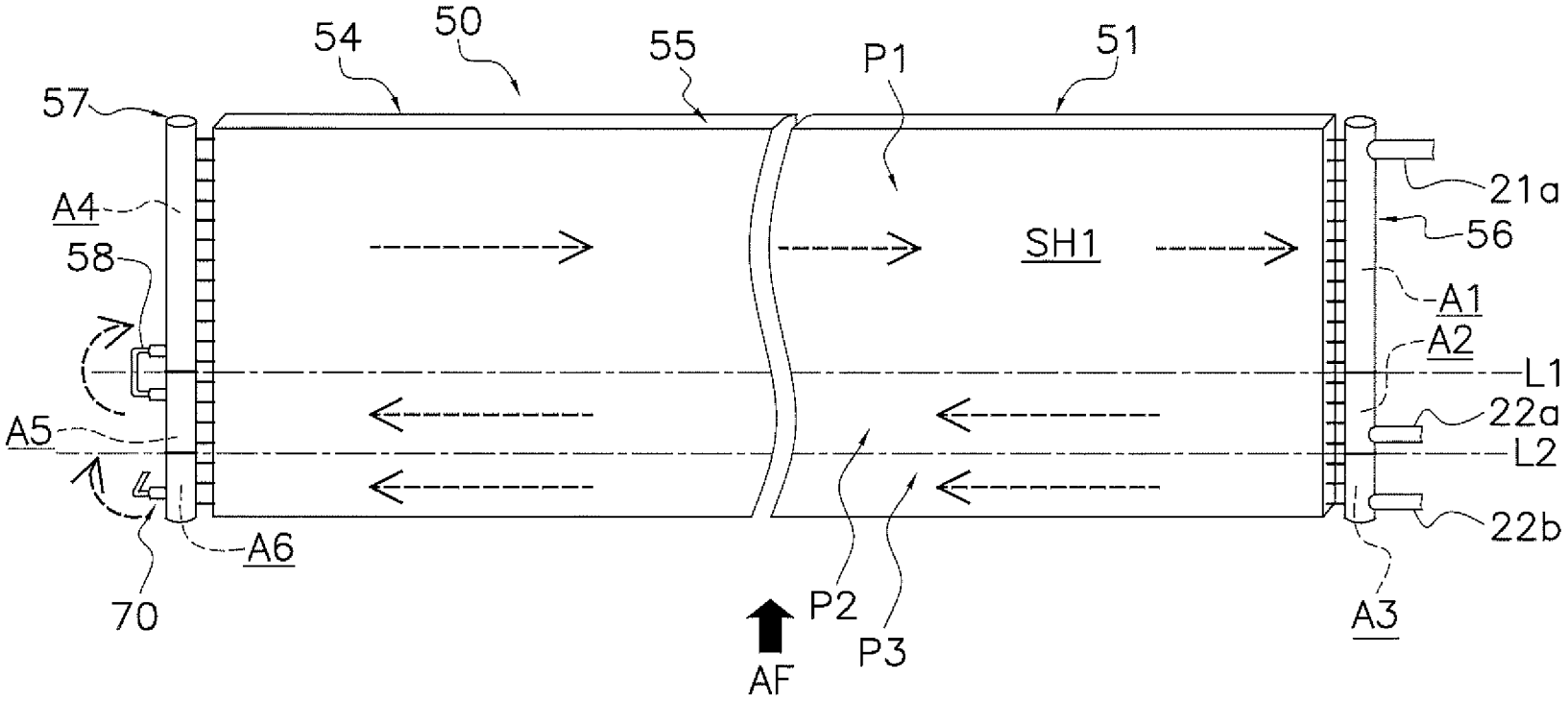
FIG. 13 is a schematic view roughly illustrating a refrigerant flow during cooling operation in a front-row heat exchanging unit of the indoor heat exchanger in FIG. 5.

The first path P1 is a refrigerant flow path that is formed by, mainly, the front-row heat exchanging unit 50, the front-row first header 56, and the front-row second header 57 (refer to, for example, FIG. 12 and FIG. 13). In one or more embodiments, the first path P1 is formed at a portion of the front-row heat exchanging unit 50 above the one-dot chain line L1 (refer to, for example, FIG. 12 and FIG. 13). The first path P1 is formed by, mainly, the front-row first space A1, the flat multi-hole tubes 45 that cause the front-row first space A1 and the front-row fourth space A4 to communicate with each other, and the front-row fourth space A4.

The indoor air flow AF that passes through the front-row heat exchanging unit 50 may have an air velocity distribution. For example, the air velocity of the indoor air flow AF that passes through a portion of the front-row heat exchanging unit 50 on the upper-tier side is higher than the air velocity of the indoor air flow AF that passes through a portion of the front-row heat exchanging unit 50 on the lower-tier side. For example, the air velocity of the indoor air flow AF that passes through a portion of the front-row heat exchanging unit 50 above the one-dot chain line L1 (refer to FIG. 10) is higher than the air velocity of the indoor air flow AF that passes through a portion thereof below the one-dot chain line L1.

During cooling operation, a refrigerant flows from the front-row fourth space A4 toward the front-row first space A1 in the first path P1 (refer to FIG. 13).

Figure 15:
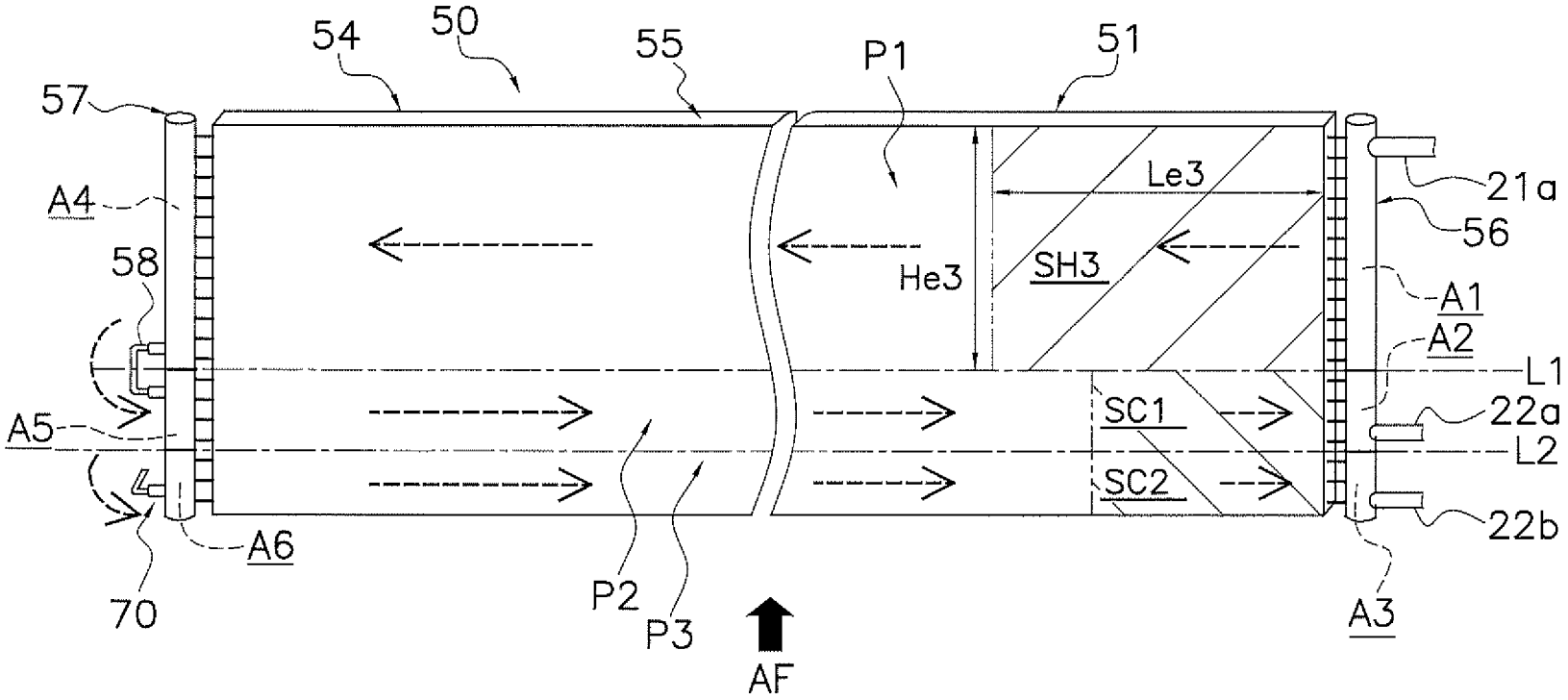
FIG. 15 is a schematic view roughly illustrating a refrigerant flow during heating operation in the front-row heat exchanging unit of the indoor heat exchanger in FIG. 5.

During heating operation, the refrigerant flows from the front-row first space A1 toward the front-row fourth space A4 in the first path P1 (refer to FIG. 15). More specifically, during heating operation, mainly, a gas refrigerant in a superheated state flows from the first gas-refrigerant pipe 21*a* into the front-row first space A1 by passing through the first gas-side port GH1. The gas refrigerant that has flowed into the front-row first space A1 flows in from end-portion openings (gas-refrigerant ports 45*aa*; refer to FIG. 12) of the flat multi-hole tubes 45 of the first path P1 at the end adjacent to the front-row first space A1, passes through the flat-tube flow paths 451, and flows in from end-portion openings of the flat multi-hole tubes 45 of the first path P1 at the end adjacent to the front-row fourth space A4 into the front-row fourth space A4.

The flat multi-hole tubes 45 of the first path P1 are an example of gas-side flat multi-hole tubes in which the gas-refrigerant ports 45*aa* (refer to FIG. 12) are disposed at one end (the end adjacent to the front-row first header 56; the first end) thereof. The gas-refrigerant ports 45*aa* are refrigerant inlets of the flat multi-hole tubes 45 on the most upstream side in a refrigerant flow direction in the indoor heat exchanger 25 during heating operation (when the indoor heat exchanger 25 functions as a condenser). In other words, when the indoor heat exchanger 25 functions as a condenser, the gas refrigerant that flows from the gas-refrigerant pipe 21 into the indoor heat exchanger 25 first flows through the gas-side flat multi-hole tubes. The gas-refrigerant ports 45*aa* are refrigerant outlets of the flat multi-hole tubes 45 on the most downstream side in a refrigerant flow direction in the indoor heat exchanger 25 during cooling operation (when the indoor heat exchanger 25 functions as an evaporator). In other words, when the indoor heat exchanger 25 functions as an evaporator, the refrigerant lastly flows through the gas-side flat multi-hole tubes and flows out from the indoor heat exchanger 25 to the liquid-refrigerant pipe 22. In other words, the gas-side flat multi-hole tubes are the flat multi-hole tubes 45 connected to the space of the header communicating with the gas-side ports GH. Hereinafter, of the flat multi-hole tubes 45, in particular, the gas-side multi-hole tubes are referred to as gas-side flat multi-hole tubes 45*a* (refer to FIG. 10).

As illustrated in FIG. 10 and FIG. 12, the one-dot chain line L1 (height position at which the horizontal partition plate 561 between the front-row first space A1 and the front-row second space A2 and the horizontal partition plate 571 between the front-row fourth space A4 and the front-row fifth space A5 are arranged) is positioned between the twelfth flat multi-hole tube 45 and the thirteenth flat multi-hole tube 45 as counted from the upper side. In other words, in one or more embodiments, the first path P1 includes the first to twelfth flat multi-hole tubes 45 (the gas-side flat multi-hole tubes 45*a*) as counted from the upper side.

(4-2-2) Second Path

The second path P2 is a refrigerant flow path formed by, mainly, the front-row heat exchanging unit 50, the front-row first header 56, and the front-row second header 57. In one or more embodiments, the second path P2 is formed at a portion of the front-row heat exchanging unit 50 below the one-dot chain line L1 and above the one-dot chain line L2 (refer to, for example, FIG. 12 and FIG. 13). The second path P2 is formed by, mainly, the front-row second space A2, the flat multi-hole tubes 45 communicating with the front-row second space A2 and the front-row fifth space A5, and the front-row fifth space A5.

During cooling operation, a refrigerant flows from the front-row second space A2 toward the front-row fifth space A5 in the second path P2 (refer to FIG. 13).

During heating operation, a refrigerant flows from the front-row fifth space A5 toward the front-row second space A2 in the second path P2 (refer to FIG. 15). More specifically, during heating operation, a refrigerant that has flowed through the first path P1 (the gas-side flat multi-hole tubes 45*a*) and the return pipe 58 flows from the second connection hole H2 into the front-row fifth space A5. In the front-row fifth space A5 (in the front-row second header 57), the refrigerant that has flowed out from a plurality of the gas-side flat multi-hole tubes 45*a* merges together. The refrigerant that has merged together in the front-row fifth space A5 (in the front-row second header 57) is guided into a plurality of the flat multi-hole tubes 45 of the second path P2. Specifically, the refrigerant that has been caused to merge together in the front-row fifth space A5 flows in from end-portion openings of the flat multi-hole tubes 45 of the second path P2 at the end adjacent to the front-row fifth space A5, passes through the flat-tube flow paths 451, and flows from end-portion openings (liquid-refrigerant ports 45*ba*; refer to FIG. 12) of the flat multi-hole tubes 45 of the second path P2 at the end adjacent to the front-row second space A2 into the front-row second space A2. The refrigerant that flows into the front-row second space A2 during heating operation is, mainly, a liquid refrigerant in a subcooled state.

The flat multi-hole tubes 45 of the second path P2 are an example of liquid-side flat multi-hole tubes that differ from the gas-side flat multi-hole tubes 45*a* and that each include the liquid-refrigerant port 45*ba* (refer to FIG. 12) at one end (the end adjacent to the front-row first header 56; the first end) thereof. The liquid-refrigerant ports 45*ba* are refrigerant outlets of the flat multi-hole tubes 45 on the most downstream side in a refrigerant flow direction in the indoor heat exchanger 25 during heating operation (when the indoor heat exchanger 25 functions as a condenser). In other words, when the indoor heat exchanger 25 functions as a condenser, the refrigerant lastly flows through the liquid-side flat multi-hole tubes and flows out from the indoor heat exchanger 25 to the liquid-refrigerant pipe 22. The liquid-refrigerant ports 45*ba* are refrigerant inlets of the flat multi-hole tubes 45 on the most upstream side in the refrigerant flow in the indoor heat exchanger 25 during cooling operation (when the indoor heat exchanger 25 function as an evaporator). In other words, when the indoor heat exchanger 25 functions as an evaporator, the liquid refrigerant that flows from the liquid-refrigerant pipe 22 into the indoor heat exchanger 25 firstly flows through the liquid-side flat multi-hole tubes. In other words, the liquid-side flat multi-hole tubes are the flat multi-hole tubes 45 connected to the space of the header communicating with the liquid-side ports LH. Hereinafter, of the flat multi-hole tubes 45, in particular, the liquid-side flat multi-hole tubes are referred to as liquid-side flat multi-hole tubes 45*b* (refer to FIG. 10).

As illustrated in FIG. 10 and FIG. 12, the one-dot chain line L2 (height position at which the horizontal partition plate 561 between the front-row second space A2 and the front-row third space A3 and the horizontal partition plate 571 between the front-row fifth space A5 and the front-row sixth space A6 are arranged) is positioned between the sixteenth flat multi-hole tube 45 and the seventeenth flat multi-hole tube 45 as counted from the upper side. In other words, in one or more embodiments, the second path P2 includes the thirteenth to sixteenth (that is, four) flat multi-hole tubes 45 (the liquid-side flat multi-hole tubes 45*b*) as counted from the upper side.

(4-2-3) Third Path

The third path P3 is a refrigerant flow path formed by, mainly, the front-row heat exchanging unit 50, the front-row first header 56, and the front-row second header 57. In one or more embodiments, the third path P3 is formed at a portion of the front-row heat exchanging unit 50 below the one-dot chain line L2 (refer to, for example, FIG. 12 and FIG. 13). The third path P3 is formed by, mainly, the front-row third space A3, the flat multi-hole tubes 45 communicating with the front-row third space A3 and the front-row sixth space A6, and the front-row sixth space A6.

During cooling operation, a refrigerant flows from the front-row third space A3 toward the front-row sixth space A6 in the third path P3 (refer to FIG. 13).

During heating operation, a refrigerant flows from the front-row sixth space A6 toward the front-row third space A3 in the third path P3 (refer to FIG. 15). More specifically, during heating operation, a refrigerant that has flowed through the later-described fourth path P4 (the gas-side flat multi-hole tubes 45*a*) and the connection pipe 70 flows from the third connection hole H3 into the front-row sixth space A6. The refrigerant that has flowed into the front-row sixth space A6 is guided into a plurality of the flat multi-hole tubes 45 of the third path P3. Specifically, the refrigerant that has flowed into the front-row sixth space A6 flows in through end-portion openings of the flat multi-hole tubes 45 of the third path P3 at the end adjacent to the front-row sixth space A6, passes through the flat-tube flow paths 451, and flows from end-portion openings (the liquid-refrigerant ports 45*ba*) of the flat multi-hole tubes 45 of the third path P3 at the end adjacent to the front-row third space A3 into the front-row third space A3. The refrigerant that flows into the front-row third space A3 during heating operation is, mainly, a liquid refrigerant in a subcooled state. The flat multi-hole tubes 45 of the third path P3 are the liquid-side flat multi-hole tubes 45*b*.

As illustrated in FIG. 10 and FIG. 12, the third path P3 includes the seventeenth to nineteenth (that is, three) flat multi-hole tubes 45 (the liquid-side flat multi-hole tubes 45*b*) as counted from the upper side.

(4-2-4) Fourth Path

Figure 14:
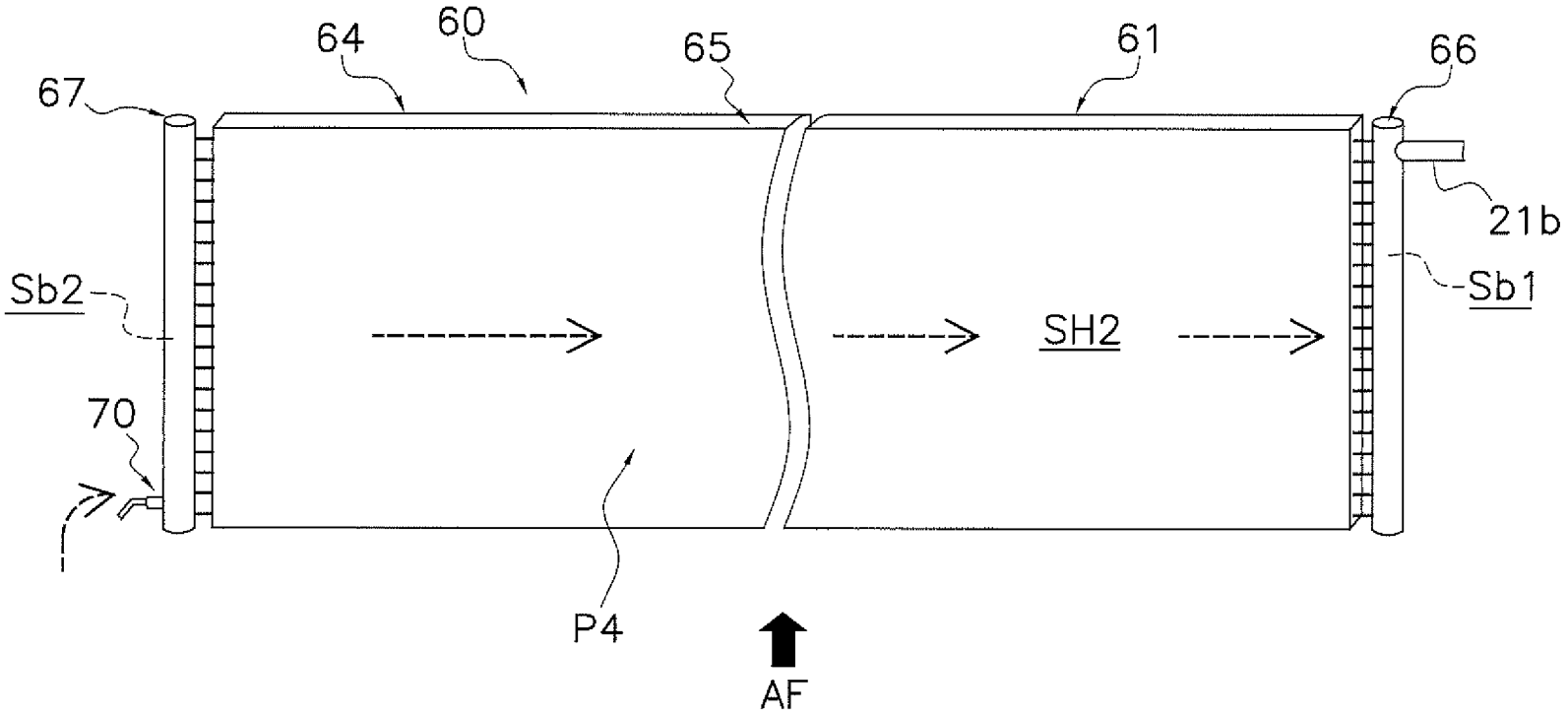
FIG. 14 is a schematic view roughly illustrating a refrigerant flow during cooling operation in a rear-row heat exchanging unit of the indoor heat exchanger in FIG. 5.

The fourth path P4 is a refrigerant flow path formed by, mainly, the rear-row heat exchanging unit 60, the rear-row first header 66, and the rear-row second header 67 (refer to, for example, FIG. 12 and FIG. 14). The fourth path P4 is formed by, mainly, the rear-row first header space Sb1, the flat multi-hole tubes 45 communicating with the rear-row first header space Sb1 and the rear-row second header space Sb2, and the rear-row second header space Sb2.

During cooling operation, a refrigerant flows from the rear-row second header space Sb2 toward the rear-row first header space Sb1 in the fourth path P4 (refer to FIG. 14).

Figure 16:
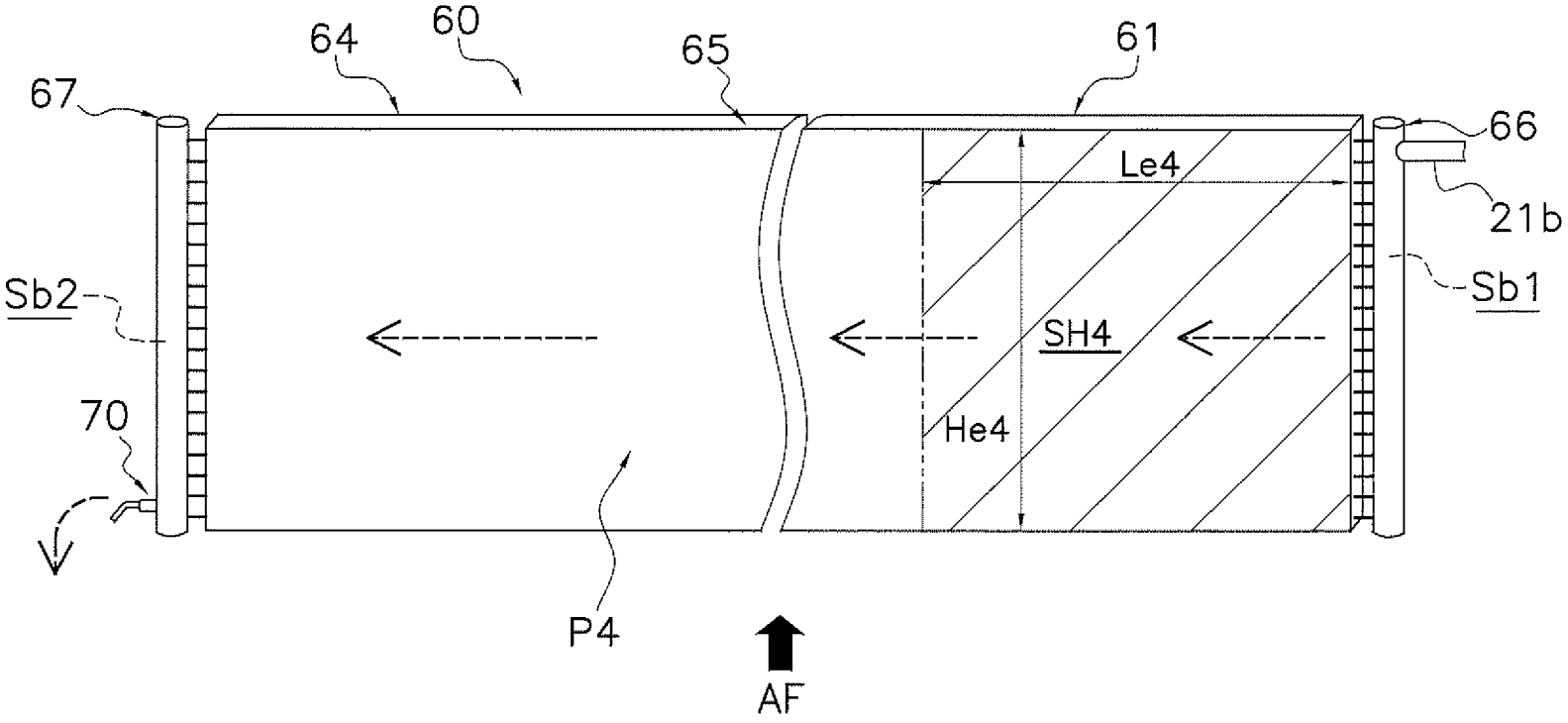
FIG. 16 is a schematic view roughly illustrating a refrigerant flow during heating operation in the rear-row heat exchanging unit of the indoor heat exchanger in FIG. 5.

During heating operation, a refrigerant flows from the rear-row first header space Sb1 toward the rear-row second header space Sb2 in the fourth path P4 (refer to FIG. 16). More specifically, during heating operation, mainly, a gas refrigerant in a superheated state flows from the second gas-refrigerant pipe 21*b* into the rear-row first header space Sb1 by passing through the second gas-side port GH2. The gas refrigerant that has flowed into the rear-row first header space Sb1 flows in from end-portion openings (gas-refrigerant ports 45*aa*) of the flat multi-hole tubes 45 of the fourth path P4 at the end adjacent to the rear-row first header space Sb1, passes through the flat-tube flow paths 451, and flows from end-portion openings of the flat multi-hole tubes 45 of the first path P1 at the end adjacent to the rear-row second header space Sb2 into the rear-row second header space Sb2. In the rear-row second header space Sb2 (in the rear-row second header 67), the refrigerant that has flowed out from a plurality of the gas-side flat multi-hole tubes 45*a* merges together. The refrigerant that has merged together in the rear-row second header space Sb2 (in the rear-row second header 67) is guided into a plurality of the liquid-side flat multi-hole tubes 45*b* of the third path P3 via the connection pipe 70 and the front-row sixth space A6.

The flat multi-hole tubes 45 of the fourth path P4 are the gas-side flat multi-hole tubes 45*a* (refer to FIG. 10). As illustrated in FIG. 10 and FIG. 12, the fourth path P4 includes a total of 19 of the flat multi-hole tubes 45 (the gas-side flat multi-hole tubes 45*a*).

In other words, all of the nineteen flat multi-hole tubes 45 of the rear-row heat exchanging unit 60 are the gas-side flat multi-hole tubes 45*a* constituting the fourth path P4. In contrast, of the flat multi-hole tubes 45 of the front-row heat exchanging unit 50, the twelve flat multi-hole tubes 45 at an upper portion are the gas-side flat multi-hole tubes 45*a*, and the seven flat multi-hole tubes 45 at a lower portion are the liquid-side flat multi-hole tubes 45*b*.

In other words, the indoor heat exchanger 25 according to one or more embodiments has a configuration in which the number of the gas-side flat multi-hole tubes 45*a* included in the heat exchanging unit (the front-row heat exchanging unit 50) at the front-most row on the airflow upstream side in the air flow direction dr3 is less than the number of the gas-side flat multi-hole tubes 45*a* included in the heat exchanging unit (the rear-row heat exchanging unit 60) at the rear-most row on the airflow downstream side.

The indoor heat exchanger 25 according to one or more embodiments also has a configuration in which a plurality of heat exchanging units (the front-row heat exchanging unit 50 and the rear-row heat exchanging unit 60) each include the gas-side flat multi-hole tubes 45*a*.

The indoor heat exchanger 25 according to one or more embodiments also has a configuration in which the total number 31 (the rear-row heat exchanging unit 60: 19; the front-row heat exchanging unit 50: 12) of the gas-side flat multi-hole tubes 45*a* is more than the total number 7 (all included in the front-row heat exchanging unit 50) of the liquid-side flat multi-hole tubes 45*b*.

The indoor heat exchanger 25 according to one or more embodiments also has a configuration in which the gas-refrigerant port 45*aa* included in each of the gas-side flat multi-hole tubes 45*a* is disposed at the end adjacent to the first headers 56 and 66.

Advantages that are provided by the indoor heat exchanger 25 having these configurations will be described later.

(4-3) Refrigerant Flow in Indoor Heat Exchanger (4-3-1) During Cooling Operation FIG. 13 is a schematic view roughly illustrating a refrigerant flow in the front-row heat exchanging unit 50 during cooling operation. FIG. 14 is a schematic view roughly illustrating a refrigerant flow in the rear-row heat exchanging unit 60 during cooling operation. The dashed arrows in FIG. 13 and FIG. 14 each indicate a refrigerant-flow direction.

During cooling operation, a refrigerant that has flowed through the first liquid-refrigerant pipe 22*a* flows into the second path P2 of the front-row heat exchanging unit 50 via the first liquid-side port LH1. The liquid refrigerant that has flowed into the second path P2 passes through the liquid-side flat multi-hole tubes 45*b* of the second path P2 while exchanging heat with the indoor air flow AF and being heated. The refrigerant that has been heated in the liquid-side flat multi-hole tubes 45*b* of the second path P2 and that has entered a two-phase state (state in which a liquid phase and a gas phase are mixed) at an intermediate portion of each of the liquid-side flat multi-hole tubes 45*b* merges together at the front-row second header 57 (at the front-row fifth space A5) and then flows into the first path P1 via the return pipe 58. The refrigerant that has flowed into the first path P1 passes through the gas-side flat multi-hole tubes 45*a* of the first path P1 while exchanging heat with the indoor air flow AF and being heated, and the gas-phase refrigerant flows out to the first gas-refrigerant pipe 21*a* via the first gas-side port GH1.

During cooling operation, a refrigerant that has flowed through the second liquid-refrigerant pipe 22*b* flows into the third path P3 of the front-row heat exchanging unit 50 via the second liquid-side port LH2. The liquid refrigerant that has flowed into the third path P3 passes through the liquid-side flat multi-hole tubes 45*b* of the third path P3 while exchanging heat with the indoor air flow AF and being heated. The refrigerant that has been heated in the liquid-side flat multi-hole tubes 45*b* of the third path P3 and that has entered a two-phase state at an intermediate portion of each of the liquid-side flat multi-hole tubes 45*b* merges together at the front-row second header 57 (at the front-row sixth space A6) and then flows into the fourth path P4 of the rear-row heat exchanging unit 60 via the connection pipe 70. The refrigerant that has flowed into the fourth path P4 passes through the gas-side flat multi-hole tubes 45*a* of the fourth path P4 while exchanging heat with the indoor air flow AF and being heated, and the gas-phase refrigerant flows out to the second gas-refrigerant pipe 21*b* via the second gas-side port GH2.

In the indoor heat exchanger 25 during cooling operation (in particular, when operation has entered a steady state), a region (superheat region SH1) in which a refrigerant in a superheated state flows is formed at the flat-tube flow paths 451 (in particular, the flat-tube flow paths 451 at the end adjacent to the front-row first header 56 in the first path P1 (for example, the flat-tube flow paths 451 included in the first path P1 of the front-row first heat exchanging surface 51)) in the first path P1. The other regions of the flat-tube flow paths 451 in the first path P1 than the superheat region SH1 are, mainly, two-phase regions in which a two-phase refrigerant (refrigerant in which a liquid phase and a gas phase are mixed) flows. In addition, a region (superheat region SH2) in which a refrigerant in a superheated state flows is formed at the flat-tube flow paths 451 (in particular, the flat-tube flow paths 451 at the end adjacent to the rear-row first header 66 in the fourth path P4 (for example, the flat-tube flow paths 451 included in the fourth path P4 of the rear-row first heat exchanging surface 61)) in the fourth path P4. The other regions of the flat-tube flow paths 451 in the fourth path P4 than the superheat region SH2 are, mainly, two-phase regions in which a two-phase refrigerant flows.

The indoor heat exchanger 25 according to one or more embodiments has a configuration in which each of the front-row heat exchanging unit 50 and the rear-row heat exchanging unit 60 includes the gas-side flat multi-hole tubes 45*a* (the pipes that each include a gas refrigerant outlet at one end thereof in the refrigerant-flow direction during cooling operation). The indoor heat exchanger 25 according to one or more embodiments also has a configuration in which the total number of the gas-side flat multi-hole tubes 45*a* at which a refrigerant that has been heated at the liquid-side flat multi-hole tubes 45*b* is further heated during cooling operation is more than the total number of the liquid-side flat multi-hole tubes 45*b*. Thus, performance degradation is easily suppressed, even when a degree of superheat in a refrigeration cycle is controlled to be relatively high during cooling operation, in which the indoor heat exchanger 25 is used as an evaporator.

(4-3-2) During Heating Operation

In the indoor heat exchanger 25 during heating operation, a gas refrigerant in a superheated state flows in from the gas-side ports GH and is cooled at the heat exchanging units 50 and 60, and a liquid refrigerant in a subcooled state flows out from the liquid-side ports LH.

FIG. 15 is a schematic view roughly illustrating a refrigerant flow in the front-row heat exchanging unit 50 during heating operation. FIG. 16 is a schematic view roughly illustrating a refrigerant flow in the rear-row heat exchanging unit 60 during heating operation. The dashed arrows in FIG. 15 and FIG. 16 each indicate a refrigerant-flow direction.

During heating operation, a gas refrigerant that has flowed through the first gas-refrigerant pipe 21*a* and that is in a superheated state flows into the front-row first space A1 of the front-row first header 56 via the first gas-side port GH1. The gas refrigerant that has flowed into the front-row first space A1 passes through the flat-tube flow paths 451 of the gas-side flat multi-hole tubes 45*a* of the first path P1 while exchanging heat with the indoor air flow AF and being cooled. The refrigerant that has been cooled at the gas-side flat multi-hole tubes 45*a* of the first path P1 and that has entered a two-phase state at an intermediate portion of each of the gas-side flat multi-hole tubes 45*a* flows into the front-row fourth space A4. The refrigerant that has flowed into the front-row fourth space A4 flows into the front-row fifth space A5 via the return pipe 58. The refrigerant that has flowed into the front-row fifth space A5 passes through the flat-tube flow paths 451 of the liquid-side flat multi-hole tubes 45*b* of the second path P2 while exchanging heat with the indoor air flow AF and entering a subcooled state and flows out to the first liquid-refrigerant pipe 22*a* via the front-row second space A2 and the first liquid-side port LH1.

During heating operation, a gas refrigerant that has flowed through the second gas-refrigerant pipe 21*b* and that is in a superheated state flows into the rear-row first header space Sb1 of the rear-row first header 66 via the second gas-side port GH2. The gas refrigerant that has flowed into the rear-row first header space Sb1 passes through the flat-tube flow paths 451 of the gas-side flat multi-hole tubes 45*a* of the fourth path P4 while exchanging heat with the indoor air flow AF and being cooled. The refrigerant that has been cooled at the gas-side flat multi-hole tubes 45*a* of the fourth path P4 and that has entered a two-phase state at an intermediate portion of each of the gas-side flat multi-hole tubes 45*a* flows into the rear-row second header space Sb2. The refrigerant that has flowed into the rear-row second header space Sb2 flows into the front-row sixth space A6 of the front-row second header 57 via the connection pipe 70. The refrigerant that has flowed into the front-row sixth space A6 passes through the flat-tube flow paths 451 of the liquid-side flat multi-hole tubes 45*b* of the third path P3 while exchanging heat with the indoor air flow AF and entering a subcooled state, and flows out to the second liquid-refrigerant pipe 22*b* via the front-row third space A3 and the second liquid-side port LH2.

In the front-row second header 57, a space (the front-row fifth space A5), into which the refrigerant that has flowed out from the gas-side flat multi-hole tubes 45*a* of the front-row heat exchanging unit 50 flows, and a space (the front-row sixth space A6), into which the refrigerant that has flowed out from the gas-side flat multi-hole tubes 45*a* of the rear-row heat exchanging unit 60 flows, are segregated from each other. In other words, the horizontal partition plate 571 that segregates the refrigerant that has flowed out from the gas-side flat multi-hole tubes 45*a* by the heat exchanging units is arranged in the front-row second header 57.

In the indoor heat exchanger 25 during heating operation (in particular, when operation has entered a steady state), a region (superheat region SH3) in which a refrigerant in a superheated state flows is formed at the flat-tube flow paths 451 (in particular, the flat-tube flow paths 451 of the gas-side flat multi-hole tubes 45*a* at the end adjacent to the front-row first header 56 in the first path P1 (for example, the flat-tube flow paths 451 included in the first path P1 of the front-row first heat exchanging surface 51)) in the first path P1. The other regions of the flat-tube flow paths 451 of the first path P1 than the superheat region SH3 are, mainly, two-phase regions in which a two-phase refrigerant flows. In addition, a region (superheat region SH4) in which a refrigerant in a superheated state flows is formed at the flat-tube flow paths 451 (in particular, the flat-tube flow paths 451 at the end adjacent to the rear-row first header 66 in the fourth path P4 (for example, the flat-tube flow paths 451 included in the fourth path P4 of the rear-row first heat exchanging surface 61)) in the fourth path P4. The other regions of the flat-tube flow paths 451 of the fourth path P4 than the superheat region SH4 are, mainly, two-phase regions in which a two-phase refrigerant flows. Each of the superheat region SH3 and the superheat region SH4 is an example of a gas region, in which a gas refrigerant flows. The gas regions are formed in the vicinity of the gas-refrigerant ports 45*aa* of the gas-side flat multi-hole tubes 45*a*.

In the indoor heat exchanger 25 according to one or more embodiments, as described above, the gas-refrigerant port 45*aa* included in each of the gas-side flat multi-hole tubes 45*a* is disposed at the end adjacent to the first headers 56 and 66. Thus, as illustrated in FIG. 15 and FIG. 16, the superheat region SH3 of the front-row heat exchanging unit 50 and the superheat region SH4 of the rear-row heat exchanging unit 60 are arranged at the same end portion (the end adjacent to the first headers 56 and 66) of the flat multi-hole tubes 45. In other words, the superheat region SH3 of the front-row heat exchanging unit 50 and the superheat region SH4 of the rear-row heat exchanging unit 60 are arranged to be superposed with each other in the air flow direction dr3. A flowing direction of a refrigerant that flows in the superheat region SH3 of the front-row heat exchanging unit 50 and a flowing direction of a refrigerant that flows in the superheat region SH4 of the rear-row heat exchanging unit 60 coincide with each other (that is, parallel flow).

In the indoor heat exchanger 25 according to one or more embodiments, the front-row heat exchanging unit 50 includes the gas-side flat multi-hole tubes 45*a* (the first gas-side flat multi-hole tubes) in which the gas-refrigerant ports 45*aa* are disposed at the first end (the end adjacent to the front-row first header 56). The rear-row heat exchanging unit 60 includes the gas-side flat multi-hole tubes 45*a* (the first gas-side flat multi-hole tubes) in which the gas-refrigerant ports 45*aa* are disposed at the first end (the end adjacent to the rear-row first header 66). In the indoor heat exchanger 25 according to one or more embodiments, the gas-side flat multi-hole tubes 45*a* are arranged in an upper portion of the front-row heat exchanging unit 50, and the gas-side flat multi-hole tubes 45*a* are arranged throughout in the rear-row heat exchanging unit 60 in the height direction thereof. Thus, on the airflow downstream side of the gas-side flat multi-hole tubes 45*a* (the first gas-side flat multi-hole tubes) of the front-row heat exchanging unit 50 in the air flow direction, only the gas-side flat multi-hole tubes 45*a* of the rear-row heat exchanging unit 60, in which the gas-refrigerant ports 45*aa* are disposed at the first end (the end adjacent to the rear-row first header 66), are arranged at a position identical to the position of the first gas-side flat multi-hole tubes (that is, at a height position identical to the height position of the first gas-side flat multi-hole tubes of the front-row heat exchanging unit 50) in the first direction (the flat-tube stacking direction dr2). No heat exchanging unit is arranged on the airflow downstream side in the air flow direction in the gas-side flat multi-hole tubes 45*a* (the first gas-side flat multi-hole tubes) of the rear-row heat exchanging unit 60.

In the indoor heat exchanger 25 according to one or more embodiments, the number of the gas-side flat multi-hole tubes 45*a* included in the heat exchanging unit (the front-row heat exchanging unit 50) at the front-most row on the airflow upstream side is less than the number of the gas-side flat multi-hole tubes 45*a* included in the heat exchanging unit (the rear-row heat exchanging unit 60) at the rear-most row on the airflow downstream side. Thus, a length He3 of the superheat region SH3 is less than a length He4 of the superheat region SH4 in the flat-tube stacking direction dr2 (refer to FIG. 15 and FIG. 16). Efficiency in the heat exchange between the indoor air flow AF and a refrigerant in the front-row heat exchanging unit 50 on the airflow upstream side is higher than efficiency in the heat exchange between the indoor air flow AF and the refrigerant in the rear-row heat exchanging unit 60 that is disposed on the airflow downstream side of front-row heat exchanging unit 50. Thus, a length Le3 of the superheat region SH3 is less than a length Le4 of the superheat region SH4 in the flat-tube extending direction dr1 (refer to FIG. 15 and FIG. 16). Thus, the area of the superheat region SH3 is less than the area of the superheat region SH4 (refer to FIG. 15 and FIG. 16). In other words, the entirety of the superheat region SH3 is included in the superheat region SH4 when viewed in the air flow direction dr3.

In other words, no two-phase or liquid region in which a two-phase refrigerant or a liquid-phase refrigerant flows in the flat multi-hole tubes 45 is arranged on the airflow downstream side of the superheat region SH3 in the air flow direction dr3. It is thus possible to suppress condensation performance of the indoor heat exchanger 25 from being degraded as a result of the indoor air flow AF that has exchanged heat with a high-temperature gas refrigerant exchanging heat with a low-temperature gas refrigerant.

In the indoor heat exchanger 25 during heating operation (when operation has entered a steady state), a region (subcool region SC1) in which a region in a subcooled state flows is formed at the flat-tube flow paths 451 in the second path P2 (in particular, the flat-tube flow paths 451 at the end adjacent to the front-row first header 56 in the second path P2 (for example the flat-tube flow paths 451 included in the second path P2 of the front-row first heat exchanging surface 51)). The other regions of the flat-tube flow paths 451 in the second path P2 than the subcool region SC1 are, mainly, two-phase regions in which a two-phase refrigerant flows. In addition, in the indoor heat exchanger 25, a region (subcool region SC2) in which a refrigerant in a subcooled state flows is formed at the flat-tube flow paths 451 in the third path P3 (in particular, the flat-tube flow paths 451 at the end adjacent to the front-row first header 56 in the third path P3 (for example, the flat-tube flow paths 451 included in the third path P3 of the front-row first heat exchanging surface 51)). The other regions of the flat-tube flow paths 451 in the third path P3 than the subcool region SC2 are, mainly, two-phase regions in which a two-phase refrigerant flows. In one or more embodiments, the liquid-side flat multi-hole tubes 45*b* are flat multi-hole tubes (first liquid-side flat multi-hole tubes) in which the liquid-refrigerant ports 45*ba* are disposed at the first end (the end adjacent to the front-row first header 56).

Here, the front-row heat exchanging unit 50 having the liquid-side flat multi-hole tubes 45*b* is a heat exchanging unit that is present on the airflow most upstream side in the air flow direction dr3. Therefore, no heat exchanging unit is arranged on the airflow upstream side of the liquid-side flat multi-hole tubes 45*b* in the air flow direction dr3. In other words, two-phase region in which a two-phase refrigerant flows or gas region in which a gas refrigerant flows in the flat multi-hole tubes 45 is not arranged on the airflow upstream side of the subcool regions SC1 and SC2 in the air flow direction dr3. It is thus possible here to suppress a refrigerant that has been once cooled to a predetermined degree of subcooling from being heated by air that has been heated on the airflow upstream side by the two-phase refrigerant or the gas refrigerant, which can suppress performance degradation. In the point of view of air, it is possible to suppress air that has been heated by the two-phase refrigerant or the gas refrigerant during heating operation from being cooled at the airflow downstream side by a refrigerant that has been subcooled, which can suppress degradation in heating performance.

(5) Features (5-1)

The indoor heat exchanger 25 according to the aforementioned embodiments includes a plurality of rows (two rows, here) of the heat exchanging units 50 and 60. In the indoor heat exchanger 25, the plurality of rows of the heat exchanging units 50 and 60 are arranged to be superposed with each other in the air flow direction dr3. In each of the heat exchanging units 50 and 60, a plurality of the flat multi-hole tubes 45 extending from the first end (the end adjacent to the first headers 56 and 66) toward the second end (the end adjacent to the second headers 57 and 67) and in which the refrigerant flows are arranged adjacent to each other in the flat-tube stacking direction dr2. The flat-tube stacking direction dr2 is an example of the first direction. In one or more embodiments, the flat-tube stacking direction dr2 is the vertical direction. The number of the gas-side flat multi-hole tubes 45*a*, in which the gas-refrigerant ports 45*aa* are disposed at one end thereof, included in the front-row heat exchanging unit 50 at the front-most row on the airflow upstream side is less than the number of the gas-side flat multi-hole tubes 45*a* included in the rear-row heat exchanging unit 60 at the rear-most row on the airflow downstream side.

In the indoor heat exchanger 25 according to one or more embodiments, for example, when a gas refrigerant flows into the gas-refrigerant ports 45*aa* of the gas-side flat multi-hole tubes 45*a* (when the indoor heat exchanger 25 is used as a condenser), a ratio of cooling of a high-temperature gas refrigerant performed at the rear-row heat exchanging unit 60 at the rear-most row is higher than that performed at the front-row heat exchanging unit 50 at the front-most row. The high-temperature gas refrigerant can exchange heat relatively efficiently even with high-temperature air (that has been heated on the airflow upstream side by a refrigerant) on the airflow downstream side. Thus, the indoor heat exchanger 25 as a whole can cause a refrigerant and air to efficiently exchange heat therebetween compared with that in a configuration differing from the aforementioned configuration.

From the point of view of air heated at the indoor heat exchanger 25 that functions as a condenser, the indoor heat exchanger 25 according to one or more embodiments enables the air that has been heated at the front-row heat exchanging unit 50 on the airflow upstream side to be further heated by the high-temperature gas refrigerant on the airflow downstream side. It is thus possible to achieve a high blow-out temperature and improve performance of the condenser.

(5-2)

In the indoor heat exchanger 25 according to the aforementioned embodiments, the two rows of the heat exchanging units 50 and 60 each include the gas-side flat multi-hole tubes 45*a*.

Highly flexible path arrangement can be achieved here by arranging the gas-side flat multi-hole tubes 45*a* at a plurality of rows of the heat exchanging units 50 and 60. Thus, performance is easily obtained when the indoor heat exchanger 25 functions as an evaporator and also when the indoor heat exchanger 25 functions as a condenser. The indoor heat exchanger 25 that is high in efficiency is thus easily achieved.

Due to such a configuration, performance degradation is easily suppressed, even when the degree of superheat in a refrigeration cycle is controlled to a relatively large value during cooling operation, in which the indoor heat exchanger 25 is used as an evaporator.

(5-3)

In the indoor heat exchanger 25 according to the aforementioned embodiments, the flat multi-hole tubes 45 include the liquid-side flat multi-hole tubes 45*b* that differ from the gas-side flat multi-hole tubes 45*a* and that each include the liquid-refrigerant port 45*ba* at one end thereof.

In the indoor heat exchanger 25 according to the aforementioned embodiments, the total number of the gas-side flat multi-hole tubes 45*a* is more than the total number of the liquid-side flat multi-hole tubes 45*b*.

Due to the number of the gas-side flat multi-hole tubes 45*a* being more than the number of the liquid-side flat multi-hole tubes 45*b*, when the indoor heat exchanger 25 is used as an evaporator, it is possible here to suppress performance degradation, even under an operational condition in which the degree of superheat is set to a large value.

(5-4)

In the indoor heat exchanger 25 according to the aforementioned embodiments, the gas-refrigerant port 45*aa* included in each of the gas-side flat multi-hole tubes 45*a* is disposed at the first end (the end adjacent to the first headers 56 and 66, here).

Here, regarding all of the plurality of rows of the gas-side flat multi-hole tubes 45*a*, the gas-refrigerant ports 45*aa* are disposed at the first end. Consequently, it is easy to reduce generation of the heat loss caused by the region (superheat region) of the gas-side flat multi-hole tubes 45*a*, in which a high-temperature gas refrigerant flows, and the region of the gas-side flat multi-hole tubes 45*a*, in which a refrigerant having a temperature lower than that of the high-temperature gas refrigerant being arranged adjacent to each other.

Here, in particular, the superheat region SH4 formed when the indoor heat exchanger 25 functions as a condenser is larger than the superheat region SH3 formed on the airflow upstream side thereof (the entirety of the superheat region SH3 is included in the superheat region SH4 when viewed in the air flow direction dr3). The air that has been once heated is thus easily suppressed from exchanging heat with a refrigerant (two-phase refrigerant or liquid refrigerant) having a relatively low temperature, which easily suppresses generation of the heat loss.

(5-5)

The indoor heat exchanger 25 according to the aforementioned embodiments includes the front-row second header 57 and the rear-row second header 67, which are an example of the merging portion that causes a refrigerant that has flowed out from a plurality of the gas-side flat multi-hole tubes 45*a* to merge together and to be guided into the liquid-side flat multi-hole tubes 45*b*.

(5-6)

The indoor heat exchanger 25 according to the aforementioned embodiments includes the front-row second header 57, which is an example of the header pipe that guides a refrigerant that has flowed out from the gas-side flat multi-hole tubes 45*a* into a plurality of the liquid-side flat multi-hole tubes 45*b*. The horizontal partition plate 571 that segregates the refrigerant that has flowed out from the gas-side flat multi-hole tubes 45*a* by the heat exchanging units 50 and 60 (that separates the front-row fifth space A5 and the front-row sixth space A6 from each other) is arranged in the front-row second header 57. The horizontal partition plate 571 is an example of the partition plate.

It is possible here to guide the refrigerants of the heat exchanging unit 50 and the heat exchanging unit 60, in other words, refrigerants in different states into respective different liquid-side flat multi-hole tubes 45*b*.

(5-7)

In the indoor heat exchanger 25 according to the aforementioned embodiments, the liquid-side flat multi-hole tubes 45*b* are the liquid-side flat multi-hole tubes in which the liquid-refrigerant ports 45*ba* are disposed at the first end (the end adjacent to the front-row first header 56). In other words, the liquid-side flat multi-hole tubes 45*b* are an example of the first liquid-side flat multi-hole tubes. No heat exchanging unit is arranged on the airflow upstream side of the liquid-side flat multi-hole tubes 45*b* in the air flow direction dr3.

Here, in a usage condenser, it is possible to suppress the refrigerant that has been once cooled from being heated by air that has been heated by a two-phase refrigerant or a gas refrigerant on the airflow upstream side, which can suppress performance degradation. From the point of view of air, during heating operation, it is possible to suppress the air that has been heated by the two-phase refrigerant or the gas refrigerant from being cooled by a subcooled refrigerant on the airflow downstream side, which can suppress degradation in heating performance.

(5-8)

In the indoor heat exchanger 25 according to the aforementioned embodiments, the indoor heat exchanger 25 includes the gas-side flat multi-hole tubes 45*a* (the first gas-side flat multi-hole tubes), in which the gas-refrigerant ports 45*aa* are disposed at the first end (the end adjacent to the front-row first header 56). The rear-row heat exchanging unit 60 includes the gas-side flat multi-hole tubes 45*a* (the first gas-side flat multi-hole tubes), in which the gas-refrigerant ports 45*aa* are disposed at the first end (the end adjacent to the rear-row first header 66). On the airflow downstream side of the gas-side flat multi-hole tubes 45*a* (the first gas-side flat multi-hole tubes) of the front-row heat exchanging unit 50 in the air flow direction, only the gas-side flat multi-hole tubes 45*a* of the rear-row heat exchanging unit 60, in which the gas-refrigerant ports 45*aa* are disposed at the first end (the end adjacent to the rear-row first header 66), are arranged at a position identical to the position of the first gas-side flat multi-hole tubes (that is, at a height position identical to the height position of the first gas-side flat multi-hole tubes of the front-row heat exchanging unit 50) in the first direction (the flat-tube stacking direction dr2). No heat exchanging unit is arranged on the airflow downstream side of the gas-side flat multi-hole tubes 45*a* (the first gas-side flat multi-hole tubes) of the rear-row heat exchanging unit 60 in the air flow direction.

It is possible here to suppress condensation performance of the indoor heat exchanger 25 from being degraded as a result of the indoor air flow AF that has exchanged heat with a high-temperature gas refrigerant exchanging heat with a gas refrigerant that has a relatively low temperature during the condenser-use period of the indoor heat exchanger 25.

(5-9)

In the indoor heat exchanger 25 according to the aforementioned embodiments, the gas-side flat multi-hole tubes 45*a* each include the superheat regions SH3 and SH4, in which a gas refrigerant flows, in the vicinity of the gas-refrigerant ports 45*aa* thereof. The superheat regions SH3 and SH4 are an example of the gas region. No two-phase or liquid region is arranged, in which a two-phase refrigerant or a liquid-phase refrigerant flows in the flat multi-hole tubes 45, is arranged on the airflow downstream side of the superheat regions SH3 and SH4 in the air flow direction dr3. Here, the superheat region SH4 is arranged on the airflow downstream side of the superheat region SH3 in the air flow direction dr3. No heat exchanging unit is arranged on the airflow downstream side of the superheat region SH4 in the air flow direction dr3.

Due to such a configuration, generation of the heat loss is easily reduced.

(5-10)

The air conditioner 100 as an example of the refrigeration apparatus according to the aforementioned embodiments includes the indoor heat exchanger 25 and a fan device that supplies air to the indoor heat exchanger 25. The indoor fan 28 is an example of the fan device. A plurality of rows of the heat exchanging units 50 and 60 of the indoor heat exchanger 25 are arranged in the air flow direction dr3 generated by the indoor fan 28 as an example of the fan device.

(6) Modification

The aforementioned embodiments can be modified, as appropriate, as presented in the following modifications. Each of the modifications may be employed by being combined with other modifications within a range that does not cause contradiction.

(6-1) Modification 1A

In one or more embodiments, the front-row fourth space A4 and the front-row fifth space A5 are connected to each other by the return pipe 58, and the front-row sixth space A6 and the rear-row second header space Sb2 are connected to each other by the connection pipe 70. The first liquid-refrigerant pipe 22*a* and the second liquid-refrigerant pipe 22*b* are connected to the front-row second space A2 and the front-row third space A3, respectively.

Figure 17:
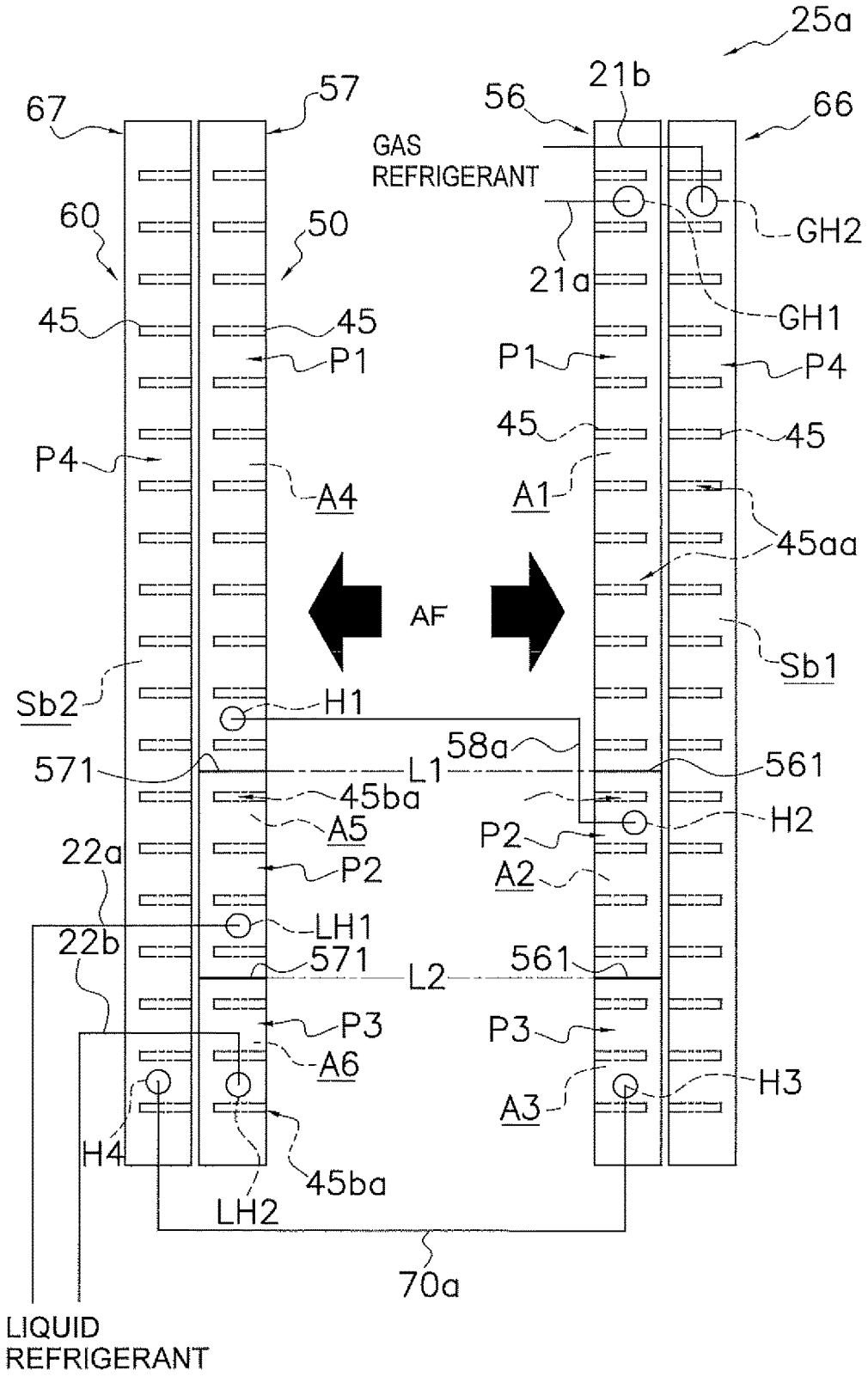
FIG. 17 is a schematic view roughly illustrating refrigerant paths formed in an indoor heat exchanger according to a modification 1A.

As an alternative to the above, as in an indoor heat exchanger 25*a* in FIG. 17, the front-row fourth space A4 of the front-row second header 57 and the front-row second space A2 of the front-row first header 56 may be connected to each other by a connection pipe 58*a*, and the front-row third space A3 of the front-row first header 56 and the rear-row second header space Sb2 may be connected to each other by a connection pipe 70*a*. The first liquid-refrigerant pipe 22*a* and the second liquid-refrigerant pipe 22*b* are connected to the front-row fifth space A5 of the front-row second header 57 and the front-row sixth space A6 of the front-row second header 57, respectively.

Figure 18:
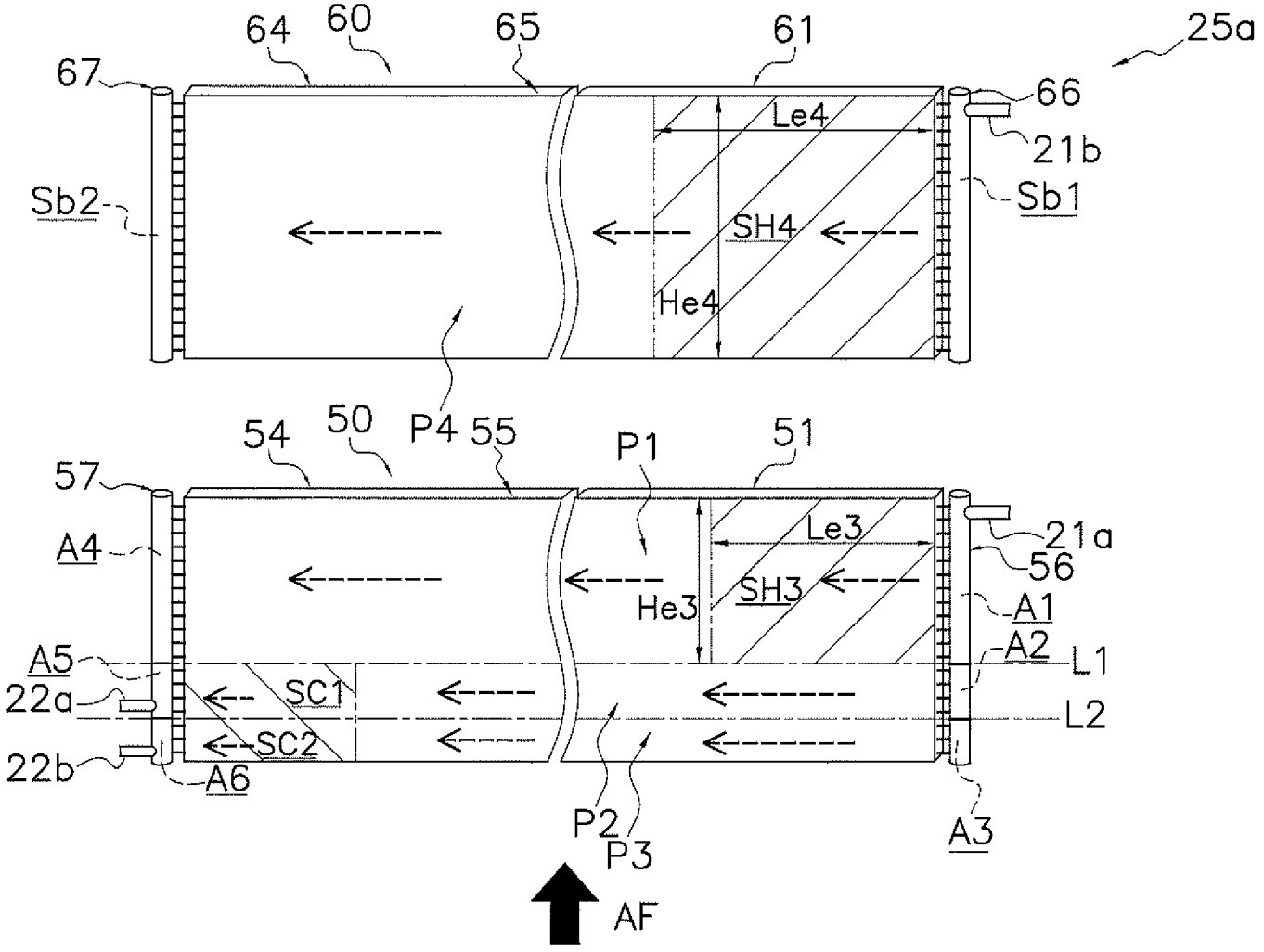
FIG. 18 is a schematic view roughly illustrating a refrigerant flow during heating operation in a front-row heat exchanging unit and a rear-row heat exchanging unit of the indoor heat exchanger in FIG. 17.

Due to the aforementioned connection, a direction in which a refrigerant flows is an identical direction in all the flat multi-hole tubes 45 during cooling operation and during heating operation. For example, FIG. 18 illustrates a refrigerant flow in the flat multi-hole tubes 45 of the first path P1 to the fourth path P4 during heating operation (in FIG. 18, illustration of the connection pipe 58*a* and the connection pipe 70*a* is omitted). As a result, the superheat regions SH3 and SH4 are arranged at the end adjacent to the first headers 56 and 66, and the subcool regions SC1 and SC2 are arranged at the end adjacent to the second headers 57 and 67. Consequently, the superheat regions SH3 and SH4 are arranged away from the subcool regions SC1 and SC2 (not adjacent to each other), and thus, generation of the heat loss is particularly suppressed.

(6-2) Modification 1B

In the aforementioned embodiments, the front-row heat exchanging unit 50 includes the gas-side flat multi-hole tubes 45*a* and the liquid-side flat multi-hole tubes 45*b* while the rear-row heat exchanging unit 60 includes only the gas-side flat multi-hole tubes 45*a*. The form of the heat exchanger according to one or more embodiments of the present invention is however not limited by the configuration of the aforementioned embodiments.

Figure 19:
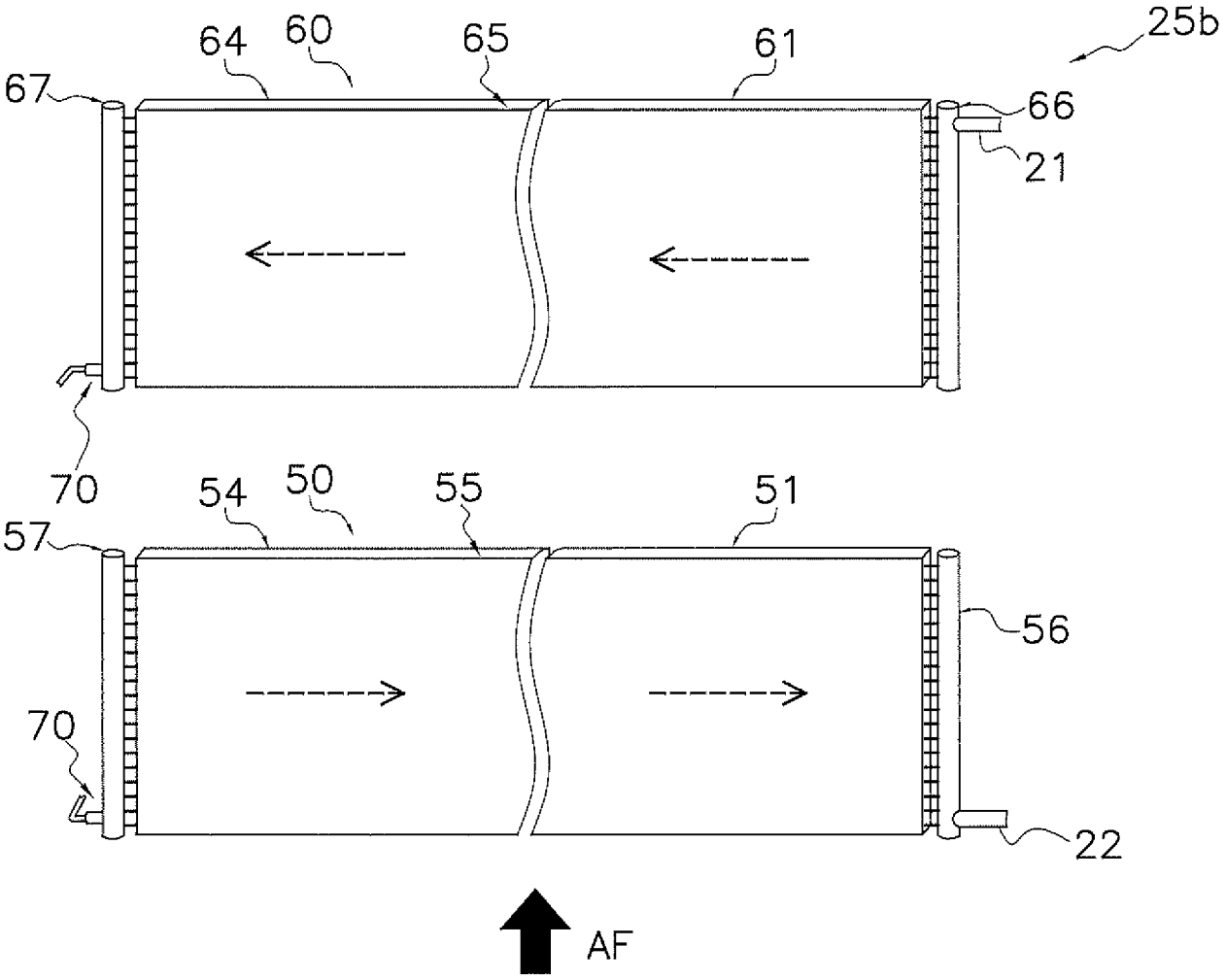
FIG. 19 is a schematic view roughly illustrating a refrigerant flow during heating operation in a front-row heat exchanging unit and a rear-row heat exchanging unit of an indoor heat exchanger according to a modification 1B.

For example, so that a refrigerant flows as illustrated in FIG. 19 during heating operation in the indoor heat exchanger, only the liquid-side flat multi-hole tubes 45*b* may be arranged in the front-row heat exchanging unit 50, and only the gas-side flat multi-hole tubes 45*a* may be arranged in the rear-row heat exchanging unit 60, as is in an indoor heat exchanger 25*b*.

Due to such a configuration in which the number of the gas-side flat multi-hole tubes 45*a* included in the front-row heat exchanging unit 50 is less than the number of the gas-side flat multi-hole tubes 45*a* included in the rear-row heat exchanging unit 60, it is possible to cause a refrigerant and air to efficiently exchange heat therebetween when the indoor heat exchanger 25*b* is used as a condenser. Moreover, it is possible to improve the performance of the condenser and achieve a high blow-out temperature from the indoor unit 20 during heating operation.

(6-3) Modification 1C

In the aforementioned embodiments, the front-row first space A1, the front-row second space A2, and the front-row third space A3 are configured to be aligned in this order from the upper side toward the lower side in the front-row first header 56. In addition, in the aforementioned embodiments, the front-row fourth space A4, the front-row fifth space A5, and the front-row sixth space A6 are configured to be aligned in this order from the upper side toward the lower side in the front-row second header 57. In other words, the paths formed in the front-row heat exchanging unit 50 are arranged such that the first path P1 is at the uppermost tier, the second path P2 is at an intermediate tier, and the third path P3 is at the lowermost tier.

The arrangement of the spaces A1, A2, and A3 in the front-row first header 56, the arrangement of the spaces A4, A5, and A6 in the front-row second header 57, and the arrangement of the paths P1, P2, and P3 in the front-row heat exchanging unit 50 are, however, not limited to those according to the aforementioned embodiments. These arrangements may be changed, as appropriate, within a range in which an effect similar to a portion or all of the effects of the aforementioned embodiments is exerted.

For example, the front-row first space A1, the front-row second space A2, and the front-row third space A3 may be configured to be aligned in this order from the lower side toward the upper side in the front-row first header 56. The front-row fourth space A4, the front-row fifth space A5, and the front-row sixth space A6 may be configured to be aligned in this order from the lower side toward the upper side in the front-row second header 57. As a result, the paths formed in the front-row heat exchanging unit 50 may be arranged such that the first path P1 is at the lowermost tier, the second path P2 is at the intermediate tier, and the third path P3 is at the uppermost tier.

In other words, in the aforementioned embodiments, the subcool regions (SC1, SC2) are positioned, in the front-row heat exchanging unit 50, at a portion (lower-tier portion) at which the air velocity of the indoor air flow AF that passes therethrough is lower than that at the other portions. The subcool regions are, however, not limited by such an arrangement and may be formed, in the front-row heat exchanging unit 50, at a portion at which the air velocity of the indoor air flow AF that passes therethrough is identical to that at the other portions or higher than that at the other portions.

In addition, for example, the second path P2, the first path P1, and the third path P3 may be formed to be arranged at the uppermost tier, the intermediate tier, and the lowermost tier, respectively.

When the positions of the paths are changed, the formation position (the connection position of the pipes) of the openings (GH1, GH2, LH1, LH2, and H1-H4) that communicate with the paths may be changed, as appropriate, in a corresponding manner.

The arrangement of the paths may, however, be designed so as to satisfy the features (for example, the features in (5-7), (5-8), and (5-9)) of the aforementioned embodiments.

(6-4) Modification 1D

In the aforementioned embodiments, the first path P1, the second path P2, and the third path P3 include twelve of the flat multi-hole tubes 45 (the gas-side flat multi-hole tubes 45*a*), four of the flat multi-hole tubes 45 (the liquid-side flat multi-hole tubes 45*b*), and three of the flat multi-hole tubes 45 (the liquid-side flat multi-hole tubes 45*b*), respectively. The number of the flat multi-hole tubes 45 included in the paths P1 to P3 presented in the aforementioned embodiments, however, does not limit the present invention and may be determined, as appropriate, in accordance with design specifications and the like.

The number and the arrangement of each of the gas-side flat multi-hole tubes 45*a* and the liquid-side flat multi-hole tubes 45*b* may, however, be designed such that the number of the gas-side flat multi-hole tubes 45*a* included in the heat exchanging unit at the front-most row on the airflow upstream side is less than the number of the gas-side flat multi-hole tubes 45*a* included in the heat exchanging unit at the rear-most row on the airflow downstream side. In addition, the number and the arrangement of each of the gas-side flat multi-hole tubes 45*a* and the liquid-side flat multi-hole tubes 45*b* may be designed so as to satisfy the features (for example, the features in (5-1) to (5-3) and (5-7) to (5-9)) of the aforementioned embodiments.

(6-5) Modification 1E

The aforementioned embodiments in which, in an installed state, the flat-tube extending direction dr1 of the indoor heat exchanger 25 is the horizontal direction while the flat-tube stacking direction dr2 is the vertical direction have been described. The flat-tube extending direction dr1 and the flat-tube stacking direction dr2 are, however, not limited to the aforementioned directions. For example, the indoor heat exchanger 25 may be configured and arranged such that, in an installed state, the flat-tube extending direction dr1 is the vertical direction while the flat-tube stacking direction dr2 is the horizontal direction.

In addition, the aforementioned embodiments in which the air flow direction dr3 is the horizontal direction have been described. The air flow direction dr3 is, however, not limited thereto and can be changed, as appropriate, depending on the configuration and the installation mode of the indoor heat exchanger 25.

(6-6) Modification 1F

In the aforementioned embodiments, the front-row second header 57 and the rear-row second header 67 are formed separately from each other, and, similarly, the front-row first header 56 and the rear-row first header 66 are formed separately from each other. However, the configuration is not limited thereto and a plurality of header collection pipes (for example, the front-row second header 57 and the rear-row second header 67, or the front-row first header 56 and the rear-row first header 66) arranged adjacent to each other in the indoor heat exchanger 25 may be configured to be integral with each other. In other words, the plurality of header collection tubes arranged adjacent to each other may be constituted by a single header collection tube, and an internal space of such a header collection tube may be divided in the longitudinal direction (for example, the vertical direction) of the header collection tube or in a direction (for example, horizontal direction) intersecting the longitudinal direction into spaces, similarly to the aforementioned embodiments, by a partition plate. Such a configuration enables a reduction in the number of the header pipes.

(6-7) Modification 1G

In the aforementioned embodiments, the indoor heat exchanger 25 is arranged so as to surround the indoor fan 28. The indoor heat exchanger 25 is, however, not necessarily arranged so as to surround the indoor fan 28. The shape and the arrangement of the indoor heat exchanger 25 can be changed, as appropriate, provided that a heat exchange between the indoor air flow AF and a refrigerant is enabled.

(6-8) Modification 1H

In the aforementioned embodiments, the indoor heat exchanger 25 included in the indoor unit 20 of a ceiling embedded type has been described as an example of the heat exchanger according to one or more embodiments of the present invention. The heat exchanger according to one or more embodiments of the present invention is, however, not limited to the indoor heat exchanger 25 included in the indoor unit 20 of the ceiling embedded type.

For example, the indoor unit of the air conditioner may be indoor units of various types other than the ceiling embedded type, such as a ceiling suspended type fixed to the ceiling surface CL, a wall mounted type installed on a side wall, a duct type, and a floor mounted type. In addition, the indoor unit may be an indoor unit of a type in which air is blown out in four directions, like the indoor unit 20 according to the aforementioned embodiments, and may be, for example, an indoor unit that blows out air in two directions or one direction.

Figure 32:
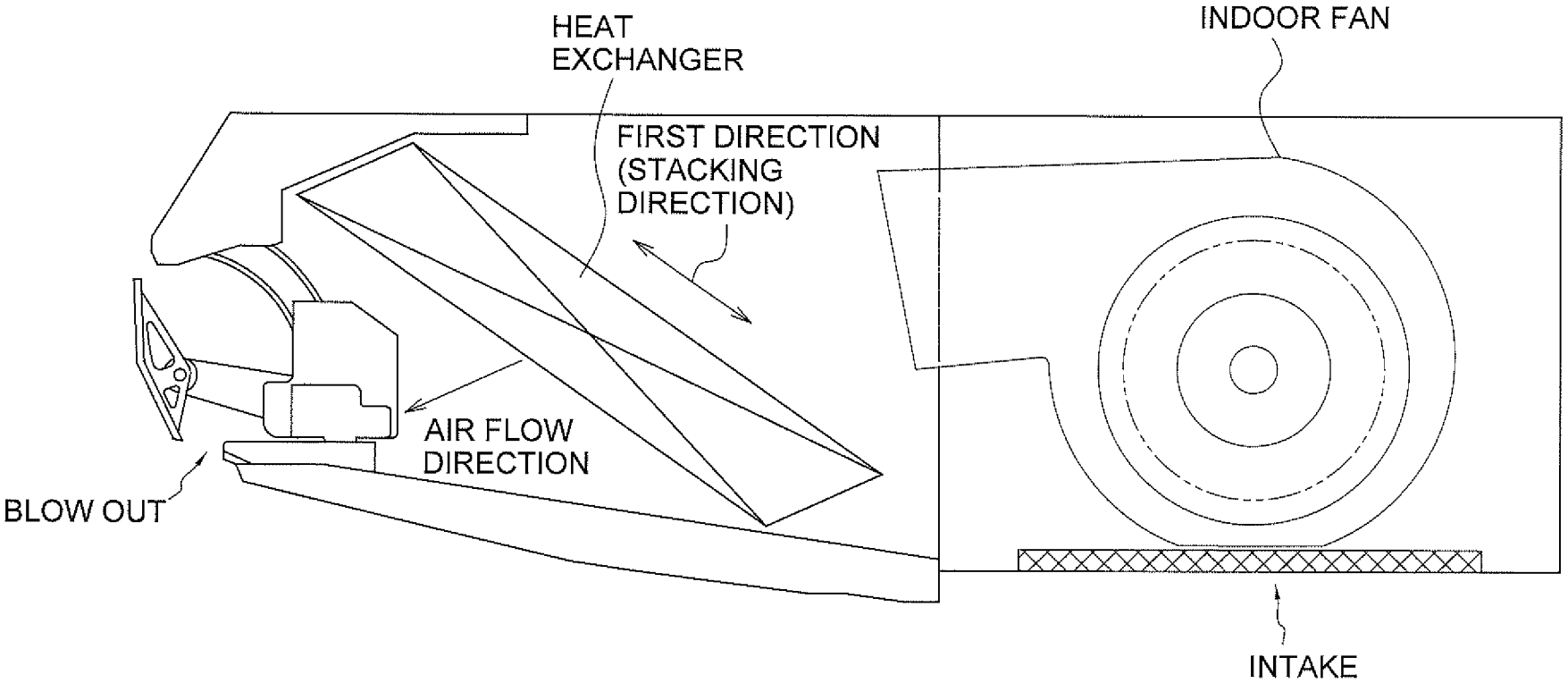
FIG. 32 is a schematic view roughly illustrating an example of the shape of an indoor heat exchanger according to one or more embodiments of the present invention.
Figure 33:
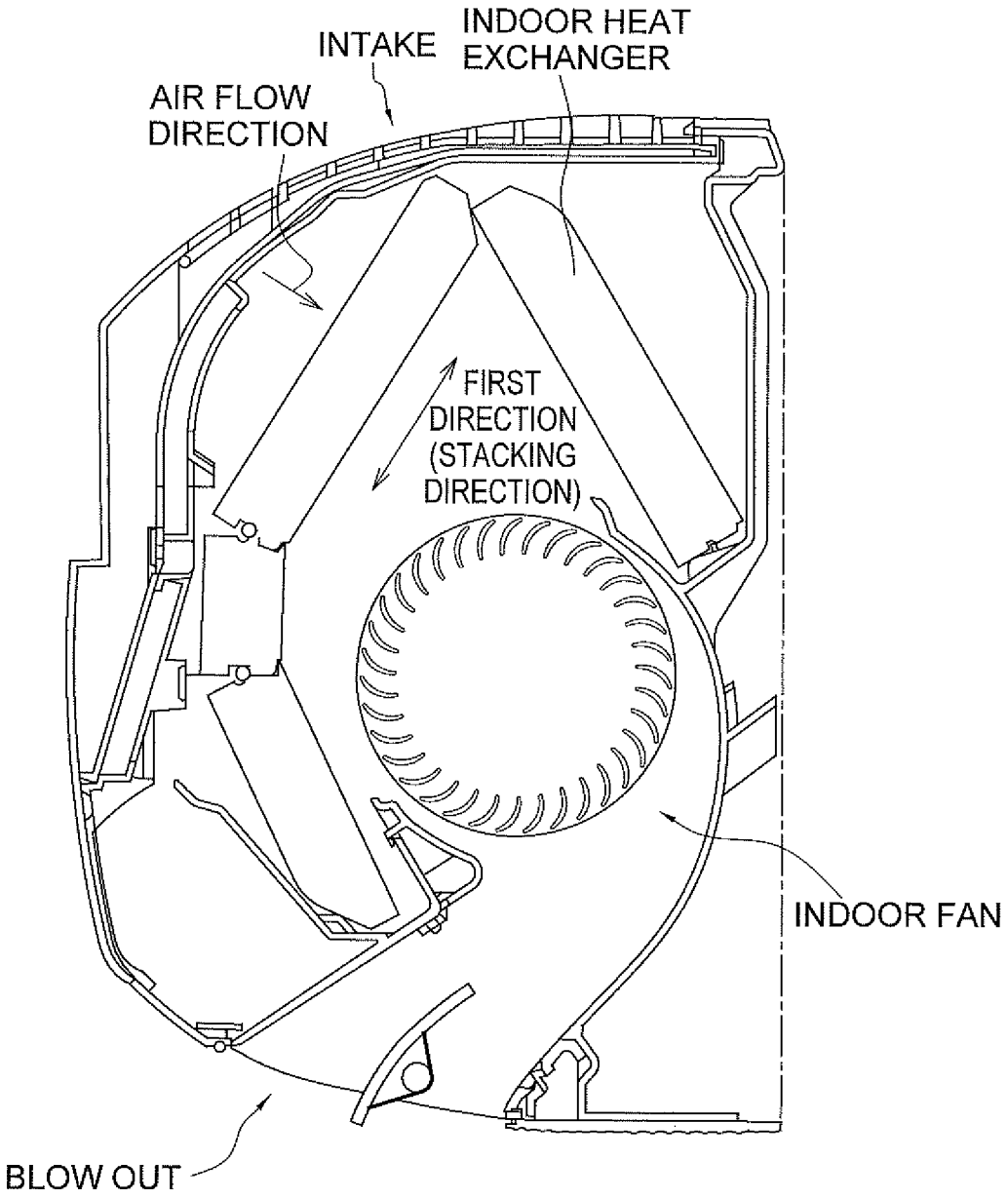
FIG. 33 is a schematic view roughly illustrating an example of the shape of an indoor heat exchanger according to one or more embodiments of the present invention.

The shape of the heat exchanging unit of the indoor heat exchanger is not limited to a shape such as that of the front-row heat exchanging unit 50 or the rear-row heat exchanging unit 60. For example, the indoor heat exchanger may include, as illustrated in FIG. 32, a plurality of rows of flat-plate shaped heat exchanging units arranged adjacent to each other and in which the stacking direction of flat multi-hole tubes inclines with respect to the vertical direction (the indoor unit in FIG. 32 is of a ceiling suspended type). In addition, for example, the indoor heat exchanger may include, as illustrated in FIG. 33, a plurality of rows of heat exchanging units that are formed into a V-shape in side view so as to cover a fan (for example, a cross-flow fan) (the indoor unit in FIG. 33 is of a wall mount type). The shape and the like of the indoor heat exchanger may be selected, as appropriate, depending on the type and the like of the indoor unit.

(6-9) Modification 1I

The aforementioned embodiments have been described by presenting an example in which the indoor heat exchanger 25 is applied to the air conditioner 100 as an example of the refrigeration apparatus (refrigeration cycle apparatus).

Figure 34:
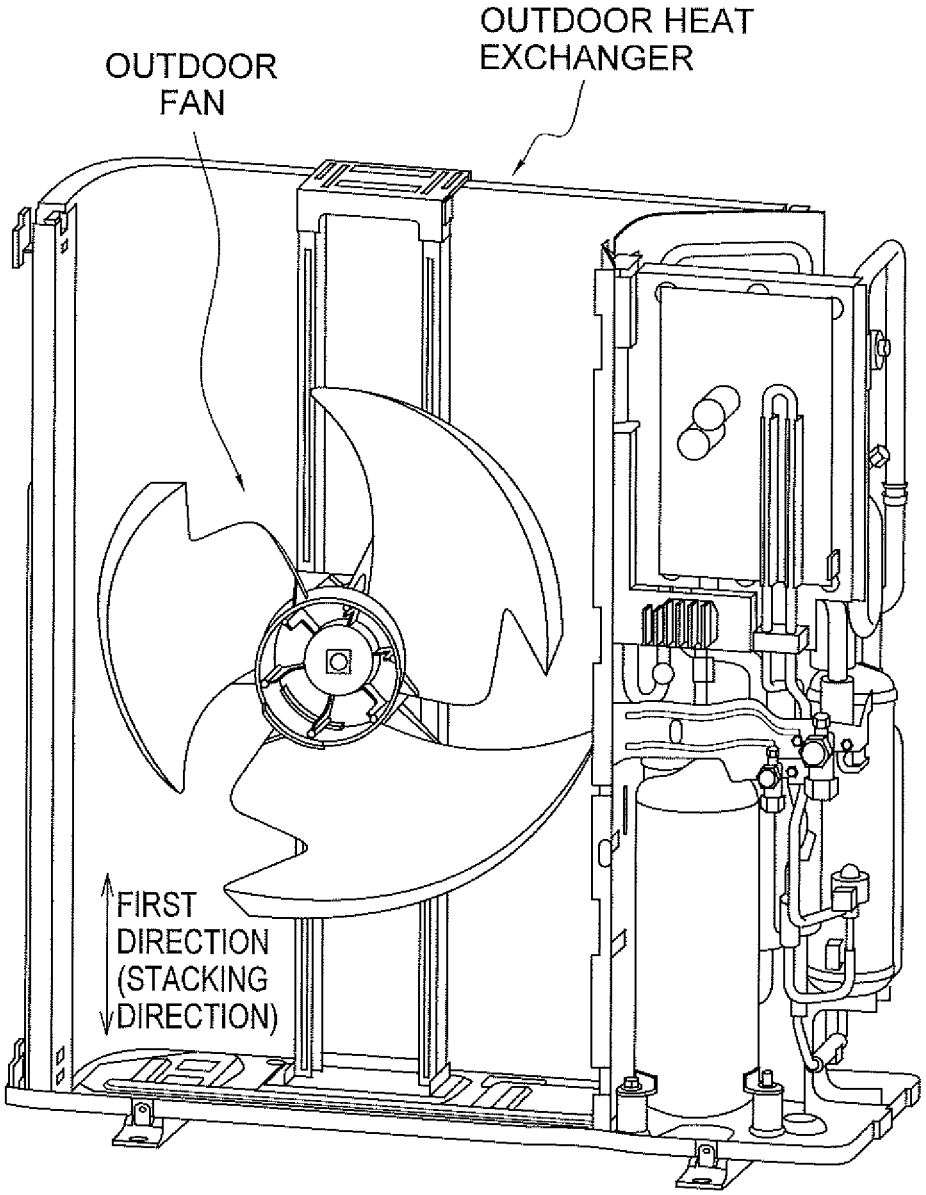
FIG. 34 is a schematic view roughly illustrating an example of the shape of an outdoor heat exchanger according to one or more embodiments of the present invention.

The features of the heat exchanger according to one or more embodiments of the present invention are, however, widely applicable to heat exchangers in which heat is exchanged between air and a refrigerant. For example, the features of the heat exchanger according to one or more embodiments of the present invention may be applied to the outdoor heat exchanger 13 (for example, a heat exchanger having a substantially L-shape, such as that in FIG. 34, and including a plurality of rows of heat exchanging units arranged adjacent to each other in a first direction, the plurality of rows of the heat exchanging units being arranged to be superposed with each other in an air flow direction) of the air conditioner 100.

The refrigeration apparatus to which the heat exchanger according to one or more embodiments of the present invention is applied is not limited to the air conditioner 100. For example, the refrigeration apparatus may be a refrigeration apparatus for low-temperature application, for example a refrigeration apparatus for a freezing/refrigerating container, a warehouse, a showcase, or the like, or may be an apparatus, such as a hot water supply apparatus, a heat-pump chiller, or the like.

(6-10) Modification 1J

In the aforementioned embodiments, the air conditioner 100 is an apparatus configured to execute both the cooling operation and the heating operation. The refrigeration apparatus according to one or more embodiments of the present invention is, however, not limited thereto and may be an air conditioner that performs one of the heating operation and the cooling operation. In other words, the heat exchanger according to one or more embodiments of the present invention may not be a heat exchanger that functions as a condenser and an evaporator. The heat exchanger according to one or more embodiments of the present invention may be a heat exchanger that functions only as a condenser in an air conditioner or a heat exchanger that functions only as an evaporator in an air conditioner. In this case, the flow-direction switching mechanism 12 may not be disposed in the refrigerant circuit RC.

In the air conditioner 100, when the indoor heat exchanger 25 functions only as a condenser or only as an evaporator, the gas-refrigerant ports 45*aa* function as either of inlets and outlets for a gas refrigerant, and the liquid-refrigerant ports 45*ba* function as one of inlets and outlets for a liquid refrigerant. Here, the gas-refrigerant ports 45*aa* are referred to as gas-refrigerant ports even when used only as one of the inlets and the outlets for a gas refrigerant in the indoor heat exchanger 25, and the liquid-refrigerant ports 45*ba* are referred to as liquid-refrigerant ports even when used only as either of the inlets and the outlets for a liquid refrigerant.

An indoor heat exchanger 125 according to one or more embodiments of the present invention will be described. A refrigeration apparatus in which the indoor heat exchanger 125 has a configuration identical to the configuration of the air conditioner 100 of the embodiments described above. Thus, description other than of the indoor heat exchanger 125 is omitted.

(1) Indoor Heat Exchanger (1-1) Configuration of Indoor Heat Exchanger

Figure 20:
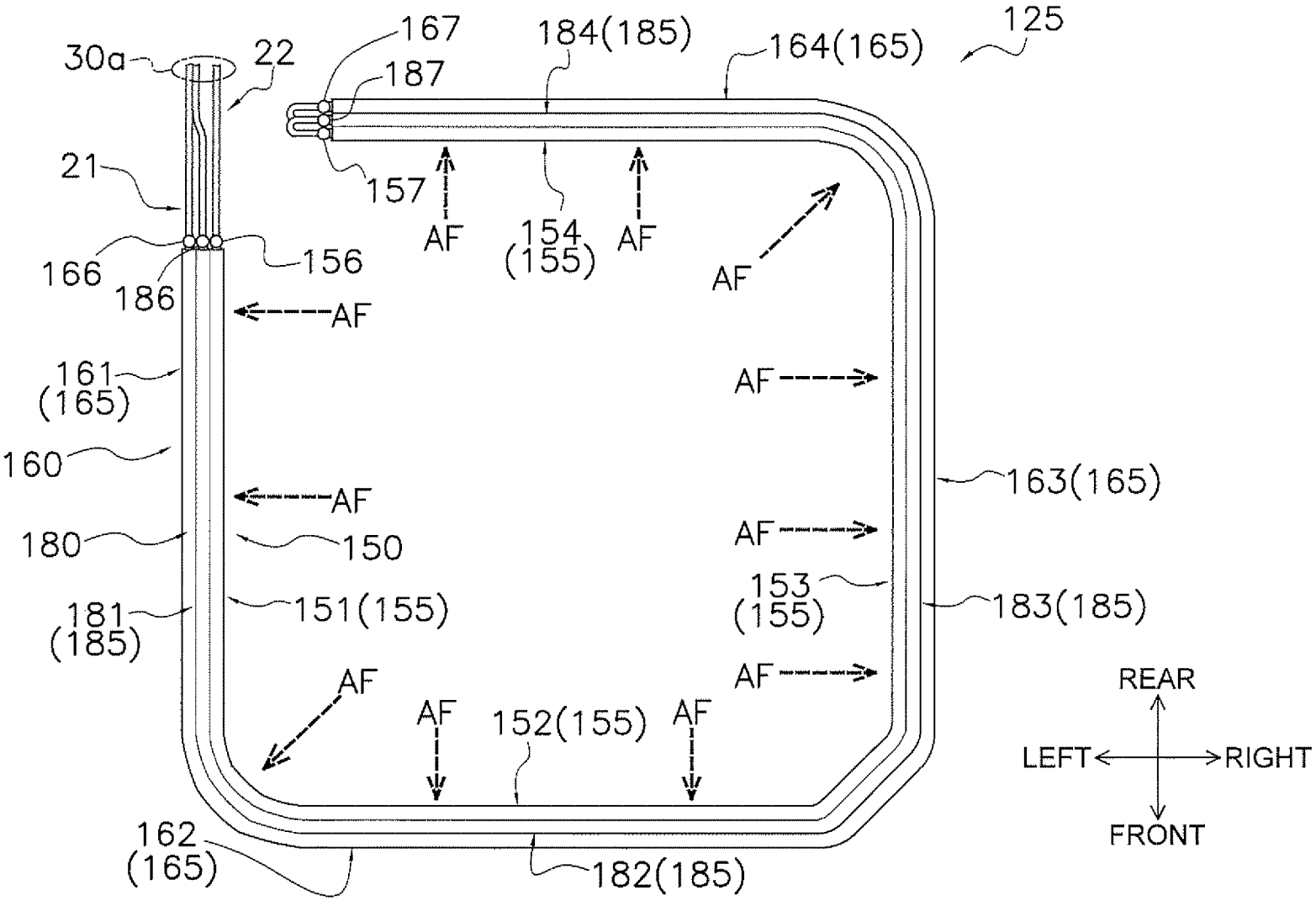
FIG. 20 is a schematic view roughly illustrating an indoor heat exchanger, as viewed in a stacking direction of flat tubes, according to one or more embodiments of the present invention.
Figure 21:
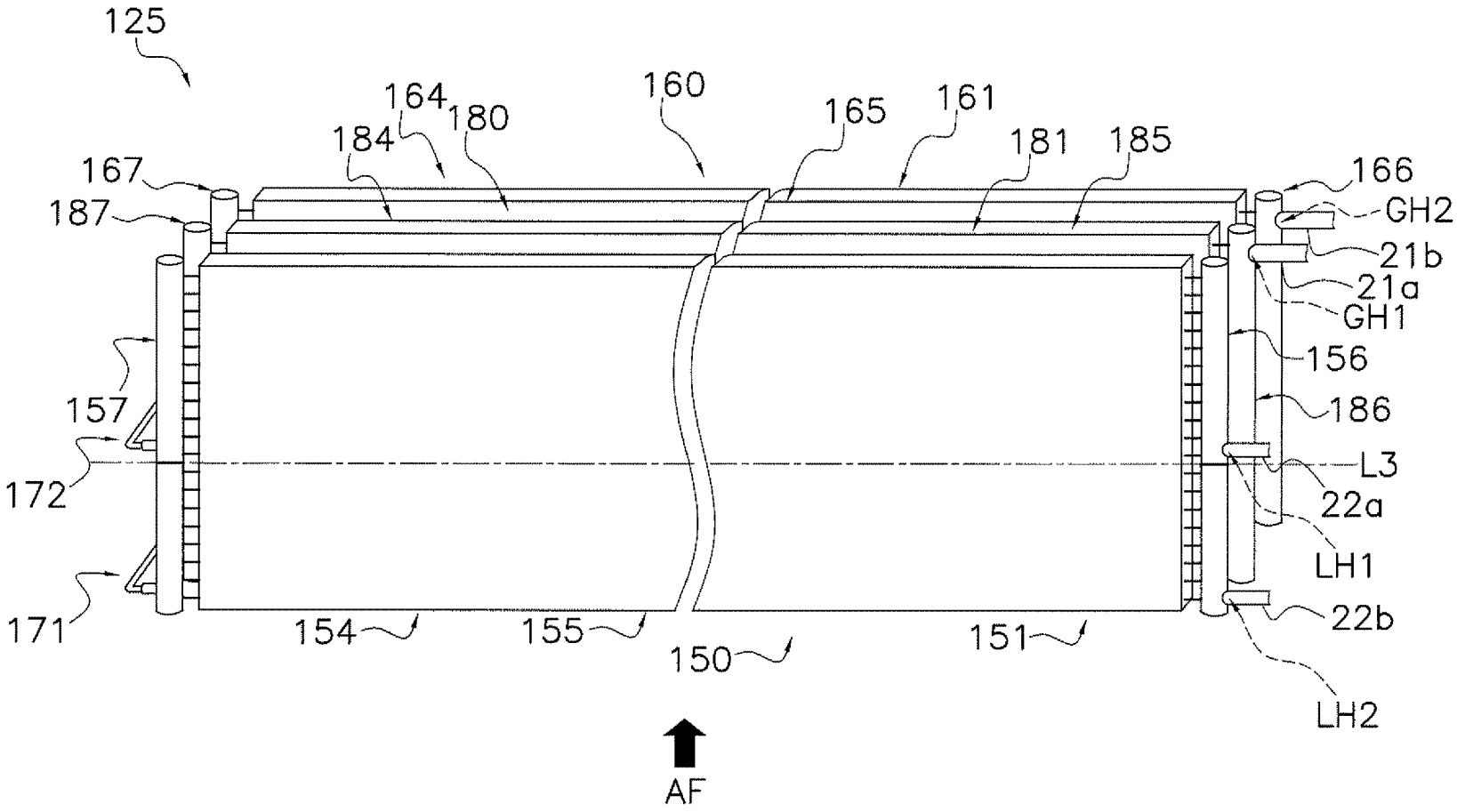
FIG. 21 is a schematic view roughly illustrating a configuration of the indoor heat exchanger in FIG. 20.
Figure 22:
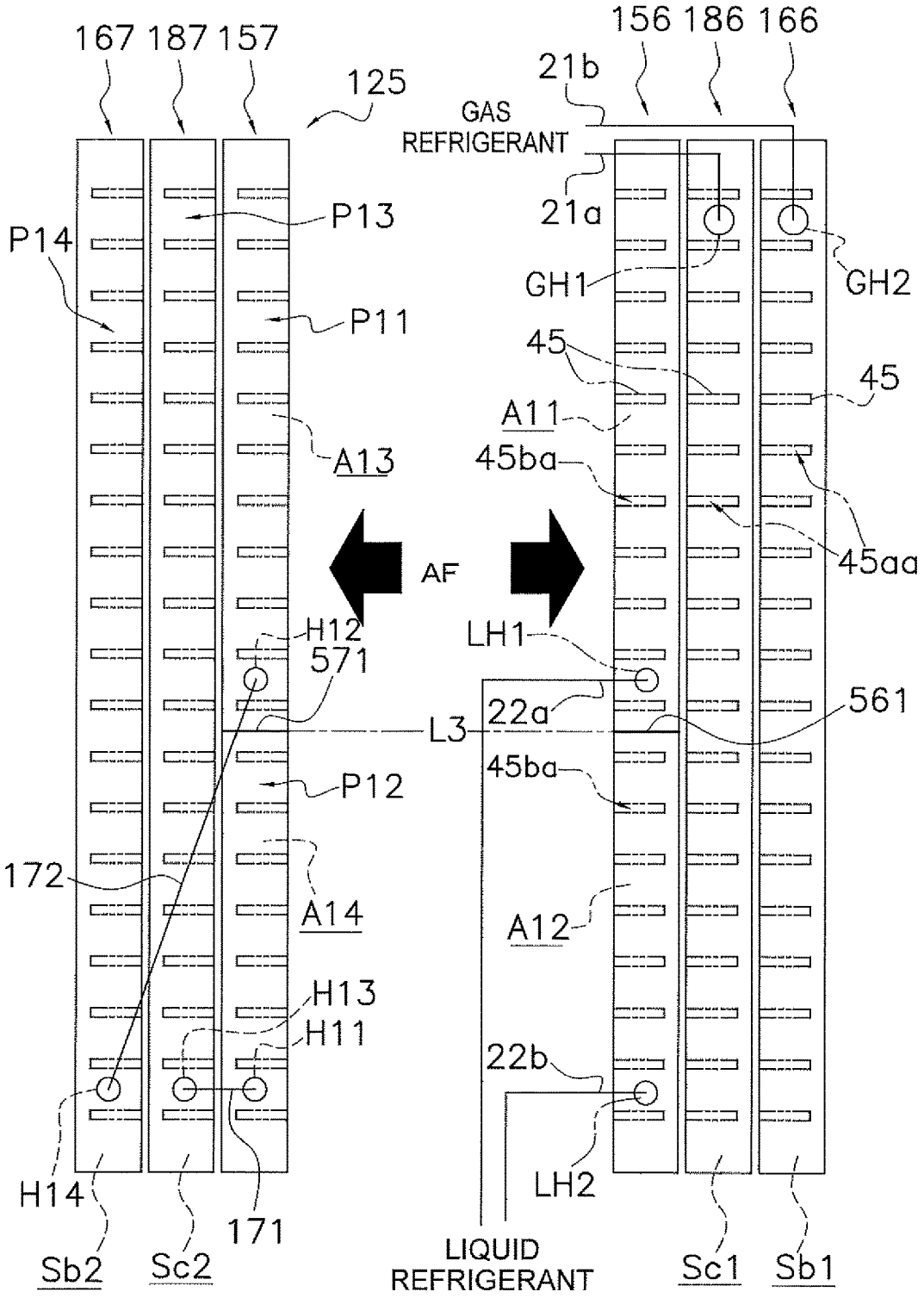
FIG. 22 is a schematic view roughly illustrating refrigerant paths formed in the indoor heat exchanger in FIG. 20.

FIG. 20 is a schematic view roughly illustrating the indoor heat exchanger 125 as viewed in the flat-tube stacking direction dr2 of the flat multi-hole tubes 45. FIG. 21 is a schematic view roughly illustrating the indoor heat exchanger 125. FIG. 22 is a schematic view roughly illustrating refrigerant paths formed in the indoor heat exchanger 125.

The indoor heat exchanger 125 includes heat exchanging units 150, 160, 180 (a front-row heat exchanging unit 150, an intermediate-row heat exchanging unit 180, and a rear-row heat exchanging unit 160) that are arranged in three rows so as to be superposed with each other in the air flow direction dr3. In other words, the indoor heat exchanger 125 differs from the indoor heat exchanger 25 in terms of the indoor heat exchanger 25 including the two rows of the front-row heat exchanging units 50 and the rear-row heat exchanging unit 60 while the indoor heat exchanger 125 including the intermediate-row heat exchanging unit 180 arranged between the front-row heat exchanging unit 150 and the rear-row heat exchanging unit 160. The configurations of the front-row heat exchanging unit 150 and the rear-row heat exchanging unit 160 partly differ from those of the front-row heat exchanging unit 50 and the rear-row heat exchanging unit 60 in terms of, for example, the intermediate-row heat exchanging unit 180 being arranged between the front-row heat exchanging unit 150 and the rear-row heat exchanging unit 160 and in terms of path arrangement and the like and. However, the configurations of the front-row heat exchanging unit 150 and the rear-row heat exchanging unit 160 and those of the front-row heat exchanging unit 50 and the rear-row heat exchanging unit 60 have much in common. Thus, differences between the features of the front-row heat exchanging unit 150 and the rear-row heat exchanging unit 160 and the features of the front-row heat exchanging unit 50 and the rear-row heat exchanging unit 60 will be mainly described, and description of the identical features is basically omitted. The intermediate-row heat exchanging unit 180 has a lot of features identical to those of the front-row heat exchanging unit 50 and the rear-row heat exchanging unit 60. Thus, to avoid duplicated description, description of the features identical to those of the front-row heat exchanging unit 50 and the rear-row heat exchanging unit 60 is omitted.

(1-1-1) Refrigerant Port for Indoor Heat Exchanger

A refrigerant flows into or flows out from the indoor heat exchanger 125 via the gas-side ports GH and the liquid-side ports LH.

Similarly to the indoor heat exchanger 25, the indoor heat exchanger 125 includes, as the gas-side ports GH, the first gas-side port GH1 and the second gas-side port GH2 (refer to FIG. 21). In addition, the indoor heat exchanger 125 includes, as the liquid-side ports LH, the first liquid-side port LH1 and the second liquid-side port LH2 (refer to FIG. 21). The first gas-side port GH1 and the second gas-side port GH2 are arranged above the first liquid-side port LH1 and the second liquid-side port LH2 (refer to FIG. 21).

(1-1-2) Configuration of Indoor Heat Exchanger

The indoor heat exchanger 125 includes, mainly, a plurality of (three, here) heat exchanging units (the front-row heat exchanging unit 150, the intermediate-row heat exchanging unit 180, and the rear-row heat exchanging unit 160), a front-row first header 156, a front-row second header 157, an intermediate-row first header 186, an intermediate-row second header 187, a rear-row first header 166, a rear-row second header 167, and connection pipes 171 and 172. Configurations of these components will be described below.

For convenience of description, a front row configuration (the front-row heat exchanging unit 150, the front-row first header 156, and the front-row second header 157) on the airflow upstream side in the air flow direction dr3, a rear row configuration (the rear-row heat exchanging unit 160, the rear-row first header 166, and the rear-row second header 167) on the airflow downstream side in the air flow direction dr3, an intermediate row configuration (the intermediate-row heat exchanging unit 180, the intermediate-row first header 186, and the intermediate-row second header 187) arranged between the front row configuration and the rear row configuration, and the connection pipes 171 and 172 will be separately described here. As described above, descriptions of the features identical to those of the embodiments described above are omitted.

(1-1-2-1) Front Row Configuration

Figure 23:
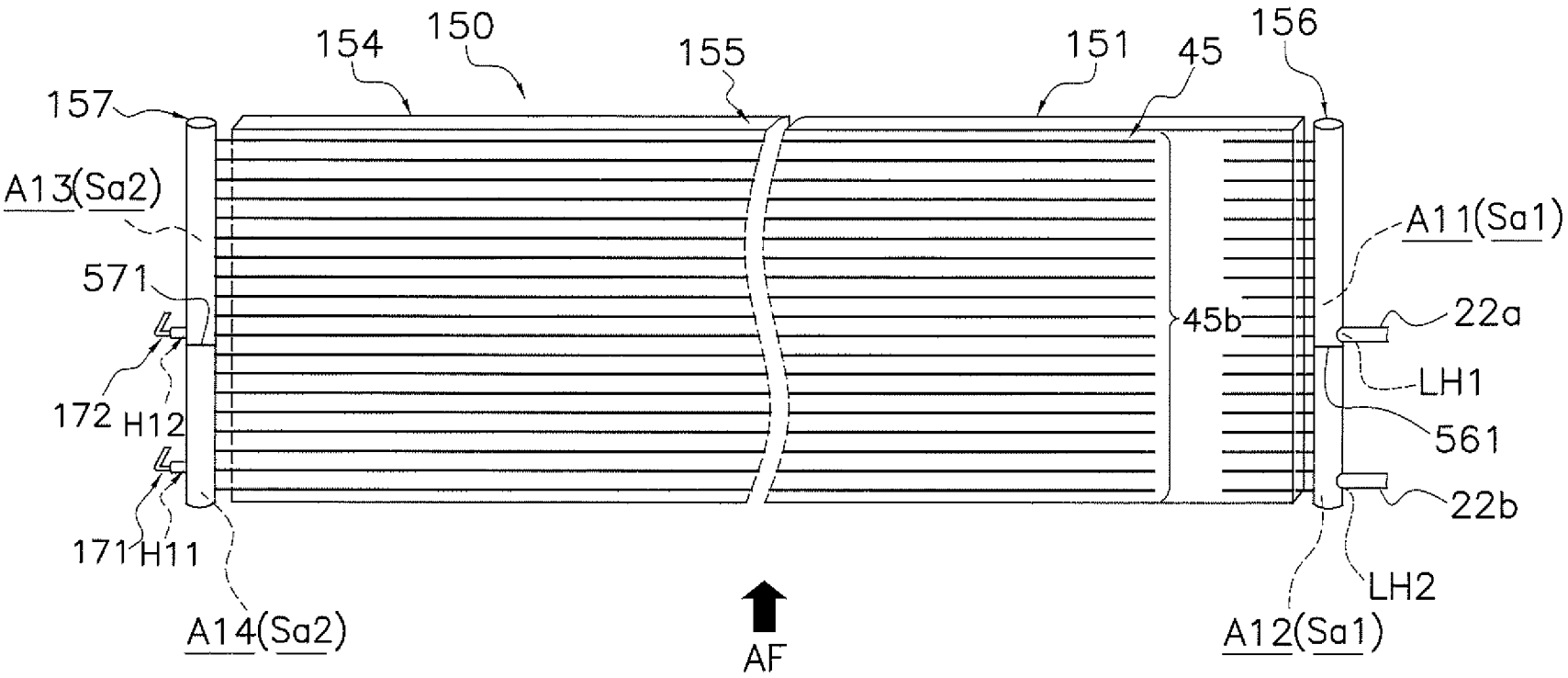
FIG. 23 is a schematic view roughly illustrating a front row configuration of the indoor heat exchanger in FIG. 20.

FIG. 23 is a schematic view roughly illustrating the front row configuration including the front-row heat exchanging unit 150, the front-row first header 156, and the front-row second header 157.

(1-1-2-1-1) Front-Row Heat Exchanging Unit

The front-row heat exchanging unit 150 includes a front-row heat exchanging surface 155 as the heat exchanging surface 40. The front-row heat exchanging surface 155 includes a front-row first heat exchanging surface 151, a front-row second heat exchanging surface 152, a front-row third heat exchanging surface 153, and a front-row fourth heat exchanging surface 154. The front-row heat exchanging surface 155, the front-row first heat exchanging surface 151, the front-row second heat exchanging surface 152, the front-row third heat exchanging surface 153, and the front-row fourth heat exchanging surface 154 have configurations identical to those of the front-row heat exchanging surface 55, the front-row first heat exchanging surface 51, the front-row second heat exchanging surface 52, the front-row third heat exchanging surface 53, and the front-row fourth heat exchanging surface 54 of the front-row heat exchanging unit 50 according to the embodiments described above. Thus, detailed description thereof is omitted here.

(1-1-2-1-2) Front-Row First Header

The front-row first header 156 differs from the front-row first header 56 in that only one horizontal partition plate 561 is arranged in the front-row first header space Sa1 (refer to FIG. 23). The front-row first header space Sa1 is partitioned into two spaces in the flat-tube stacking direction dr2 by the horizontal partition plate 561. Specifically, the front-row first header space Sa1 is partitioned by the horizontal partition plate 561 into a front-row first space A11 and a front-row second space A12 (refer to FIG. 23). The front-row first space A11 is arranged above the front-row second space A12.

The front-row first header 156 includes the first liquid-side port LH1 and the second liquid-side port LH2 (refer to FIG. 23). The first liquid-side port LH1 communicates with the front-row first space A11. The first liquid-refrigerant pipe 22*a* is connected to the first liquid-side port LH1 (refer to FIG. 23). The second liquid-side port LH2 communicates with the front-row second space A12. The second liquid-refrigerant pipe 22*b* is connected to the second liquid-side port LH2 (refer to FIG. 23). The front-row first space A11 and the front-row second space A12 are positioned on the most upstream side in a refrigerant flow in the indoor heat exchanger 125 during cooling operation and positioned on the most downstream side in a refrigerant flow in the indoor heat exchanger 125 during heating operation.

(1-1-2-1-3) Front-Row Second Header

The front-row second header 157 differs from the front-row second header 57 also in that only one horizontal partition plate 571 is arranged in the front-row second header space Sa2 (refer to FIG. 23). The front-row second header space Sa2 is partitioned into two spaces in the flat-tube stacking direction dr2 by the horizontal partition plate 571. Specifically, the front-row second header space Sa2 is partitioned by the horizontal partition plate 571 into a front-row third space A13 and a front-row fourth space A14 (refer to FIG. 23). The front-row third space A13 is arranged above the front-row fourth space A14.

The front-row third space A13 communicates with the front-row first space A11 of the front-row first header 156 via the flat multi-hole tubes 45 (refer to FIG. 23). A second connection hole H12 is formed at a portion corresponding to the front-row third space A13 of the front-row second header 157. One end of the second connection pipe 172 is connected to the second connection hole H12, and the front-row third space A13 and the second connection pipe 172 communicate with each other. The front-row third space A13 communicates with the rear-row second header space Sb2 via the second connection pipe 172.

The front-row fourth space A14 communicate with the front-row second space A12 of the front-row first header 156 via the flat multi-hole tubes 45 (refer to FIG. 23). A first connection hole H11 is formed at a portion corresponding to the front-row fourth space A14 of the front-row second header 157. One end of the first connection pipe 171 is connected to the first connection hole H11, and the front-row fourth space A14 and the first connection pipe 171 communicate with each other. The front-row fourth space A14 communicates with an intermediate-row second header space Sc2 via the first connection pipe 171.

(1-1-2-2) Intermediate Row Configuration

Figure 24:
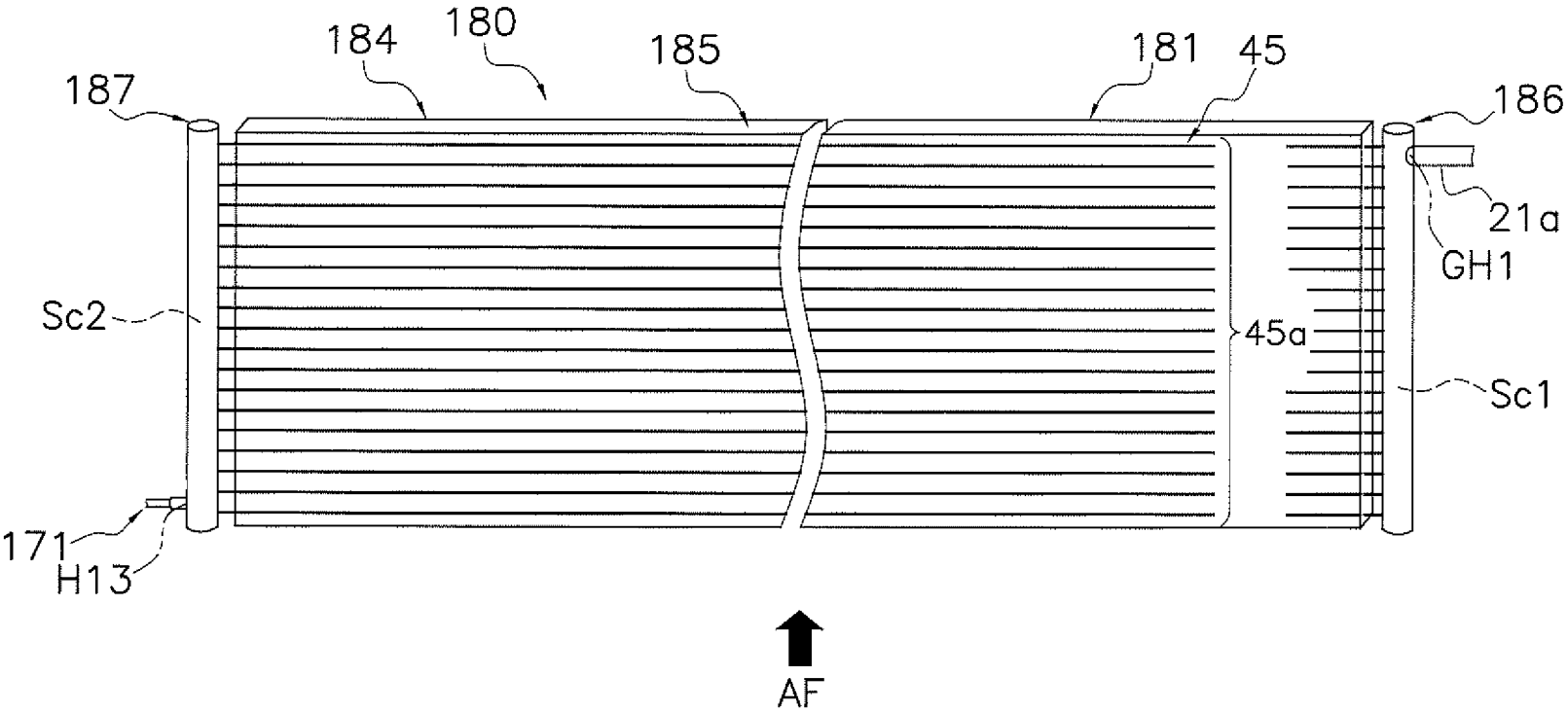
FIG. 24 is a schematic view roughly illustrating an intermediate row configuration of the indoor heat exchanger in FIG. 20.

FIG. 24 is a schematic view roughly illustrating the front row configuration including the intermediate-row heat exchanging unit 180, the intermediate-row first header 186, and the intermediate-row second header 187.

(1-1-2-2-1) Intermediate-Row Heat Exchanging Unit

The intermediate-row heat exchanging unit 180 includes an intermediate-row heat exchanging surface 185 as the heat exchanging surface 40. The intermediate-row heat exchanging surface 185 includes an intermediate-row first heat exchanging surface 181, an intermediate-row second heat exchanging surface 182, an intermediate-row third heat exchanging surface 183, and an intermediate-row fourth heat exchanging surface 184. The intermediate-row heat exchanging surface 185 formed into a substantially quadrilateral shape is arranged adjacent to the front-row heat exchanging surface 155 so as to surround the front-row heat exchanging surface 155 (refer to FIG. 20). The intermediate-row first heat exchanging surface 181, the intermediate-row second heat exchanging surface 182, the intermediate-row third heat exchanging surface 183, and the intermediate-row fourth heat exchanging surface 184 are arranged to face the front-row first heat exchanging surface 151, the front-row second heat exchanging surface 152, the front-row third heat exchanging surface 153, and the front-row fourth heat exchanging surface 154, respectively.

The physical configuration of the intermediate-row heat exchanging unit 180 is identical to that of the front-row heat exchanging unit 150, and detailed description thereof is thus omitted.

(1-1-2-2-2) Intermediate-Row First Header

The intermediate-row first header 186 is a header pipe that functions, for example, as a distribution header that causes a refrigerant to diverge into each of the flat multi-hole tubes 45 or as a merging header that causes the refrigerant flowing out from each of the flat multi-hole tubes 45 to merge together. The intermediate-row first header 186, in an installed state, extends such that the vertical direction coincides with the longitudinal direction thereof. The intermediate-row first header 186 is arranged on the airflow downstream side (left side in FIG. 20) of the front-row first header 156 in the air flow direction dr3 so as to be adjacent to the front-row first header 156.

The intermediate-row first header 186 has a cylindrical shape, and an intermediate-row first header space Sc1 is formed therein (refer to FIG. 24). The intermediate-row first header 186 is connected to a terminal end (rear end) of the intermediate-row first heat exchanging surface 181 (refer to FIG. 20). The intermediate-row first header 186 is connected to one end of each of the flat multi-hole tubes 45 of the intermediate-row heat exchanging unit 180 and causes these flat multi-hole tubes 45 to communicate with the intermediate-row first header space Sc1 (refer to FIG. 24).

The intermediate-row first header 186 includes the first gas-side port GH1 (refer to FIG. 24). The first gas-side port GH1 communicates with the intermediate-row first header space Sc1. The first gas-refrigerant pipe 21*a* is connected to the first gas-side port GH1 (refer to FIG. 24). The intermediate-row first header space Sc1 is positioned on the most downstream side of a refrigerant flow in the indoor heat exchanger 125 during cooling operation and positioned on the most upstream side of a refrigerant flow in the indoor heat exchanger 125 during heating operation.

(1-1-2-2-3) Intermediate-Row Second Header

The intermediate-row second header 187 is a header pipe that functions as, for example, a distribution header that causes a refrigerant to diverge into each of the flat multi-hole tubes 45, a merging header that causes the refrigerant flowing out from each of the flat multi-hole tubes 45 to merge together, or a return header that causes the refrigerant flowing out from each of the flat multi-hole tubes 45 to return to other flat multi-hole tubes 45. The intermediate-row second header 187, in an installed state, extends such that the vertical direction coincides with the longitudinal direction thereof. The intermediate-row second header 187 is adjacent to the airflow downstream side (rear side in FIG. 20) of the front-row second header 157 in the air flow direction dr3.

The intermediate-row second header 187 has a cylindrical shape, and the intermediate-row second header space Sc2 is formed therein (refer to FIG. 24). The intermediate-row second header 187 is connected to a terminal end (left end) of the intermediate-row fourth heat exchanging surface 184 (refer to FIG. 20). The intermediate-row second header 187 is connected to one end of each of the flat multi-hole tubes 45 of the intermediate-row heat exchanging unit 180 and causes these flat multi-hole tubes 45 to communicate with the intermediate-row second header space Sc2 (refer to FIG. 24).

The intermediate-row second header space Sc2 communicates with the intermediate-row first header space Sc1 of the intermediate-row first header 186 via the flat multi-hole tubes 45 (refer to FIG. 24). The intermediate-row second header 187 includes a third connection hole H13. One end of the first connection pipe 171 is connected to the third connection hole H13. The intermediate-row second header space Sc2 communicates with the front-row fourth space A14 of the front-row second header 57 via the first connection pipe 171.

(1-1-2-3) Rear Row Configuration

Figure 25:
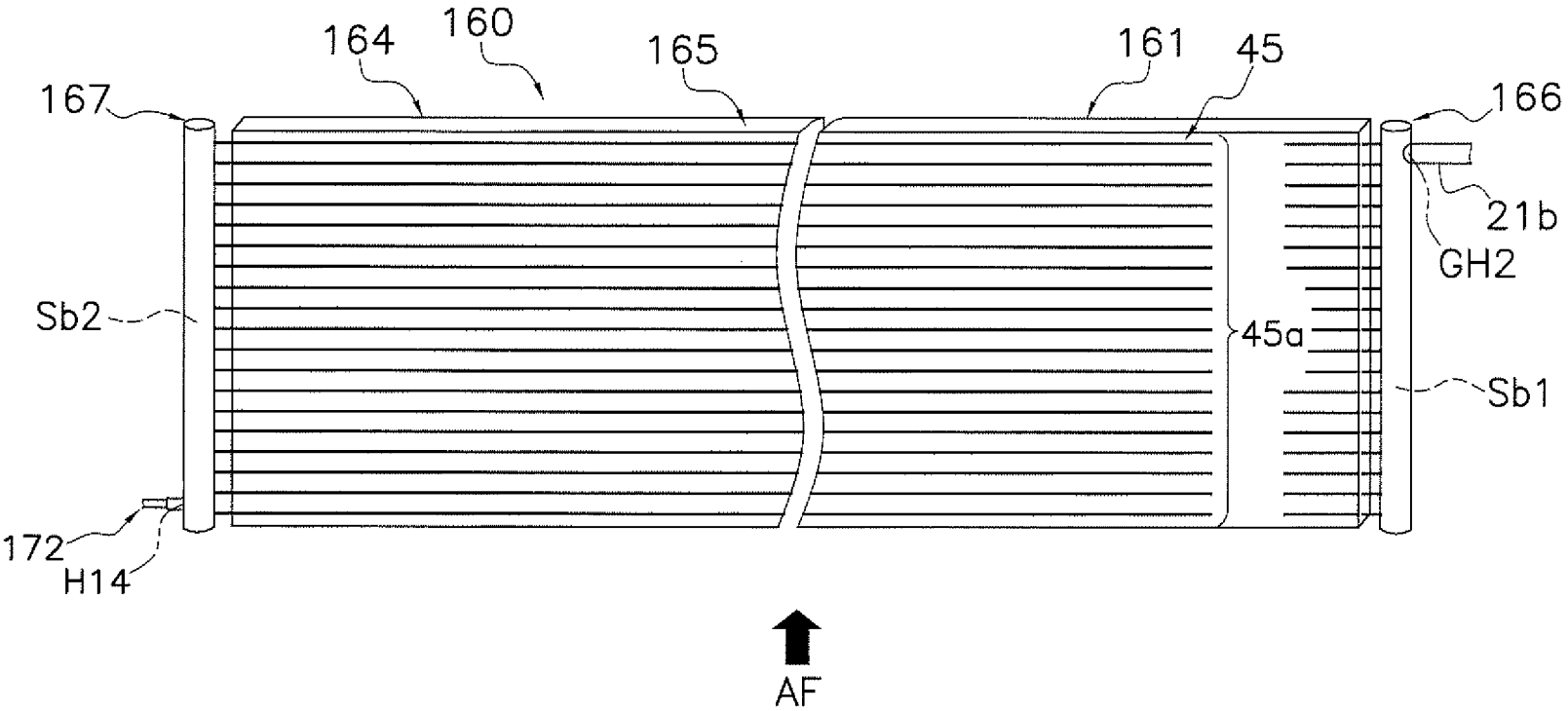
FIG. 25 is a schematic view roughly illustrating a rear row configuration of the indoor heat exchanger in FIG. 20.

FIG. 25 is a schematic view roughly illustrating the front row configuration including the rear-row heat exchanging unit 160, the rear-row first header 166, and the rear-row second header 167.

(1-1-2-3-1) Rear-row Heat Exchanging Unit

The physical configuration of the rear-row heat exchanging unit 160 is identical to that of the rear-row heat exchanging unit 60.

The rear-row heat exchanging unit 160 differs from the rear-row heat exchanging unit 60 in terms of a substantially quadrilateral rear-row heat exchanging surface 165 being arranged adjacent to the intermediate-row heat exchanging surface 185 so as to surround the intermediate-row heat exchanging surface 185 (refer to FIG. 20). A rear-row first heat exchanging surface 161, a rear-row second heat exchanging surface 162, a rear-row third heat exchanging surface 163, and a rear-row fourth heat exchanging surface 164 are arranged to face the intermediate-row first heat exchanging surface 181, the intermediate-row second heat exchanging surface 182, the intermediate-row third heat exchanging surface 183, and the intermediate-row fourth heat exchanging surface 184, respectively.

(1-1-2-3-2) Rear-Row First Header

The rear-row first header 166 is arranged on the airflow downstream side (left side in FIG. 20) of the intermediate-row first header 186 in the air flow direction dr3 so as to be adjacent to the intermediate-row first header 186. Other features are identical to those of the rear-row first header 66, and description thereof is thus omitted.

(1-1-2-3-3) Rear-Row Second Header

Features of the rear-row second header 167 differing from those of the rear-row second header 67 will be mainly described.

The rear-row second header 167 is arranged adjacent to the airflow downstream side (rear side in FIG. 20) of the intermediate-row second header 187 in the air flow direction dr3. The rear-row second header space Sb2 communicates with the rear-row first header space Sb1 of the rear-row first header 166 via the flat multi-hole tubes 45 (refer to FIG. 25). The rear-row second header 167 includes a fourth connection hole H14. One end of the second connection pipe 172 is connected to the fourth connection hole H14. The rear-row second header space Sb2 communicate with the front-row third space A13 of the front-row second header 157 via the second connection pipe 172 (refer to FIG. 21).

(1-1-2-4) Connection Pipe

The first connection pipe 171 is a refrigerant pipe that forms a refrigerant flow path between the front-row heat exchanging unit 150 and the intermediate-row heat exchanging unit 180. The first connection pipe 171 is a refrigerant flow path that causes the front-row fourth space A14 of the front-row heat exchanging unit 150 and the intermediate-row second header space Sc2 of the intermediate-row second header 187 to communicate with each other.

The second connection pipe 172 is a refrigerant pipe that forms a refrigerant flow path between the front-row heat exchanging unit 150 and the rear-row heat exchanging unit 160. The second connection pipe 172 is a refrigerant flow path that causes the front-row third space A13 of the front-row heat exchanging unit 150 and the rear-row second header space Sb2 of the rear-row second header 167 to communicate with each other.

(1-2) Refrigerant Paths in Indoor Heat Exchanger

Refrigerant paths in the indoor heat exchanger 125 will be described.

FIG. 22 is a schematic view roughly illustrating refrigerant paths formed in the indoor heat exchanger 125. In one or more embodiments, the indoor heat exchanger 125 includes a plurality of paths. Specifically, the indoor heat exchanger 125 includes a first path P11, a second path P12, a third path P13, and a fourth path P14.

(1-2-1) First Path

Figure 26:
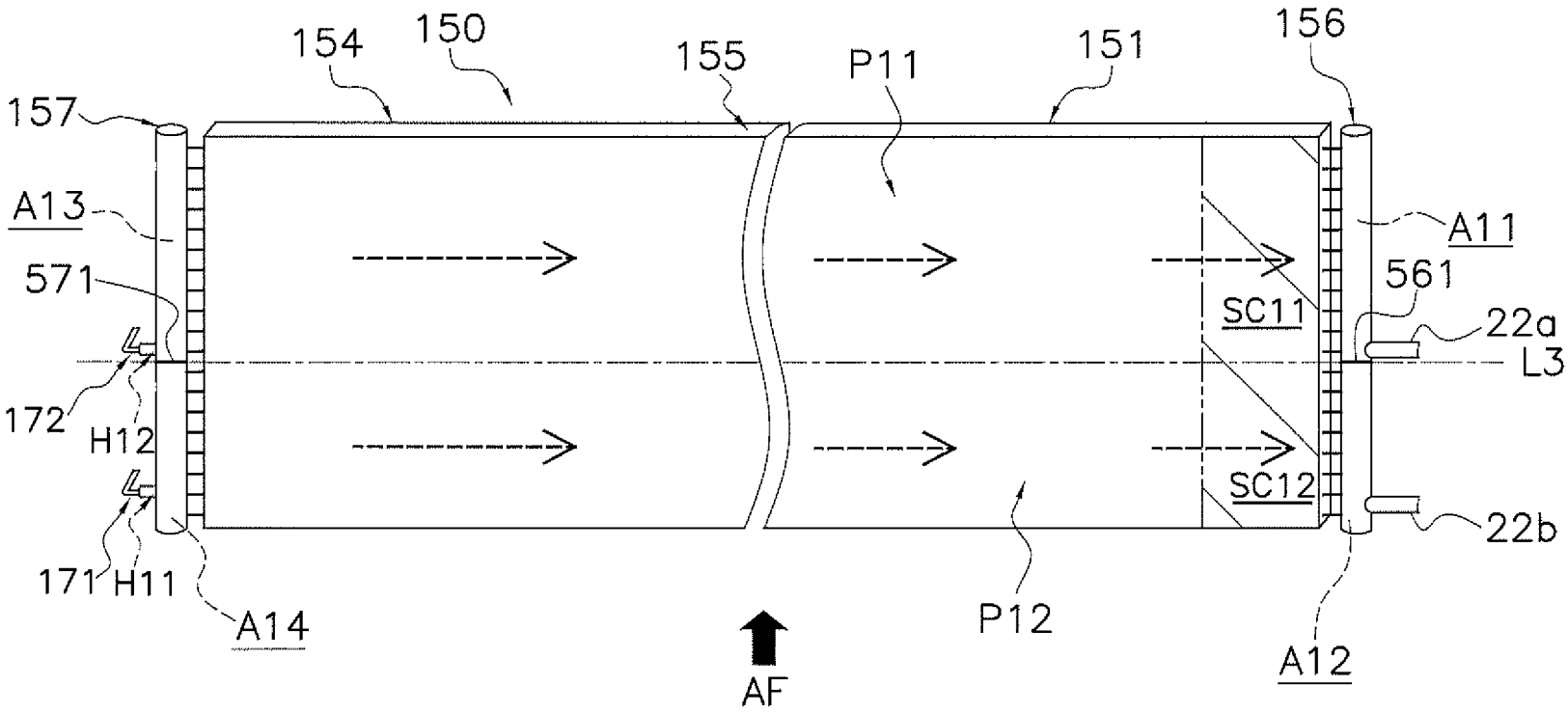
FIG. 26 is a schematic view roughly illustrating a refrigerant flow during heating operation in a front-row heat exchanging unit of the indoor heat exchanger in FIG. 20.

In one or more embodiments, the first path P11 is formed at a portion of the front-row heat exchanging unit 150 above the one-dot chain line L3 (refer to, for example, FIG. 26). The first path P1 is formed by, mainly, the front-row first space A11, the flat multi-hole tubes 45 that cause the front-row first space A11 and the front-row third space A13 to communicate with each other, and the front-row third space A13.

During cooling operation, a refrigerant flows from the front-row first space A11 toward the front-row third space A13 in the first path P11.

During heating operation, a refrigerant flows from the front-row third space A13 toward the front-row first space A11 in the first path P11 (refer to FIG. 26). More specifically, during heating operation, a refrigerant that has flowed through the later-described fourth path P14 (the gas-side flat multi-hole tubes 45*a*) and the second connection pipe 172 flows from the second connection hole H12 into the front-row third space A13. The refrigerant that has flowed into the front-row third space A13 (into the front-row second header 57) is guided into a plurality of the flat multi-hole tubes 45 of the first path P11. The refrigerant in the front-row third space A13 flows from end-portion openings of the flat multi-hole tubes 45 of the first path P11 at the end adjacent to the front-row third space A13, passes through the flat-tube flow paths 451, and flows into the front-row first space A11 from end-portion opening (the liquid-refrigerant ports 45*ba*) of the flat multi-hole tubes 45 of the first path P11 at the end adjacent to the front-row first space A11. The refrigerant that flows into the front-row first space A11 during heating operation is, mainly, a liquid refrigerant in a subcooled state.

The flat multi-hole tubes 45 of the first path P11 are the liquid-side flat multi-hole tubes 45*b*. Description of the liquid-side flat multi-hole tubes 45*b* is omitted because it has been described in the embodiments described above. The number of the flat multi-hole tubes 45 of the first path P11 is, for example, eleven, as illustrated in FIG. 22. The number of the flat multi-hole tubes 45 of the first path P11, however, may be determined, as appropriate.

(1-2-2) Second Path

In one or more embodiments, the second path P12 is formed at a portion of the front-row heat exchanging unit 150 below the one-dot chain line L3 (refer to, for example, FIG. 26). The second path P12 is formed by, mainly, the front-row second space A12, the flat multi-hole tubes 45 that cause the front-row second space A12 and the front-row fourth space A14 to communicate with each other, and the front-row fourth space A14.

During cooling operation, a refrigerant flows from the front-row second space A12 toward the front-row fourth space A14 in the second path P12.

During heating operation, a refrigerant flows from the front-row fourth space A14 toward the front-row second space A12 in the second path P12 (refer to FIG. 26). More specifically, during heating operation, a refrigerant that has flowed through the later-described third path P13 (the gas-side flat multi-hole tubes 45*a*) and the first connection pipe 171 flows from the first connection hole H11 into the front-row fourth space A14. The refrigerant that has flowed into the front-row fourth space A14 (into the front-row second header 57) is guided into a plurality of the flat multi-hole tubes 45 of the second path P12. The refrigerant in the front-row fourth space A14 flows in from end-portion openings of the flat multi-hole tubes 45 of the second path P12 at the end adjacent to the front-row fourth space A14, passes through the flat-tube flow paths 451, and flows into the front-row second space A12 from end-portion openings (the liquid-refrigerant ports 45*ba*) of the flat multi-hole tubes 45 of the second path P12 at the end adjacent to the front-row first space A11. The refrigerant that flows into the front-row second space A12 during heating operation is, mainly, a liquid refrigerant in a subcooled state.

The flat multi-hole tubes 45 of the second path P12 are the liquid-side flat multi-hole tubes 45*b*. The number of the flat multi-hole tubes 45 of the second path P12 is, for example, eight, as illustrated in FIG. 22. The number of the flat multi-hole tubes 45 of the second path P12, however, may be determined, as appropriate.

(1-2-3) Third Path

The third path P13 is formed by, mainly, the intermediate-row first header space Sc1, the flat multi-hole tubes 45 that cause the intermediate-row first header space Sc1 and the intermediate-row second header space Sc2 to communicate with each other, and the intermediate-row second header space Sc2.

During cooling operation, a refrigerant flows from the intermediate-row second header space Sc2 toward the intermediate-row first header space Sc1 in the third path P13.

Figure 27:
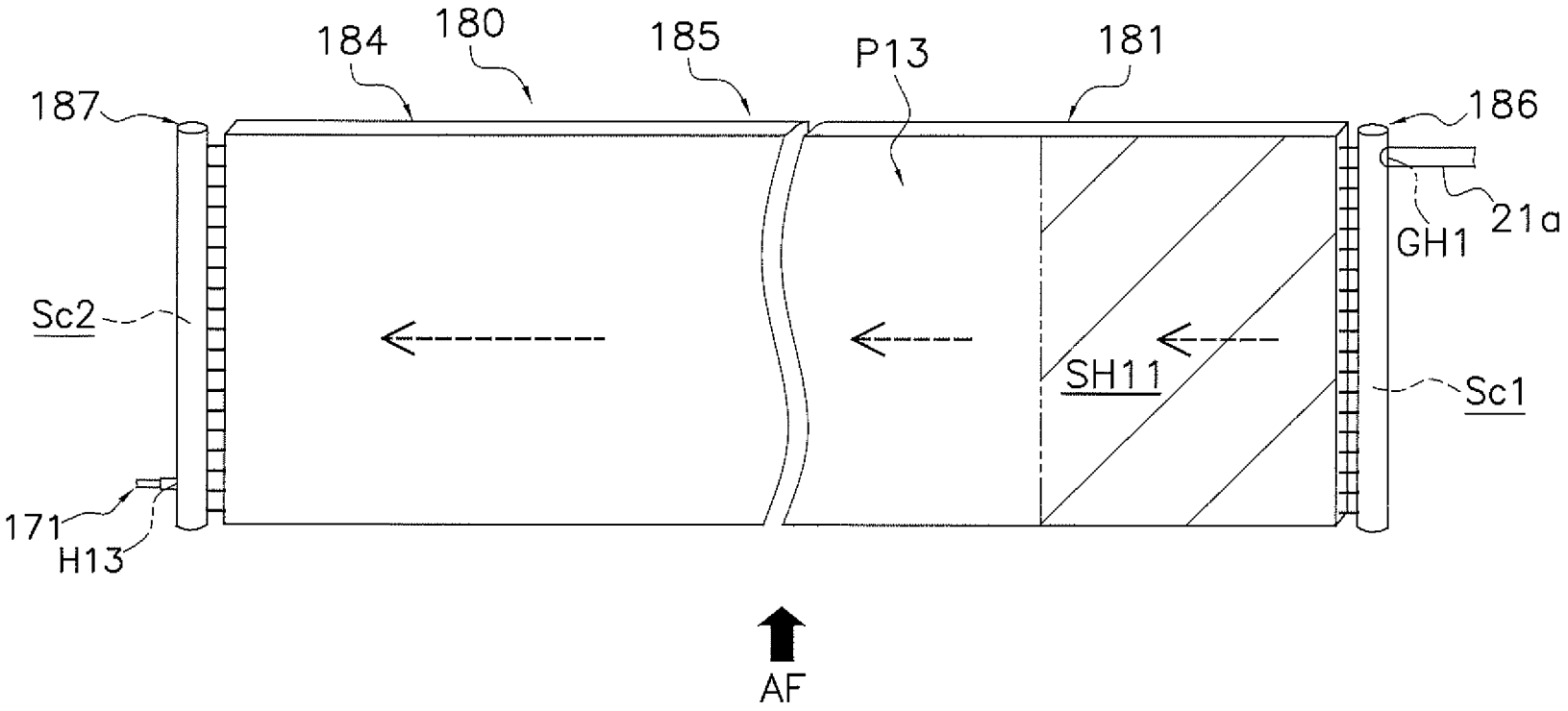
FIG. 27 is a schematic view roughly illustrating a refrigerant flow during heating operation in an intermediate-row heat exchanging unit of the indoor heat exchanger in FIG. 20.

During heating operation, a refrigerant flows from the intermediate-row first header space Sc1 toward the intermediate-row second header space Sc2 in the third path P13 (refer to FIG. 27). More specifically, a gas refrigerant in, mainly, a superheated state flows from the first gas-refrigerant pipe 21*a* into the intermediate-row first header space Sc1 by passing through the first gas-side port GH1. The gas refrigerant that has flowed into the intermediate-row first header space Sc1 flows in from end-portion openings (the gas-refrigerant ports 45*aa*) of the flat multi-hole tubes 45 of the third path P13 at the end adjacent to the intermediate-row first header space Sc1, passes through the flat-tube flow paths 451, and flows into the intermediate-row second header space Sc2 from end-portion openings of the flat multi-hole tubes 45 of the third path P13 at the end adjacent to the intermediate-row second header space Sc2. The refrigerant that has flowed out from a plurality of the gas-side flat multi-hole tubes 45*a* merges together in the intermediate-row second header space Sc2 (in the intermediate-row second header 187). The refrigerant that has merged together in the intermediate-row second header space Sc2 (in the intermediate-row second header 187) is guided, via the first connection pipe 171 and the front-row fourth space A14, into a plurality of the liquid-side flat multi-hole tubes 45*b* of the second path P12.

The flat multi-hole tubes 45 of the third path P13 are the gas-side flat multi-hole tubes 45*a* (refer to FIG. 24). Description of the gas-side flat multi-hole tubes 45*a* is omitted because it has been described in the embodiments described above. As illustrated in FIG. 22, the third path P13 includes a total of, for example, 19 of the flat multi-hole tubes 45 (gas-side flat multi-hole tubes 45*a*).

(1-2-4) Fourth Path

The fourth path P14 has much in common with the fourth path P4 according to the embodiments described above. The fourth path P14 is formed by, mainly, the rear-row first header space Sb1, the flat multi-hole tubes 45 that cause the rear-row first header space Sb1 and the rear-row second header space Sb2 to communicate with each other, and the rear-row second header space Sb2.

During cooling operation, a refrigerant flows from the rear-row second header space Sb2 toward the rear-row first header space Sb1 in the fourth path P14.

The refrigerant flow in the fourth path P14 during heating operation is identical to the refrigerant flow in the fourth path P4 according to the embodiments described above. As a difference, a refrigerant that has passed through the gas-side flat multi-hole tubes 45*a* of the fourth path P14 and merged together in the rear-row second header space Sb2 is guided into a plurality of the liquid-side flat multi-hole tubes 45*b* of the first path P11 via the second connection pipe 172 and the front-row third space A13.

The flat multi-hole tubes 45 of the fourth path P14 are the gas-side flat multi-hole tubes 45*a* (refer to FIG. 25). As illustrated in FIG. 22, the fourth path P14 includes a total of, for example, 19 of the flat multi-hole tubes 45 (the gas-side flat multi-hole tubes 45*a*).

The indoor heat exchanger 125 according to the embodiments described above has a configuration in which the number (zero) of the gas-side flat multi-hole tubes 45*a* included in the heat exchanging unit (the front-row heat exchanging unit 150) at the front-most row on the airflow upstream side in the air flow direction dr3 is less than the number (19) of the gas-side flat multi-hole tubes 45*a* included in the heat exchanging unit (the rear-row heat exchanging unit 160) at the rear-most row on the airflow downstream side. Here, the configuration in which the number of the gas-side flat multi-hole tubes 45*a* included in the heat exchanging unit at the front-most row on the airflow upstream side is less than the number of the gas-side flat multi-hole tubes 45*a* included in the heat exchanging unit at the rear-most row on the airflow downstream side includes a configuration in which the number of the gas-side flat multi-hole tubes 45*a* included in the heat exchanging unit at the front-most row on the airflow upstream side in the air flow direction dr3 is zero and in which the gas-side flat multi-hole tubes 45*a* are included in the heat exchanging unit at the rear-most row on the airflow downstream side.

In addition, the indoor heat exchanger 125 according to one or more embodiments has a configuration in which a plurality of the heat exchanging units (the intermediate-row heat exchanging unit 180 and the rear-row heat exchanging unit 160) each include the gas-side flat multi-hole tubes 45*a*.

In addition, the indoor heat exchanger 125 according to one or more embodiments has a configuration in which the total number 38 (the rear-row heat exchanging unit 160: 19; the intermediate-row heat exchanging unit 180: 19) of the gas-side flat multi-hole tubes 45*a* is more than the total number 19 (the front-row heat exchanging unit 150) of the liquid-side flat multi-hole tubes 45*b*.

In addition, the indoor heat exchanger 125 according to one or more embodiments has a configuration in which only the front-row heat exchanging unit 150 at the front-most row (on the airflow most upstream side) includes the liquid-side flat multi-hole tubes 45*b*.

In addition, the indoor heat exchanger 125 according to one or more embodiments has a configuration in which the gas-refrigerant port 45*aa* included in each of the gas-side flat multi-hole tubes 45*a* is disposed at the end adjacent to the first headers 186 and 166.

(1-3) Refrigerant Flow in Indoor Heat Exchanger (1-3-1) During Cooling Operation Description of the refrigerant flow during cooling operation is omitted here. During cooling operation, a refrigerant flows in a direction opposite to the direction during heating operation in each of the paths P11 to P14 of the indoor heat exchanger 125.

(1-3-2) During Heating Operation

In the indoor heat exchanger 125 during heating operation, a gas refrigerant in a superheated state flows in from the gas-side ports GH and is cooled at the heat exchanging units 150, 160, and 180, and a liquid refrigerant in a subcooled state flows out from the liquid-side ports LH.

Figure 28:
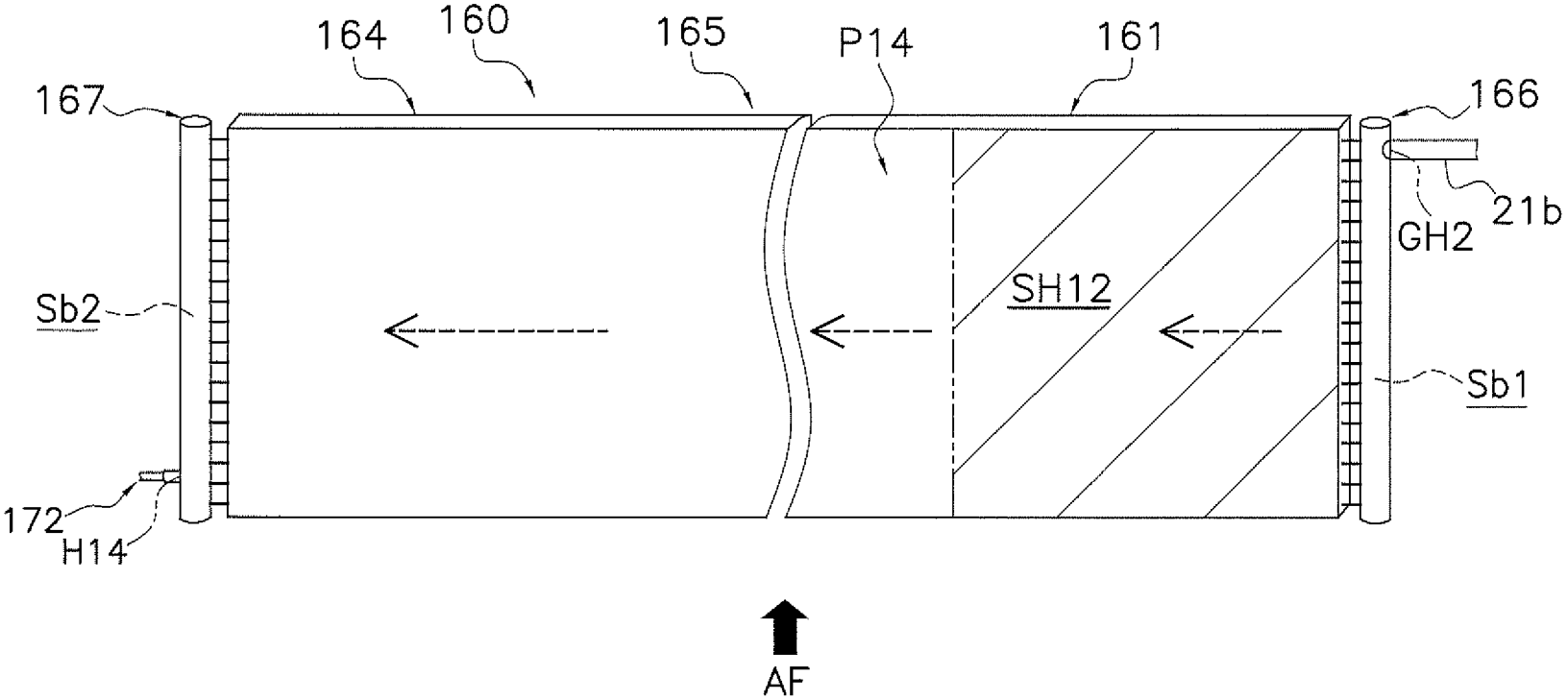
FIG. 28 is a schematic view roughly illustrating a refrigerant flow during heating operation in a rear-row heat exchanging unit of the indoor heat exchanger in FIG. 20.

FIG. 26 is a schematic view roughly illustrating a refrigerant flow in the front-row heat exchanging unit 150 during heating operation. FIG. 27 is a schematic view roughly illustrating a refrigerant flow in the intermediate-row heat exchanging unit 180 during heating operation. FIG. 28 is a schematic view roughly illustrating a refrigerant flow in the rear-row heat exchanging unit 160 during heating operation. In FIG. 26 to FIG. 28, each of the dashed arrows indicates a refrigerant-flow direction.

During heating operation, a gas refrigerant that has flowed through the first gas-refrigerant pipe 21*a* and that has entered a superheated state flows into the intermediate-row first header space Sc1 of the intermediate-row first header 186 via the first gas-side port GH1. The gas refrigerant that has flowed into the intermediate-row first header space Sc1 passes through the flat-tube flow paths 451 of the gas-side flat multi-hole tubes 45*a* of the third path P13 while exchanging heat with the indoor air flow AF and being cooled. The refrigerant that has been cooled at the gas-side flat multi-hole tubes 45*a* of the third path P13 and that has entered a two-phase state at an intermediate portion of each of the gas-side flat multi-hole tubes 45*a* flows into the intermediate-row second header space Sc2. The refrigerant that has flowed into the intermediate-row second header space Sc2 flows into the front-row fourth space A14 via the first connection pipe 171. The refrigerant that has flowed into the front-row fourth space A14 passes through the flat-tube flow paths 451 of the liquid-side flat multi-hole tubes 45*b* of the second path P12 while exchanging heat with the indoor air flow AF and entering a subcooled state and flows out to the second liquid-refrigerant pipe 22*b* via the front-row second space A12 and the first liquid-side port LH1.

During heating operation, a gas refrigerant that has flowed through the second gas-refrigerant pipe 21*b* and that has entered a superheated state flows into the rear-row first header space Sb1 of the rear-row first header 166 via the second gas-side port GH2. The gas refrigerant that has flowed into the rear-row first header space Sb1 passes through the flat-tube flow paths 451 of the gas-side flat multi-hole tubes 45*a* of the fourth path P14 while exchanging heat with the indoor air flow AF and being cooled. The refrigerant that has been cooled at the gas-side flat multi-hole tubes 45*a* of the fourth path P14 and that has entered a two-phase state at an intermediate portion of each of the gas-side flat multi-hole tubes 45*a* flows into the rear-row second header space Sb2. The refrigerant that has flowed into the rear-row second header space Sb2 flows into the front-row third space A13 of the front-row second header 57 via the second connection pipe 172. The refrigerant that has flowed into the front-row third space A13 passes through the flat-tube flow paths 451 of the liquid-side flat multi-hole tubes 45*b* of the first path P11 while exchanging heat with the indoor air flow AF and entering a subcooled state and flows out to the first liquid-refrigerant pipe 22*a* via the front-row first space A11 and the second liquid-side port LH2.

In the front-row second header 157, a space (the front-row fourth space A14) into which a refrigerant that has flowed out from the gas-side flat multi-hole tubes 45*a* of the intermediate-row heat exchanging unit 180 flows and a space (the front-row third space A13) into which a refrigerant that has flowed out from the gas-side flat multi-hole tubes 45*a* of the rear-row heat exchanging unit 160 flows are segregated from each other. In other words, the horizontal partition plate 571 that segregates the refrigerant that has flowed out from the gas-side flat multi-hole tubes 45*a* by the heat exchanging units is arranged in the front-row second header 157.

During heating operation (in particular, when operation has entered a steady state), in the indoor heat exchanger 125, a region (superheat region SH11) in which a refrigerant in a superheated state flows is formed at the flat-tube flow paths 451 (in particular, the flat-tube flow paths 451 of the gas-side flat multi-hole tubes 45*a* at the end adjacent to the intermediate-row first header 186 in the third path P13 (for example, the flat-tube flow paths 451 included in the third path P13 of the intermediate-row first heat exchanging surface 181)) in the third path P13. The other regions of the flat-tube flow paths 451 of the third path P13 than the superheat region SH11 are, mainly, two-phase regions in which a two-phase refrigerant flows. In addition, a region (superheat region SH12) in which a refrigerant in a superheated state flows is formed at the flat-tube flow paths 451 (in particular, the flat-tube flow paths 451 at the end adjacent to the rear-row first header 166 in the fourth path P14 (for example the flat-tube flow paths 451 included in the fourth path P14 of the rear-row first heat exchanging surface 161). The other regions of the flat-tube flow paths 451 of the fourth path P14 than the superheat region SH12 are, mainly, two-phase regions in which a two-phase refrigerant flows. The superheat region SH11 and the superheat region SH12 are an example of the gas regions, in which a gas refrigerant flows, formed at the gas-side flat multi-hole tubes 45*a* in the vicinity of the gas-refrigerant ports 45*aa*.

As described above, in the indoor heat exchanger 125 according to one or more embodiments, the gas-refrigerant port 45*aa* included in each of the gas-side flat multi-hole tubes 45*a* is disposed at the end adjacent to the first headers 186 and 166. Thus, as illustrated in FIG. 27 and FIG. 28, the superheat region SH11 of the intermediate-row heat exchanging unit 180 and the superheat region SH12 of the rear-row heat exchanging unit 160 are arranged at the same end portion (the end adjacent to the first headers 186 and 166) of the flat multi-hole tubes 45. In other words, the superheat region SH11 of the intermediate-row heat exchanging unit 180 and the superheat region SH12 of the rear-row heat exchanging unit 160 are arranged so as to be superposed with each other in the air flow direction dr3. The flowing direction in which a refrigerant that flows in the superheat region SH11 of the intermediate-row heat exchanging unit 180 and the flowing direction of a refrigerant that flows in the superheat region SH12 of the rear-row heat exchanging unit 160 coincide with each other (that is, parallel flow).

In the indoor heat exchanger 125 according to one or more embodiments, the intermediate-row heat exchanging unit 180 includes the gas-side flat multi-hole tubes 45*a* (the first gas-side flat multi-hole tubes) that include the gas-refrigerant ports 45*aa* at the first end (the end adjacent to the intermediate-row first header 186). The rear-row heat exchanging unit 160 includes the gas-side flat multi-hole tubes 45*a* (the first gas-side flat multi-hole tubes) that include the gas-refrigerant ports 45*aa* at the first end (the end adjacent to the rear-row first header 166). In the indoor heat exchanger 125 according to one or more embodiments, the gas-side flat multi-hole tubes 45*a* are arranged throughout the intermediate-row heat exchanging unit 180 and the rear-row heat exchanging unit 160 in the height direction thereof. Thus, on the airflow downstream side of the gas-side flat multi-hole tubes 45*a* (the first gas-side flat multi-hole tubes) of the intermediate-row heat exchanging unit 180 in the air flow direction, only the gas-side flat multi-hole tubes 45*a* of the rear-row heat exchanging unit 160 including the gas-refrigerant ports 45*aa* at the first end (the end adjacent to the rear-row first header 166) are arranged at a position identical to the position of the first gas-side flat multi-hole tubes (that is, at a height position identical to the height position of the first gas-side flat multi-hole tubes of the intermediate-row heat exchanging unit 180) in the first direction (the flat-tube stacking direction dr2). No heat exchanging unit is arranged on the airflow downstream side of the gas-side flat multi-hole tubes 45*a* (the first gas-side flat multi-hole tubes) of the rear-row heat exchanging unit 160 in the air flow direction.

In the indoor heat exchanger 125 according to one or more embodiments, efficiency in a heat exchange between the indoor air flow AF and a refrigerant in the intermediate-row heat exchanging unit 180 on the airflow upstream side of the rear-row heat exchanging unit 160 is higher than efficiency in a heat exchange between the indoor air flow AF and the refrigerant in the rear-row heat exchanging unit 160 that is disposed on the airflow downstream side of the intermediate-row heat exchanging unit 180. Thus, the length of the superheat region SH11 is less than the length of the superheat region SH12 in the flat-tube extending direction dr1 (refer to FIG. 27 and FIG. 28). Accordingly, the area of the superheat region SH11 is less than the area of the superheat region SH12 (refer to FIG. 27 and FIG. 28). In other words, the superheat region SH11 is included in the superheat region SH12 when viewed in the air flow direction dr3.

In other words, on the airflow downstream side of the superheat region SH11 in the air flow direction dr3, no two-phase or liquid region in which a two-phase refrigerant or a liquid-phase refrigerant flows in the flat multi-hole tubes 45 is arranged. It is thus possible to suppress condensation performance of the indoor heat exchanger 125 from being degraded as a result of the indoor air flow AF that has exchanged heat with a high-temperature gas refrigerant exchanging heat with a low-temperature gas refrigerant.

During heating operation (in particular, when operation has entered a steady state), in the indoor heat exchanger 125, a region (subcool region SC11) in which a refrigerant in a subcooled state flows is formed at the flat-tube flow paths 451 (in particular, the flat-tube flow paths 451 at the end adjacent to the front-row first header 156 in the first path P11 (for example, the flat-tube flow paths 451 included in the first path P11 of the front-row first heat exchanging surface 151)) in the first path P11. The other region of the flat-tube flow paths 451 in the first path P11 than the subcool region SC11 are, mainly, two-phase regions in which a two-phase refrigerant flows. In addition, in the indoor heat exchanger 125, a region (subcool region SC12) in which a refrigerant in a subcooled state flows is formed at the flat-tube flow paths 451 (in particular, the flat-tube flow paths 451 at the end adjacent to the front-row first header 156 in the second path P12 (for example, the flat-tube flow paths 451 included in the second path P12 of the front-row first heat exchanging surface 151)) in the second path P12. The other regions of the flat-tube flow paths 451 in the second path P12 than the subcool region SC12 are, mainly, two-phase regions in which a two-phase refrigerant flows. In one or more embodiments, the liquid-side flat multi-hole tubes 45*b* are flat multi-hole tubes (the first liquid-side flat multi-hole tubes) including the liquid-refrigerant ports 45*ba* at the first end (the end adjacent to the front-row first header 156).

Here, the front-row heat exchanging unit 150 including the liquid-side flat multi-hole tubes 45*b* is a heat exchanging unit that is present on the airflow most upstream side in the air flow direction dr3, and, thus, no heat exchanging unit is arranged on the airflow upstream side of the liquid-side flat multi-hole tubes 45*b* in the air flow direction dr3. In other words, no two-phase or gas region in which a two-phase refrigerant or a gas refrigerant flows in the flat multi-hole tubes 45 is arranged on the airflow upstream side of the subcool regions SC11 and SC12 in the air flow direction dr3. It is thus possible here to suppress a refrigerant that has been once cooled to a predetermined degree of subcooling from being heated by air that has been heated on the airflow upstream side by a two-phase refrigerant or a gas refrigerant, and it is possible to suppress performance degradation. In addition, from the point of view of air, it is possible to suppress air that has been heated by a two-phase refrigerant or a gas refrigerant during heating operation from being cooled by a refrigerant that has been subcooled on the airflow downstream side, and it is possible to suppress degradation in heating performance.

(2) Features

The indoor heat exchanger 125 according to one or more embodiments also has features identical to the features in (5-1) to (5-9) of the indoor heat exchanger 25 according to the embodiments described above. Additionally, the indoor heat exchanger 125 has the following features.

(2-1)

The indoor heat exchanger 125 includes at least three rows (here, in particular, three rows) of the heat exchanging units 150, 160, and 180. Only the heat exchanging unit at the front-most row, that is, the front-row heat exchanging unit 150 includes the liquid-side flat multi-hole tubes 45*b*.

Here, when the indoor heat exchanger 125 is used as a condenser, heating regions are concentrated on the rear row side, and it is thus possible to achieve a performance improvement (an increase in the blow-out temperature).

(3) Modification

The aforementioned embodiments can be modified, as appropriate, as presented in the following modifications. Each of the modifications may be employed by being combined with other modifications within a range that does not cause contradiction.

In addition, a part of or an entirety of the configuration of the embodiments described above and the configurations of the modifications of the embodiments described above can be applied to the modifications of the any of the embodiments described above within a range that does not cause contradiction.

(3-1) Modification 2A

In the aforementioned embodiments, the indoor heat exchanger 125 includes the three rows of the heat exchanging units and is, however, not limited thereto. The heat exchanger may include four rows or more of heat exchanging units. Even when four rows or more of heat exchanging units are included, the number of the gas-side flat multi-hole tubes 45*a* included in the heat exchanging unit at the front-most row may be less than the number of the gas-side flat multi-hole tubes 45*a* included in the heat exchanging unit at the rear-most row.

(3-2) Modification 2B

In the aforementioned embodiments, the heat exchanging unit of the indoor heat exchanger 125 at the front-most row, that is, the front-row heat exchanging unit 150 includes only the liquid-side flat multi-hole tubes 45*b* and does not include the gas-side flat multi-hole tubes 45*a*.

Figure 29:
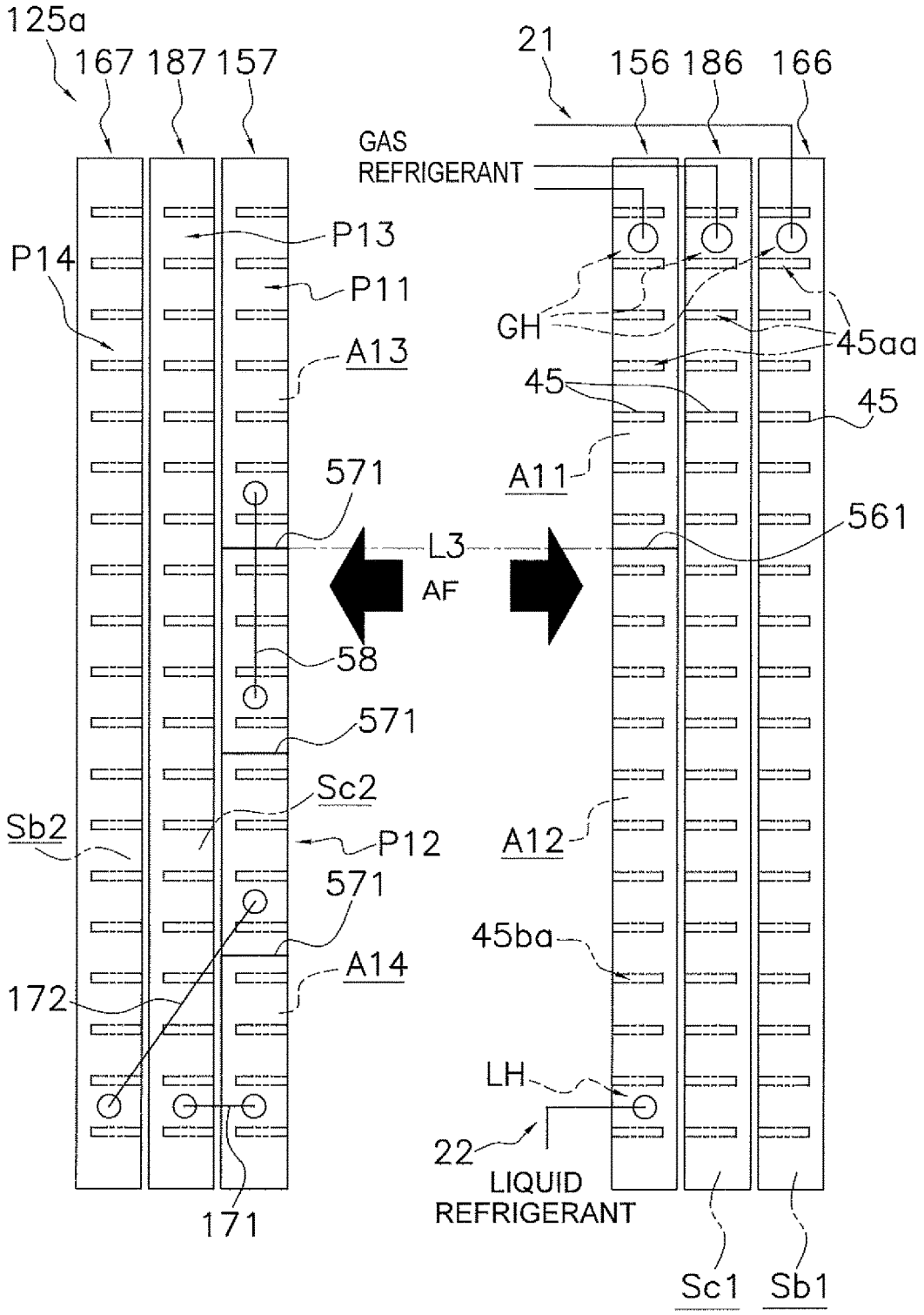
FIG. 29 is a schematic view roughly illustrating refrigerant paths formed in an indoor heat exchanger of a modification 2B.

The indoor heat exchanger is, however, not limited thereto and may be an indoor heat exchanger 125*a* having a path arrangement such as that in FIG. 29. In the indoor heat exchanger 125*a*, the front-row first space A11 includes the gas-side ports GH, and the gas-refrigerant pipe 21 is connected to the gas-side ports GH. As a result, the flat multi-hole tubes 45 of the first path P11 in the aforementioned embodiments functions as the gas-side flat multi-hole tubes 45*a* during heating operation.

Figure 30:
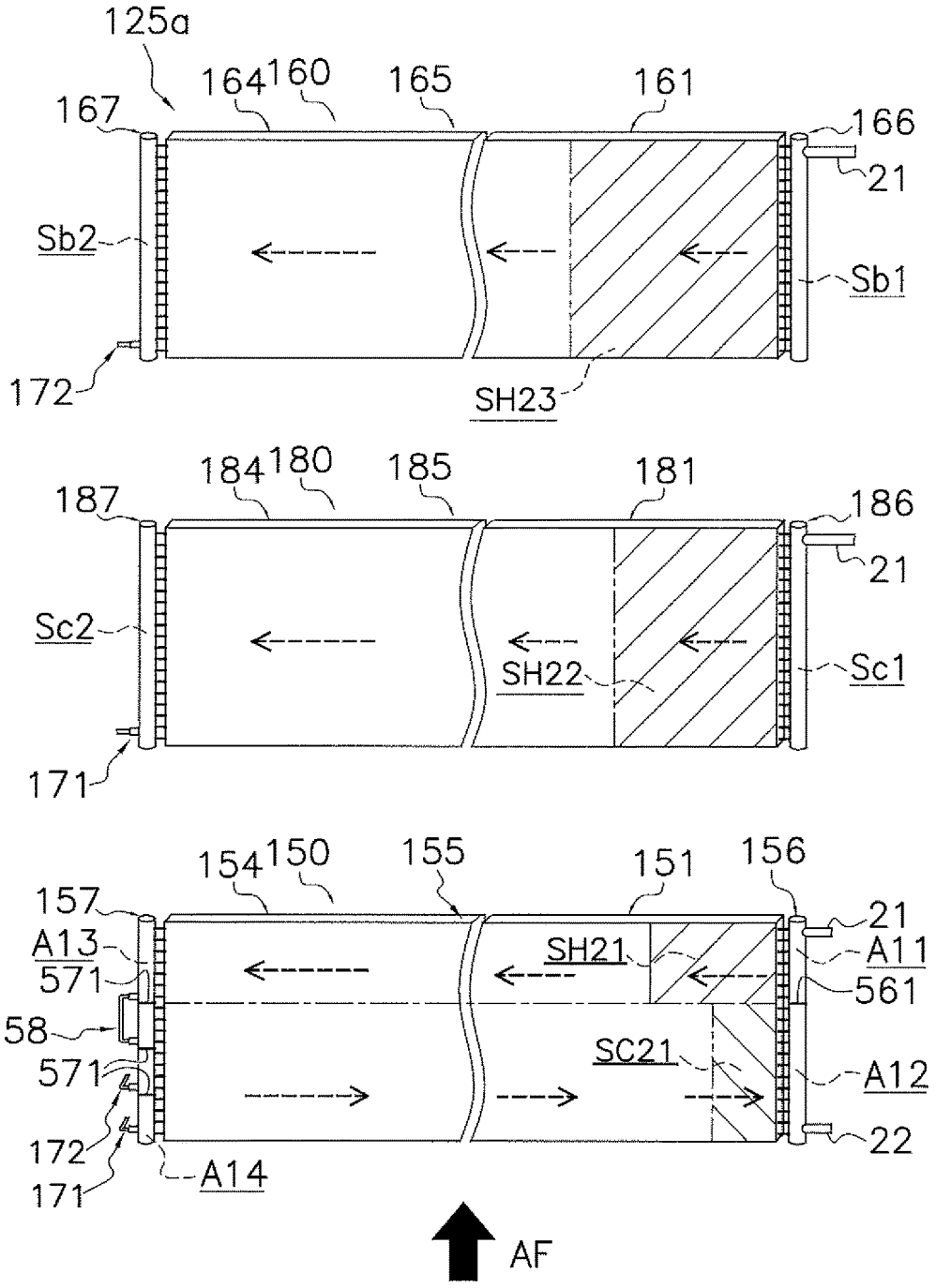
FIG. 30 is a schematic view roughly illustrating a refrigerant flow during heating operation in a front-row heat exchanging unit, an intermediate-row heat exchanging unit, and a rear-row heat exchanging unit of the indoor heat exchanger in FIG. 29.

During heating operation, a refrigerant that has passed through the gas-side flat multi-hole tubes 45*a* of the first path P11, the third path P13, and the fourth path P14 is guided into the front-row fourth space A14 via the return pipe 58 and the connection pipes 171 and 172. The front-row fourth space A14 may be divided into three divisions in the flat-tube stacking direction dr2 by the horizontal partition plates 571 (refer to FIG. 29). A refrigerant that has passed through the gas-side flat multi-hole tubes 45*a* of the heat exchanging units at rows differing from each other may be guided into respective three divisions formed by the horizontal partition plates 571. The refrigerant that has flowed into the front-row fourth space A14 is guided, in the second path P12, into the front-row second space A12, merges together in the front-row second space A12 (in the front-row first header 156), and flows out from the liquid-side ports LH to the liquid-refrigerant pipe 22. As a result, as illustrated in FIG. 30, superheat regions SH21, SH22, and SH23 and a subcool region SC21 are formed during heating operation. Regions without reference signs of SH21, SH22, and SH23 of the superheat regions or SC21 of the subcool region are, mainly, two-phase refrigerant regions in which a two-phase refrigerant flows in the flat multi-hole tubes 45.

Similarly to the aforementioned embodiments, the superheat regions SH21, SH22, and SH23 are arranged so as to be superposed with each other in the air flow direction dr3. For the same reason as that described above, the areas of the superheat regions SH21, SH22, and SH23 have a relation of (the area of SH23)>(the area of SH22)>(the area of SH21). An effect obtained as a result of such a configuration is as described above.

(3-3) Modification 2C

In the aforementioned embodiments, only the heat exchanging unit of the indoor heat exchanger 125 at the front-most row includes the liquid-side flat multi-hole tubes 45*b*; however, the indoor heat exchanger 125 is not limited thereto. For example, as with an indoor heat exchanger 125*b* in FIG. 31, the liquid-side flat multi-hole tubes 45*b* may be included also in the intermediate-row heat exchanging unit 180.

The indoor heat exchanger 125*b* may satisfy a relation of (the number of the gas-side flat multi-hole tubes 45*a* of the front-row heat exchanging unit 150) (the number of the gas-side flat multi-hole tubes 45*a* of the intermediate-row heat exchanging unit 180) (the number of the gas-side flat multi-hole tubes 45*a* of the rear-row heat exchanging unit 160) and also satisfies a relation of (the number of the gas-side flat multi-hole tubes 45*a* of the front-row heat exchanging unit 150 (at the front-most row))<(the number of the gas-side flat multi-hole tubes 45*a* of the rear-row heat exchanging unit 160 (at the rear-most row)). In particular, the indoor heat exchanger 125*b* may satisfy a relation of (the number of the gas-side flat multi-hole tubes 45*a* of the front-row heat exchanging unit 150)<(the number of the gas-side flat multi-hole tubes 45*a* of the intermediate-row heat exchanging unit 180)<(the number of the gas-side flat multi-hole tubes 45*a* of the rear-row heat exchanging unit 160). Even when four rows or more of the heat exchanging units are included, such quantitative relations of the gas-side flat multi-hole tubes 45*a* may be satisfied.

In addition, the indoor heat exchanger 125*b* may satisfy a relation of (the number of the liquid-side flat multi-hole tubes 45*b* of the front-row heat exchanging unit 150) (the number of the liquid-side flat multi-hole tubes 45*b* of the intermediate-row heat exchanging unit 180). In particular, the indoor heat exchanger 125*b* may satisfy a relation of (the number of the liquid-side flat multi-hole tubes 45*b* of the front-row heat exchanging unit 150 (on the airflow upstream side))>(the number of the liquid-side flat multi-hole tubes 45*b* of the intermediate-row heat exchanging unit 180 (on the airflow downstream side)). In the present modification, a relation of (the number of the liquid-side flat multi-hole tubes 45*b* of the front-row heat exchanging unit 150)>(the number of the liquid-side flat multi-hole tubes 45*b* of the intermediate-row heat exchanging unit 180) is satisfied.

A refrigerant flow in the indoor heat exchanger 125*b* during heating operation will be roughly described. To avoid redundant description, description of a specific configuration of path arrangement is omitted.

In the indoor heat exchanger 125*a*, the gas-refrigerant port 45*aa* of each of the gas-side flat multi-hole tubes 45*a* is disposed at the end adjacent to the first headers 156, 166, and 186. The liquid-refrigerant port 45*ba* of each of the liquid-side flat multi-hole tubes 45*b* is disposed at the end adjacent to the first headers 156 and 186.

A refrigerant that has flowed through the gas-side flat multi-hole tubes 45*a* of the rear-row heat exchanging unit 160 flows into and merges together in the rear-row second header 167 and diverges and flows into end-portion openings, which are at the end adjacent to the second headers 187 and 157, of the liquid-side flat multi-hole tubes 45*b* of the intermediate-row heat exchanging unit 180 and the front-row heat exchanging unit 150. The refrigerant that has flowed through the gas-side flat multi-hole tubes 45*a* of the intermediate-row heat exchanging unit 180 flows into and merges together in the intermediate-row second header 187 and diverges and flows into end-portion openings, which are at the end adjacent to the second headers 187 and 157, of the liquid-side flat multi-hole tubes 45*b* of the intermediate-row heat exchanging unit 180 and the front-row heat exchanging unit 150. The refrigerant that has flowed through the gas-side flat multi-hole tubes 45*a* of the front-row heat exchanging unit 150 flows into and merges together in the front-row second header 157 and diverges and flows into end-portion openings at the end adjacent to the second header 157 of the liquid-side flat multi-hole tubes 45*b* of the front-row heat exchanging unit 150. The refrigerant that has passed through the flat-tube flow paths 451 of the liquid-side flat multi-hole tubes 45*b* of the intermediate-row heat exchanging unit 180 and the front-row heat exchanging unit 150 flows out from the liquid-refrigerant ports 45*ba* and finally flows in from the liquid-refrigerant pipe 22.

Figure 31:
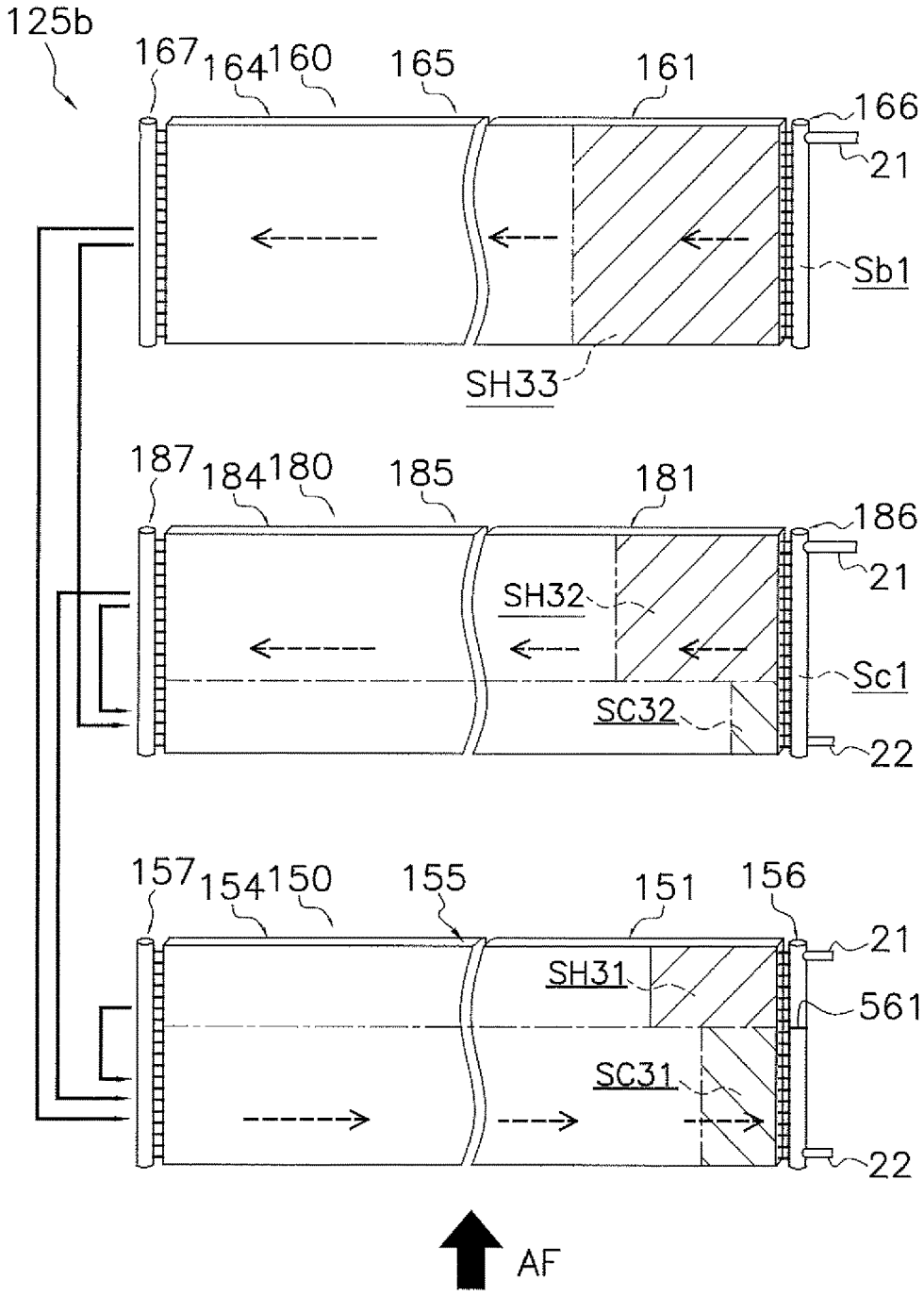
FIG. 31 is a schematic view roughly illustrating a refrigerant flow during heating operation in a front-row heat exchanging unit, an intermediate-row heat exchanging unit, and a rear-row heat exchanging unit of an indoor heat exchanger of a modification 2C.

As a result of the refrigerant thus flowing, as illustrated in FIG. 31, superheat regions SH31, SH32, and SH33 and subcool regions SC31 and SC32 are formed during heating operation in the indoor heat exchanger 125*b*. Regions without reference signs of SH21, SH22, and SH23 of the superheat regions or SC21 of the subcool region are, mainly, two-phase refrigerant regions in which a two-phase refrigerant flows in the flat multi-hole tubes 45.

In the same manner described above, the superheat regions SH31, SH32, and SH33 may be arranged so as to be superposed with each other in the air flow direction dr3. For the same reason as that described above, the areas of the superheat regions SH31, SH32, and SH33 may have a relation of (the area of SH33)>(the area of SH32)>(the area of SH31). An effect obtained as a result of such a configuration is as described below.

In the indoor heat exchanger 125*b*, the number of the liquid-side flat multi-hole tubes 45*b* included in the intermediate-row heat exchanging unit 180 on the airflow downstream side is less than the number of the liquid-side flat multi-hole tubes 45*b* included in the front-row heat exchanging unit 150 on the airflow upstream side. Thus, the length of the subcool region SC32 is less than the length of the subcool region SC31 in the flat-tube stacking direction dr2 (refer to FIG. 31). In other words, on the airflow upstream side of the liquid-side flat multi-hole tubes 45*b* of the intermediate-row heat exchanging unit 180 in the air flow direction dr3, the liquid-side flat multi-hole tubes 45*b* including the liquid-refrigerant ports 45*ba* at the end adjacent to the intermediate-row first header 186, only the liquid-side flat multi-hole tubes 45*b* of the front-row heat exchanging unit 150, the liquid-side flat multi-hole tubes 45*b* including the liquid-refrigerant ports 45*ba* at the end adjacent to the intermediate-row first header 186, are arranged at a position identical to the position of the liquid-side flat multi-hole tubes 45*b* of the intermediate-row heat exchanging unit 180 in the flat-tube stacking direction dr2. Efficiency in a heat exchange between the indoor air flow AF and a refrigerant in the front-row heat exchanging unit 150 on the airflow upstream side is higher than efficiency in a heat exchange between the indoor air flow AF and a refrigerant in the intermediate-row heat exchanging unit 180 that is disposed on the airflow downstream side of the front-row heat exchanging unit 150. Thus, the length of the subcool region SC32 is less than the length of the subcool region SC31 in the flat-tube extending direction dr1 (refer to FIG. 31). Thus, the areas of the subcool regions SC31 and SC32 have a relation of (the area of SC31)>(the area of SC32), and the subcool region SC32 is included in the subcool region SC31 when viewed in the air flow direction dr3.

As a result of such a configuration, when the indoor heat exchanger 125*b* is used as a condenser, it is possible to suppress a refrigerant that has been once cooled from being heated by air that has been heated on the airflow upstream side, and it is possible to suppress performance degradation.

The embodiments of the present invention have been described above. Forms and details thereof are, however, understood to be variously changeable without deviating from the concept and the scope of the present invention described in the claims.

The present invention can be widely usable for a heat exchanger and a refrigeration apparatus including the heat exchanger.

REFERENCE SIGNS LIST

25, 25*a*, 25*b* indoor heat exchanger (heat exchanger)
45 flat multi-hole tube
45*a* gas-side flat multi-hole tube (first gas-side flat multi-hole tube)
45*aa* gas-refrigerant port
45*b* liquid-side flat multi-hole tube
45*ba* liquid-refrigerant port
50 front-row heat exchanging unit (heat exchanging unit at the front-most row)
57 front-row second header (merging portion, header pipe)
60 rear-row heat exchanging unit (heat exchanging unit at the rear-most row)
67 rear-row second header (merging portion)
100 air conditioner (refrigeration apparatus)
125, 125*a*, 125*b* indoor heat exchanger (heat exchanger)
150 front-row heat exchanging unit (heat exchanging unit at the front-most row)
157 front-row second header (merging portion, header pipe)
160 rear-row heat exchanging unit (heat exchanging unit at the rear-most row)
167 rear-row second header (merging portion)
180 intermediate-row heat exchanging unit (heat exchanging unit)
187 intermediate-row second header (merging portion)
571 horizontal partition plate (partition plate)
SH3, SH4 superheat region (gas region)
SH11, SH12 superheat region (gas region)
SH21, SH22, SH23 superheat region (gas region)
SH31, SH32, SH33 superheat region (gas region)
dr2 flat-tube stacking direction (first direction)
dr3 air flow direction Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

The invention claimed is:

1. A heat exchanger comprising:
heat exchanging units that are superposed with one another in an air flow direction of the heat exchanger, wherein
each of the heat exchanging units comprises:
a pair of header pipes; and
flat multi-hole tubes that:
extend, between the pair of header pipes, from a first end toward a second end of each of the heat exchanging units, and
comprise gas-side flat multi-hole tubes that each comprise a gas-refrigerant port at one end of each of the gas-side flat multi-hole tubes,
a refrigerant flows in the flat multi-hole tubes,
a number of the flat multi-hole tubes is same among all the heat exchanging units,
the one end of each of the gas-side flat multi-hole tubes is connected to a space in a corresponding one of the pair of header pipes, wherein a gas-refrigerant pipe is connected to and communicates with the space,
the refrigerant flows toward the heat exchanger through the gas-refrigerant pipe when the heat exchanger functions as a condenser and the refrigerant flows out of the heat exchanger through the gas-refrigerant pipe when the heat exchanger functions as an evaporator,
at least two of the heat exchanging units comprise the gas-side flat multi-hole tubes,
in each of the heat exchanging units, the flat multi-hole tubes are disposed in a first direction, and
among the heat exchanging units, a number of the gas-side flat multi-hole tubes that are included in a front-most heat exchanging unit on an airflow upstream side of the heat exchanger is less than a number of the gas-side flat multi-hole tubes included in a rear-most heat exchanging unit on an airflow downstream side of the heat exchanger.

2. The heat exchanger according to claim 1, wherein the flat multi-hole tubes further comprise liquid-side flat multi-hole tubes that:
differ from the gas-side flat multi-hole tubes, and
each comprise a liquid-refrigerant port at one end.

3. The heat exchanger according to claim 2, wherein a total number of the gas-side flat multi-hole tubes is more than a total number of the liquid-side flat multi-hole tubes.

4. The heat exchanger according to claim 1, wherein the gas-refrigerant port included in each of the gas-side flat multi-hole tubes is disposed at the first end.

5. The heat exchanger according to claim 2, further comprising:
a merging portion that:
merges the refrigerant flowing out from the gas-side flat multi-hole tubes, and
guides the refrigerant into the liquid-side flat multi-hole tubes.

6. The heat exchanger according to claim 2, further comprising:
a partition plate that:
segregates the refrigerant flowing out from the gas-side flat multi-hole tubes among the heat exchanging units, and
is disposed in one of the header pipes that guides the refrigerant flowing out from the gas-side flat multi-hole tubes into the liquid-side flat multi-hole tubes.

7. The heat exchanger according to claim 1, wherein the refrigerant flows in an identical direction in all of the flat multi-hole tubes.

8. The heat exchanger according to claim 1, wherein
the heat exchanger comprises three of the heat exchanging units.

9. The heat exchanger according to claim 2, wherein
the heat exchanger comprises three of the heat exchanging units,
one of the pair of header pipes of only the front-most heat exchanging unit, among the three of the heat exchanging units, comprises a liquid-side port to which a liquid-refrigerant pipe is connected, and
the refrigerant flows out of the heat exchanger through the liquid-refrigerant pipe when the heat exchanger functions as a condenser and the refrigerant flows into the heat exchanger through the liquid-refrigerant pipe when the heat exchanger functions as an evaporator.

10. The heat exchanger according to claim 1, wherein
the gas-side flat multi-hole tubes include a first gas-side flat multi-hole tube that comprises the gas-refrigerant port at the first end, and the heat exchanging units are not disposed on an airflow downstream side of the first gas-side flat multi-hole tube in the air flow direction, or on the airflow downstream side of the first gas-side flat multi-hole tube, only the gas-side flat multi-hole tubes that include the gas-refrigerant port at the first end are disposed, in the first direction, at a position identical to a position of the first gas-side flat multi-hole tube.

11. The heat exchanger according to claim 1, wherein the gas-side flat multi-hole tubes each include a gas region, in which a gas refrigerant flows, in a vicinity of the gas-refrigerant port thereof, and no two-phase region in which a two-phase refrigerant flows or liquid region in which a liquid-phase refrigerant flows in the flat multi-hole tubes is disposed on an airflow downstream side of the gas region in the air flow direction.

12. A refrigeration apparatus comprising: the heat exchanger according to claim 1.

* * * * *